US011633663B2

(12) United States Patent
Challan et al.

(10) Patent No.: US 11,633,663 B2
(45) Date of Patent: Apr. 25, 2023

(54) FAIRTRADE MARKET BOARD GAME

(71) Applicants: Mohsen Bekheet Challan, Irvine, CA (US); Atteyat Ahmed Mahmoud, Irvine, CA (US); Omar Mohsen Challan, Irvine, CA (US)

(72) Inventors: Mohsen Bekheet Challan, Irvine, CA (US); Atteyat Ahmed Mahmoud, Irvine, CA (US); Omar Mohsen Challan, Irvine, CA (US)

( * ) Notice: Subject to any disclaimer, the term of this patent is extended or adjusted under 35 U.S.C. 154(b) by 0 days.

(21) Appl. No.: 17/033,793

(22) Filed: Sep. 27, 2020

(65) Prior Publication Data

US 2021/0016158 A1 Jan. 21, 2021

(51) Int. Cl.
*A63F 3/00* (2006.01)
*A63F 3/04* (2006.01)

(52) U.S. Cl.
CPC ..... *A63F 3/0457* (2013.01); *A63F 3/00063* (2013.01); *A63F 3/00176* (2013.01); *A63F 2003/00066* (2013.01); *A63F 2003/00996* (2013.01)

(58) Field of Classification Search
CPC ..... A63F 3/00063; A63F 2003/00066; A63F 2003/00189–00192
See application file for complete search history.

(56) References Cited

U.S. PATENT DOCUMENTS 590,078 A * 9/1897 Turner ..... A63F 3/00063 273/278
1,132,403 A * 3/1915 Still ..... A63F 3/00063 273/278

(Continued)

FOREIGN PATENT DOCUMENTS

GB 2215219 A * 9/1989 ..... A63F 3/00063
GB 2236059 A * 3/1991 ..... A63F 3/00063
GB 2300575 A * 11/1996 ..... A63F 3/00157

OTHER PUBLICATIONS

Age of Conan: The Strategy Board Game Rulebook, designed by Roberto Di Meglio, Marco Maggi, and Francesco Nepitello, published by NG International Srl, p. 1-8, copyright 2008; available online at https://images-cdn.fantasyflightgames.com/ffg_content/age-of-conan/media/age-of-conan-rulebook_EN.pdf (Year: 2008).*

*Primary Examiner* — Laura Davison
(74) *Attorney, Agent, or Firm* — Cohen IP Law Group, PC; Michael N. Cohen

(57) ABSTRACT

The present invention is a commodity trading multi-player game, and the game is played with a plurality of cards. It can be played "Face to Face" or "Online." The game comprises a game board, coin chips, game cards, customized dice which is a dodecahedron pentagonal prism, regulations, and rules. The game was constructed and arranged so that acquiring more commodities and money, by uniquely following the game's rules, would be the key to win the game. The present invention applies a new proposed economic theory of mutual shared-rights of the commoditerial history in fairtrade markets board game. It has a three-pronged approach: a) learning by training the expert systems about economy and markets, b) education by teaching informative, knowledgeable subjects about the US states, and c) entertainment.

21 Claims, 65 Drawing Sheets

Discloses a view of the formal game board details.

(56) References Cited

U.S. PATENT DOCUMENTS 2,526,300 A * 10/1950 Todd ..... A63F 3/00069 273/278
4,266,775 A * 5/1981 Chitnis ..... A63F 3/00063 273/272
4,687,206 A * 8/1987 Cordry ..... A63F 3/00075 273/262
5,388,836 A * 2/1995 Foti ..... A63F 3/00072 273/256
5,662,332 A * 9/1997 Garfield ..... A63F 1/00 273/308
7,815,191 B2 * 10/2010 Fanning ..... A63F 9/04 273/287
8,074,990 B2 * 12/2011 Kennedy ..... A63F 3/00006 273/241
8,454,019 B1 * 6/2013 Stuempfl ..... A63F 3/00072 273/254
8,585,055 B2 * 11/2013 Pardo ..... A63F 3/00082 273/246
9,095,768 B1 * 8/2015 Bohadi ..... A63F 3/00145
9,597,581 B2 * 3/2017 Kingsley ..... A63F 3/0415
9,795,867 B1 * 10/2017 Hughes ..... A63F 3/00574
10,512,834 B2 * 12/2019 Joshi ..... A63F 3/00063
10,518,166 B1 * 12/2019 Chen ..... A63F 3/00138
2002/0024177 A1 * 2/2002 Fikki ..... A63F 3/00063 273/256
2004/0150159 A1 * 8/2004 Wong ..... A63F 3/00138 273/256
2004/0164490 A1 * 8/2004 Glass ..... A63F 3/00072 273/256
2005/0029739 A1 * 2/2005 Smith ..... A63F 3/00072 273/256
2005/0151318 A1 * 7/2005 Tarantini ..... A63F 3/00069 273/237
2005/0258594 A1 * 11/2005 Steenstra ..... A63F 9/1288 273/241
2006/0017226 A1 * 1/2006 Yamazaki ..... A63F 3/02 273/236
2006/0033275 A1 * 2/2006 Trass ..... A63F 3/00072 273/256
2006/0202417 A1 * 9/2006 DeLaCruz-Newlan ..... A63F 3/02 273/242
2006/0232011 A1 * 10/2006 Hummel ..... A63F 1/00 273/292
2007/0045954 A1 * 3/2007 DeLaCruz-Newlan ..... A63F 3/02 273/256
2007/0057459 A1 * 3/2007 Silva ..... A63F 1/00 273/255
2007/0132181 A1 * 6/2007 Daniels ..... A63F 3/00063 273/256
2007/0265048 A1 * 11/2007 Winsick ..... G07F 17/3223 463/9
2008/0007001 A1 * 1/2008 Bowen ..... G09B 19/00 273/242
2008/0111302 A1 * 5/2008 Griffith ..... A63F 3/00072 273/256
2008/0194324 A1 * 8/2008 Treher ..... A63F 3/04 463/31
2008/0224397 A1 * 9/2008 Broadwater ..... A63F 3/00072 273/256
2009/0236801 A1 * 9/2009 Ali Bin Hashim ..... A63F 3/00072 273/256
2010/0019452 A1 * 1/2010 Woestman ..... G09B 19/18 273/256
2010/0102509 A1 * 4/2010 Pickelhaupt ..... A63F 3/00069 273/278
2011/0285085 A1 * 11/2011 Pickelhaupt ..... A63F 3/00069 273/256
2014/0073392 A1 * 3/2014 Kanekal ..... A63F 1/04 463/16
2014/0125011 A1 * 5/2014 Thompson ..... A63F 3/00063 273/256
2016/0339343 A1 * 11/2016 Gerard ..... A63F 13/12
2018/0178112 A1 * 6/2018 Guarino ..... A63F 1/04
2019/0388777 A1 * 12/2019 Brown ..... A63F 3/0023
2020/0188770 A1 * 6/2020 Strangfeld ..... A63F 9/24

* cited by examiner

ALABAMA
Montgomery/ Birmingham
52,419 sq mi (30th)
500 ft (150 m)
4,903,185 (24th)
$48,123 (47th)
UTC-06:00 (Central)
US$170 billion
64 °F (18 °C)
COTTON
Civil Rights Memorial
Edmund Pettus Bridge
ALABAMA POWER &
SAKS 5TH AVENUE
US-AL-01
The Yellowhammer State

Fig. 001

ALASKA
Juneau/ Anchorage
663,268 sq mi (1st)
1,900 ft (580 m)
710,249 (48th)
$73,181 (8th)
UTC-09:00 (Alaska)
US$55 billion, 48th
-23 °F (-32 °C)
SALMON
Denali National Park
Mt. McKinley
ARCTIC SLOPE REGIONAL &
CARR'S-SAFEWAY
US-AK-02
The Last Frontier

Fig. 002

ARIZONA
Phoenix/ Greater Phoenix
113,990 sq mi (6th)
4,100 ft (1,250 m)
7,278,717 (14th)
$56,581 (29th)
UTC−07:00
US$259 billion (20th)
40 °F (15 °C)
COPPER
The Grand Canyon
Rainbow Rock Shop
BANNER HEALTH &
WALMART STORES
US-AZ-03
The Grand Canyon State

Fig. 003

ARKANSAS
Little Rock/ Central Arkansas
53,179 sq mi (29th)
650 ft (200 m)
3,017,804 (33rd)
$45,869 (49th)
UTC-06:00 (Central)
US$119 billion (34th)
78 °F (26 °C)
BROILERS
Hot Springs National Park
Ozark Folk Center
WALMART &
TYSON FOODS
US-AR-04
The Natural State

Fig. 004

CALIFORNIA
Sacramento/ Los Angeles
163,696 sq mi (3rd)
2,900 ft (880 m)
39,512,223 (1st)
$71,228 (9th)
UTC-08:00 (PST)
US$3.0 trillion (1st)
60 °F (16 °C)
WINE
Golden Gate Bridge
Winchester Mystery House
APPLE & SOUTHERN
CALIFORNIA EDISON
US-CA-05
The Golden State "Eureka"

Fig. 005

COLORADO
Denver/ Aurora-Lakewood
104,094 sq mi (8th)
6,800 ft (2,070 m)
5,770,545 (21st)
$69,117 (12nd)
UTC-07:00 (Mountain)
US$318.6 billion (17th)
40 °F (-9 °C)
MARIJUANA
Mesa Verde National Park Red
Rocks Park
ARROW ELECTRONICS
& COORS
US-CO-06
The Centennial State

Fig. 006

CONNECTICUT
Hartford/ Bridgeport/GNY
5,567 sq mi (48th)
500 ft (150 m)
3,565,287 (29th)
$76,106 (6th)
UTC−05:00 (Eastern)
US$229.3 billion (23rd)
37 °F (3 °C)
INSURANCE
Mystic Seaport
Yale University
AETNA HEALTH INSURANCE
& GENERAL ELECTRIC (GE)
US-CT-07
The Constitution State

Fig. 007

DELAWARE
Dover/ Wilmington
1,982 sq mi (49th)
60 ft (20 m)
973,764 (45th)
$62,852 (18th)
UTC−05:00 (EST)
US61 $ billion (42rd)
46 °F (8 °C)
CORPORATIONS
Statue of Caesar Rodney
Kalmar Nyckel
DOW DUPONT & INTEGRITY
STAFFING SOLUTIONS
US-DE-10
The First State

Fig. 008

FLORIDA
Tallahassee/ Jacksonville/Miami
65,758 sq mi (22nd)
100 ft (30 m)
21,477,737 (3rd)
$53,267 (40th)
UTC-05:00 (Eastern)
US$1.0 trillion (4th)
71 °F (22 °C)
ORANGES
Disney World
Kennedy Space Center
WORLD FUEL SERVICES &
HOOTERS RESTAURANTS
US-FL-12
The Sunshine State

Fig. 009

GEORGIA
Atlanta/ Atlanta Metro
59,425 sq mi (24th)
600 ft (180 m)
10,617,423 (8th)
$56,183 (33rd)
UTC−05:00 (Eastern)
US$602 billion (9th)
58 °F (9 °C)
PEACHES
The Georgia Aquarium
Stone Mountain
THE HOME DEPOT
& COCA-COLA
US-GA-13
The Peach State

Fig. 010

HAWAII
Honolulu/ Island of O'ahu
10,931 sq mi (43rd)
3,030 ft (920 m)
1,415,872 (40th)
$77,765 (4th)
UTC−10:00 (Hawaii)
US$47 billion (46th)
56 °F (12 °C)
PINEAPPLES
The USS Arizona Memorial
Punaluu Black Sand Beach
HAWAIAN ELECTRIC IND. &
HAWAIIAN AIRLINES
US-HI-14
The Aloha State

Fig. 011

IDAHO
Boise/ Boise metropolitan
83,569 sq mi (14th)
5,000 ft (1,520 m)
1,787,065 (39th)
$52,225 (41st)
UTC−07:00 (Mountain)
US$65 billion (41st)
89 °F (31 °C)
POTATOES
Moon's Craters Monument
Salmon River Middle Fork
ARCHER DANIELS MIDLAND
CO. & MICRON TECHNOLOGY
US-ID-15
The Gem State

Fig. 012

ILLINOIS
Springfield/ Chicago
57,914 sq mi (25th)
600 ft (180 m)
12,419,000 (6th)
$62,992 (17th)
UTC-06:00 (Central)
US$880 billion (5th)
40 °F (2 °C)
FARM EQUIPMENT
The Cloud Gate &Willis Tower
& Wrigley Field
WALGREENS BOOTS AAS &
CATERPILLAR (CAT)
US-IL-16
The Land of Lincoln

Fig. 013

INDIANA
Indianapolis/ G. Indianapolis
36,418 sq mi (38th)
700 ft (210 m)
6,732,219 (17th)
$54,181 (35th)
UTC−05:00 (Eastern)
US$347.2 billion (16th)
40 °F (5 °C)
LIMESTONE
Indiana Motor Speedway
Massachusetts Avenue
ANTHEM &
CUMMINS
US-IN-17
The Hoosier State

Fig. 014

IOWA
Des Moines/ Des Moines Metro
58,273 sq mi (26th)
1,100 ft (340 m)
3,155,070 (31st)
$58,570 (26th)
UTC-06:00 (Central)
US$124 billion (33rd)
36 °F (2 °C)
CORN
The Field of Dreams "film"
Iowa State Fair
BERKSHIRE HATHAWAY
ENERGY & MAYTAG
US-IA-20
The Hawkeye State

Fig. 015

KANSAS
Topeka/ Wichita
82,278 sq mi (15th)
2,000 ft (610 m)
2,911,505 (35th)
$56,422 (31th)
UTC-06:00 (Central)
US$164 billion (29th)
41 °F (5 °C)
WHEAT
Dodge City & World's Largest
Ball of Twine KOCH
INDUSTRIES & GARMIN
INTERNATIONAL
US-KS-21
The Sunflower State

Fig. 016

KENTUCKY
Frankfort/ Louisville
40,408 sq mi (37th)
750 ft (230 m)
4,468,402 (26th)
$48,375 (44th)
UTC−05:00 (Eastern)
US$216 billion (25th)
64 °F (18 °C)
BOURBON WHISKEY
Churchill Downs Derby
Mammoth Dinosaur World
HUMANA HEALTHCARE &
LEXMARK INTERNATIONAL
US-KY-23
The Bluegrass State

Fig. 017

LOUISIANA
Baton Rouge/ New Orleans
52,069sq mi (31st)
100 ft (30 m)
4,659,978 (25TH)
$49,973 (48th)
UTC-06:00 (Central)
US$214 billion (26th)
49 °F (-1 °C)
SHRIMP
New Orleans' French Quarter
Kentwood Historical Museum
CENTURYLINK COMMUN.
& TABASCO MCILHENNY
US-LA-24
The Pelican State

Fig. 018

MAINE
Augusta/ Portland
35,385 sq mi (39th)
600 ft (180 m)
1,338,404 (42nd)
$56,277 (32nd)
UTC−05:00 (Eastern)
US$52 billion (45th)
53 °F (12 °C)
LOBSTERS
The Portland Head Light
Acadia National Park
HANNAFORD BROSTHERS
& L.L. BEAN STORES
US-ME-25
The Pine Tree State

Fig. 019

MARYLAND
Annapolis/ Baltimore
12,407 sq mi (42nd)
350 ft (110 m)
6,045,680 (19th)
$80,776 (2nd)
UTC−05:00 (Eastern)
US$382.4 billion (15th)
64 °F (18 °C)
CRABS
Baltimore's Fort McHenry
Annapolis Naval Academy
GENERAL ELECTRIC
& GEICO INSURANCE
US-MD-26
Old Line State

Fig. 020

MASSACHUSETTS
Boston/ Greater Boston
10,565 sq mi (44th)
500 ft (150 m)
6,939,373 (15th)
$77,385 (5th)
UTC−05:00 (Eastern)
US$527 billion (12nd)
58 °F (15 °C)
CRANBERRIES
Boston Common & Boston Old
Town Trolley Tour
GENERAL ELECTRIC &
PROCTER GAMBLE GILLETTE
US-MA-27
The Bay State

Fig. 021

MICHIGAN
Lansing/ Detroit
96,716 sq mi (11st)
900 ft (270 m)
9,883,635 (10th)
$54,909 (34th)
UTC-06:00 (Central)
US$538 billion (11st)
30 °F (-1 °C)
CARS
The Henry Ford Museum
Michigan's Mackinac Island
FORD MOTOR &
GENERAL MOTORS (GM)
US-MI-30
The Great Lake State

Fig. 022

MINNESOTA
Saint Paul/ Minneapolis
86,950 sq mi (12nd)
1,200 ft (370 m)
5,639,632 (22nd)
$68,388 (10th)
UTC-06:00 (Central)
US$262 billion (19th)
27 °F (-3 °C)
BUTTER
The Mall of America
Minneapolis Food Tour
UNITED HEALTH GROUP &
PILLSBURY&NESTLÉ
US-MN-31
Land of 10,000 Lakes

Fig. 023

MISSISSIPPI
Jackson/ Greater Jackson
48,430 sq mi (32nd)
300 ft (90 m)
2,976,149 (34th)
$43,567 (50th)
UTC-06:00 (Central)
US$98 billion (35th)
62 °F (18 °C)
CATFISH
Vicksburg Nat Military Park
Elvis Presley Birthplace
SANDERSON FARMS &
PEAVEY ELECTRONICS
US-MS-32
The Magnolia State

Fig. 024

MISSOURI
Jefferson/ Kansas/ St. Louis
69,715 sq mi (21st)
800 ft (244 m)
6,126,452 (18th)
$53,578 (37th)
UTC-06:00 (Central)
US$299 billion (18th)
39 °F (4 °C)
BEER
The Gateway Arch
Precious Moments Chapel
EXPRESS SCRIPTS &
ANHEUSER-BUSCH
US-MO-34
The Show Me State

Fig. 025

MONTANA
Helena/ Billings
147,040 sq mi (4th)
3,400 ft (1,040 m)
1,062,305 (43th)
$53,386 (38th)
UTC−07:00 (Mountain)
US$44.3 billion (47th)
66 °F (14 °C)
PRECIOUS METALS
Little Bighorn Battlefield
Glacier National Park
GLACIER BANCORP &
GREAT HARVEST BREAD
US-MT-35
The Big Sky State

Fig. 026

NEBRASKA
Lincoln/ Omaha
77,358 sq mi (16th)
2,600 ft (790 m)
1,929,268 (37th)
$59,970 (22th)
UTC-06:00 (Central)
US$89.8 billion (36th)
36 °F (2 °C)
BEEF
Chimney Rock in Morrill
Museum of American Speed
BERKSHIRE HATHAWAY &
CABELA'S SPORT STORES
US-NE-36
The Cornhusker State

Fig. 027

NEVADA
Carson/ Las Vegas
110,577 sq mi (7th)
5,500 ft (1,680 m)
3,034,392 (32nd)
$58,003 (27th)
UTC−08:00 (Pacific)
US$170 billion (27th)
37 °F (3 °C)
CASINOS
Las Vegas Strip
Death Valley National Park
LAS VEGAS SANDS RESORTS & ZAPPOS STORES
US-NV-37
The Silver State

Fig. 028

NEW HAMPSHIRE
Concord/ Manchester
9,349 sq mi (46th)
1,000 ft (300 m)
1,356,458 (41st)
$73,381 (7th)
UTC−05:00 (Eastern)
US$86 billion (37th)
46 °F (7 °C)
GRANITE
White Mount Aerial Tram & Washington Cog Railway
C&S WHOLESALE GROCERS & TIMBERLAND SHOES
US-NH-48
The Granite State

Fig. 029

NEW JERSEY
Trenton/ Newark/ GNY
8,723 sq mi (47th)
250 ft (80 m)
8,882,190 (11st)
$79,363 (3rd)
UTC−05:00 (Eastern)
US$639.8 billion (7th)
38 °F (3 °C)
SALTWATER TAFFY CANDY
Atlantic City Boardwalk Cape May Lighthouse
JOHNSON & JOHNSON; CAMPBELL SOUP CO.
US-NJ-41
The Garden State

Fig. 030

NEW MEXICO
Santa Fe/ Albuquerque
121,700 sq mi (5th)
5,701 ft (1,741 m)
2,096,829 (36th)
$46,744 (49th)
UTC-06:00 (Central)
US$85 billion (38th)
36 °F (4 °C)
CHILE PEPPERS
The Carlsbad Caverns
Albuquerque Balloon Rides
ALLSUP'S STORES & PNM ELECTRICITY RESOURCES
US-NM-42
The Land of Enchantment

Fig. 031

NEW YORK
Albany/ New York City
54,555 sq mi (27th)
1,000 ft (300 m)
19,453,561 (4th)
$64,894 (15th)
UTC−05:00 (Eastern)
US$1.7 trillion (4th)
33 °F (2 °C)
APPLES
The Empire State building The Statue of Liberty
IBM CORPORATION & PEPSI CO.
US-NY-43
The Empire State

Fig. 032

NORTH CAROLINA
Raleigh/ Charlotte
53,819 sq mi (28th)
700 ft (210 m)
10,488,084 (9th)
$52,752 (39th)
UTC−05:00 (Eastern)
US$496 billion (13rd)
64 °F (18 °C)
TEXTILES
The Baltimore Mansions
Wright Brothers Memorial
COMPASS FOODSERVICES & LOWE'S RETAIL
US-NC-45
The Old North State

Fig. 033

NORTH DAKOTA
Bismarck/ Fargo
70,761 sq mi (19th)
1,900 ft (580 m)
762,062 (47th)
$61,843 (19th)
UTC-06:00 (Central)
US$55.18 billion (43rd)
40 °F (10 °C)
SUNFLOWERS
Theodore Roosevelt Nat Park
World's Largest Buffalo Mon.
MDU POWER RESOURCES & BOBCAT COMPACT TRACK
US-ND-46
The Peace Garden State

Fig. 034

OHIO
Columbus/ Cincinnati
44,825 sq mi (34th)
850 ft (260 m)
11,689,100 (7th)
$54,021 (36th)
UTC−05:00 (Eastern)
US$626 billion (8th)
37 °F (3 °C)
RUBBER
Rock and Roll Hall of Fame
Zoo and Botanical Garden
CARDINAL HEALTH & WENDY'S FAST FOOD
US-OH-47
The Buckeye State

Fig. 035

OKLAHOMA
Oklahoma/ Greater Oklahoma
69,420 sq mi (20th)
1,300 ft (400 m)
3,956,971 (28th)
$50,051 (44th)
UTC-06:00 (Central)
US$131.9 billion (31st)
50 °F (20 °C)
WIND POWER
Route 66 "Mother Road" Nat. Memorial & Museum
NGL ENERGY PARTNERS & SONIC RESTAURANTS
US-OK-50
The Native America State

Fig. 036

OREGON
Salem/ Portland
98,381 sq mi (9th)
3,300 ft (1,000 m)
4,190,713 (27th)
$60,212 (21st)
UTC−08:00 (Pacific)
US$219.6 billion (24th)
33 °F (0 °C)
SNEAKERS
Crater Lake; Multnomah Falls and Columbia River
NIKE APPAREL FURNITURE
DAIMLER TRUCKS AMERICA
US-OR-51
The Beaver State

Fig. 037

PENNSYLVANIA
Harrisburg/ Philadelphia
46,055 sq mi (33rd)
1,100 ft (340 m)
12,801,989 (5th)
$59,195 (25th)
UTC−05:00 (Eastern)
US$803 billion (3rd)
57 °F (14 °C)
STEEL
Philadelphia's Liberty Bell
Gettysburg Nat Military Park
AMRISOURCE BERGEN &
THE HERSHEY COMPANY
US-PA-52
The Keystone State

Fig. 038

RHODE ISLAND
Providence/ G. Providence
1,214 sq mi (50th)
200 ft (60 m)
1,057,315 (44th)
$63,870 (16th)
UTC−05:00 (Eastern)
US$80 billion (39th)
52 °F (11 °C)
STEAMED CLAMS
The Newport Mansions Vintage Electric Streetcar
CVS HEALTH PHARMACY &
HASBRO TOYS
US-RI-53
The Ocean State

Fig. 039

SOUTH CAROLINA
Columbia/ Charleston
32,020 sq mi (40th)
350 ft (110 m)
5,148,714 (23rd)
$50,570 (43rd)
UTC−05:00 (Eastern)
US$153 billion (30th)
47 °F (8.5 °C)
BOILED PEANUTS
Battle of Fort Sumter
Charleston History Tour
MICHILEN N. AMERICA;
DENNY'S RESTAURANTS
US-SC-54
The Palmetto State

Fig. 040

SOUTH DAKOTA
Pierre/ Sioux Falls
77,116 sq mi (17th)
2,200 ft (670 m)
884,659 (46th)
$56,521 (30th)
UTC-06:00 (Central)
US$39.8 billion (48th)
31 °F (-1 °C)
PORK
Mount Rushmore Nat Mem
Terrific TeaPot Museum
TYSON FRESH MEATS &
SUPER 8 HOTELS
US-SD-56
The Mount Rushmore State

Fig. 041

TENNESSEE
Nashville/ G Nashville
42,143 sq mi (36th)
900 ft (270 m)
6,833,793 (16th)
$52,340 (42nd)
UTC-05:00 (Eastern)
US$234 billion (22nd)
41 °F (5 °C)
WHISKEY
Graceland Exhibition Cent.
Grand Ole Opry
FEDEX COURIER &
HCA HEALTHCARE
US-TN-57
The Volunteer State

Fig. 042

TEXAS
Austin/ Houston/ Dallas
268,581 sq mi (2nd)
1,700 ft (520 m)
28,995,881 (2nd)
$59,206 (24th)
UTC-06:00 (Central)
US$1.8 trillion (2nd)
76 °F (20 °C)
PETROLEUM
The Alamo Battle
Big Bend National Park
EXXON MOBILE &
DR PEPPER
US-TX-60
The Lone Star State

Fig. 043

UTAH
Salt Lake/ Salt Lake Metro
84,899 sq mi (13rd)
6,100 ft (1,860 m)
3,205,958 (30th)
$68,374 (14th)
UTC-07:00 (Mountain)
US$130.5 billion (32nd)
58 °F (6 °C)
CANDY
The Salt Lake Temple
Monument Valley Safari
SINCLAIR OIL &
AUTOLIV SAFETY SUPPLIER
US-UT-61
The Beehive State

Fig. 044

VERMONT
Montpelier/ Burlington
9,616 sq mi (45th)
1,000 ft (300 m)
4,903,185 (49th)
$57,513 (28th)
UTC-05:00 (Eastern)
US$19.3 billion (50th)
28 °F (-3 °C)
MAPLE SYRUP
Covered bridges
Burlington Brewery Tour
NLV FINANCIAL &
BEN & JERRY'S
US-VT-62
The Green Mountain State

Fig. 045

VIRGINIA
Richmond/ Virginia Beach
42,774 sq mi (35th)
950 ft (290 m)
8,517,685 (12th)
$71,535 (10th)
UTC-05:00 (Eastern)
US$476.4 billion (14th)
56 °F (14 °C)
TOBACCO
The Arlington Nat Cemetery T. Jefferson's Monticello
GENERAL DYNAMICS & America OnLine "AOL"
US-VA-63
The Old Dominion State

Fig. 046

WASHINGTON
Olympia/ Seattle
71,362 sq mi (18th)
1,700 ft (520 m)
7,535,591 (13rd)
$70,979 (11st)
UTC-08:00 (Pacific)
US$570 billion (10th)
35 °F (2 °C)
AIRPLANES
Seattle's The Space Needle
Chihuly Garden and Glass
AMAZON & STARBUCKS
US-WA-64
The Evergreen State

Fig. 047

WEST VIRGINIA
Charleston/ Huntington
24,230 sq mi (41st)
1,513 ft (461 m)
1,805,832 (38TH)
$43,469 (34th)
UTC-05:00 (Eastern)
US$78 billion (40th)
64 °F (18 °C)
COAL
New River Gorge Bridge
Methodist Episcopal Church
MONOGAHELA POWER & GINO'S PIZZA
US-WV-65
The Mountain State

Fig. 048

WISCONSIN
Madison/ Milwaukee
65,498 sq mi (23rd)
1,050 ft (320 m)
5,822,434 (20th)
$59,305 (23rd)
UTC-06:00 (Central)
US$248.3 billion (21st)
30 °F (-1 °C)
CHEESE
Wisconsin Dells Waterpark
Milwaukee City Tour
JOHNSON CONTROLS INT. & HARLEY-DAVIDSON
US-WI-67
The Badger State

Fig. 049

WYOMING
Cheyenne/ Cheyenne Metro
97,914 sq mi (10th)
6,700 ft (2,040 m)
578,759 (50th)
$62,268 (20th)
UTC-07:00 (Mountain)
US$38.4 billion (49th)
72 °F (22 °C)
HORSES
Yellowstone National Park
Grand Teton Wildlife Safari
CLOUD PEAK ENERGY & TACO JOHN'S
US-WY-70
The Equality State

Fig. 050

| ALABAMA Production Card | |
|---|---|
| State Commodity Code | 01 |
| Production Coefficient | 0.33 |
| Production Efficiency | 0.44 |
| Required Quantity (kp) | 35 |
| Production Tax (pp) | 0.07 |
| Production Price (pp) | 1.33 |
| Producer (Q) Profit (k$) | 5 |
| Buyer (Q) Profit (k$) | 5 |
| Production (Q) Tax (k$) | 2 |
| Total Quantity Cost (k$) | 46 |

US-AL-01
The Yellowhammer State

Fig. 051

| ALASKA Production Card | |
|---|---|
| State Commodity Code | 02 |
| Production Coefficient | 0.74 |
| Production Efficiency | 1.28 |
| Required Quantity (kp) | 77 |
| Production Tax (pp) | 0.09 |
| Production Price (pp) | 1.74 |
| Producer (Q) Profit (k$) | 13 |
| Buyer (Q) Profit (k$) | 13 |
| Production (Q) Tax (k$) | 7 |
| Total Quantity Cost (k$) | 134 |

US-AK-02
The Last Frontier

Fig. 052

| ARIZONA Production Card | |
|---|---|
| State Commodity Code | 03 |
| Production Coefficient | 0.34 |
| Production Efficiency | 0.45 |
| Required Quantity (kp) | 36 |
| Production Tax (pp) | 0.07 |
| Production Price (pp) | 1.34 |
| Producer (Q) Profit (k$) | 5 |
| Buyer (Q) Profit (k$) | 5 |
| Production (Q) Tax (k$) | 2 |
| Total Quantity Cost (k$) | 48 |

US-AZ-03
The Grand Canyon State

Fig. 053

| ARKANSAS Production Card | |
|---|---|
| State Commodity Code | 04 |
| Production Coefficient | 0.37 |
| Production Efficiency | 0.51 |
| Required Quantity (kp) | 39 |
| Production Tax (pp) | 0.07 |
| Production Price (pp) | 1.37 |
| Producer (Q) Profit (k$) | 5 |
| Buyer (Q) Profit (k$) | 5 |
| Production (Q) Tax (k$) | 3 |
| Total Quantity Cost (k$) | 54 |

US-AR-04
The Natural State

Fig. 054

| CALIFORNIA Production Card | |
|---|---|
| State Commodity Code | 05 |
| Production Coefficient | 0.72 |
| Production Efficiency | 1.24 |
| Required Quantity (kp) | 76 |
| Production Tax (pp) | 0.09 |
| Production Price (pp) | 1.72 |
| Producer (Q) Profit (k$) | 13 |
| Buyer (Q) Profit (k$) | 13 |
| Production (Q) Tax (k$) | 7 |
| Total Quantity Cost (k$) | 131 |

US-CA-05
The Golden State "Eureka"

Fig. 055

| COLORADO Production Card | |
|---|---|
| State Commodity Code | 06 |
| Production Coefficient | 0.52 |
| Production Efficiency | 0.80 |
| Required Quantity (kp) | 55 |
| Production Tax (pp) | 0.08 |
| Production Price (pp) | 1.52 |
| Producer (Q) Profit (k$) | 8 |
| Buyer (Q) Profit (k$) | 8 |
| Production (Q) Tax (k$) | 4 |
| Total Quantity Cost (k$) | 84 |

US-CO-06
The Centennial State

Fig. 056

| CONNECTICUT Production Card | |
|---|---|
| State Commodity Code | 07 |
| Production Coefficient | 0.61 |
| Production Efficiency | 0.98 |
| Required Quantity (kp) | 64 |
| Production Tax (pp) | 0.08 |
| Production Price (pp) | 1.61 |
| Producer (Q) Profit (k$) | 10 |
| Buyer (Q) Profit (k$) | 10 |
| Production (Q) Tax (k$) | 5 |
| Total Quantity Cost (k$) | 104 |

US-CT-07
The Constitution State

Fig. 057

| DELAWARE Production Card | |
|---|---|
| State Commodity Code | 10 |
| Production Coefficient | 0.60 |
| Production Efficiency | 0.95 |
| Required Quantity (kp) | 63 |
| Production Tax (pp) | 0.08 |
| Production Price (pp) | 1.60 |
| Producer (Q) Profit (k$) | 10 |
| Buyer (Q) Profit (k$) | 10 |
| Production (Q) Tax (k$) | 5 |
| Total Quantity Cost (k$) | 100 |

US-DE-10
The First State

Fig. 058

| FLORIDA Production Card | |
|---|---|
| State Commodity Code | 12 |
| Production Coefficient | 0.44 |
| Production Efficiency | 0.64 |
| Required Quantity (kp) | 47 |
| Production Tax (pp) | 0.07 |
| Production Price (pp) | 1.44 |
| Producer (Q) Profit (k$) | 7 |
| Buyer (Q) Profit (k$) | 7 |
| Production (Q) Tax (k$) | 3 |
| Total Quantity Cost (k$) | 67 |

US-FL-12
The Sunshine State

Fig. 059

| GEORGIA Production Card | |
|---|---|
| State Commodity Code | 13 |
| Production Coefficient | 0.54 |
| Production Efficiency | 0.83 |
| Required Quantity (kp) | 57 |
| Production Tax (pp) | 0.08 |
| Production Price (pp) | 1.54 |
| Producer (Q) Profit (k$) | 9 |
| Buyer (Q) Profit (k$) | 9 |
| Production (Q) Tax (k$) | 4 |
| Total Quantity Cost (k$) | 87 |

US-GA-13
The Peach State

Fig. 060

| HAWAII Production Card | |
|---|---|
| State Commodity Code | 14 |
| Production Coefficient | 0.32 |
| Production Efficiency | 0.41 |
| Required Quantity (kp) | 33 |
| Production Tax (pp) | 0.07 |
| Production Price (pp) | 1.32 |
| Producer (Q) Profit (k$) | 4 |
| Buyer (Q) Profit (k$) | 4 |
| Production (Q) Tax (k$) | 2 |
| Total Quantity Cost (k$) | 44 |

US-HI-14
The Aloha State

Fig. 061

| IDAHO Production Card | |
|---|---|
| State Commodity Code | 15 |
| Production Coefficient | 0.35 |
| Production Efficiency | 0.46 |
| Required Quantity (kp) | 36 |
| Production Tax (pp) | 0.07 |
| Production Price (pp) | 1.35 |
| Producer (Q) Profit (k$) | 5 |
| Buyer (Q) Profit (k$) | 5 |
| Production (Q) Tax (k$) | 2 |
| Total Quantity Cost (k$) | 49 |

US-ID-15
The Gem State

Fig. 062

| ILLINOIS Production Card | |
|---|---|
| State Commodity Code | 16 |
| Production Coefficient | 0.67 |
| Production Efficiency | 1.13 |
| Required Quantity (kp) | 71 |
| Production Tax (pp) | 0.08 |
| Production Price (pp) | 1.67 |
| Producer (Q) Profit (k$) | 12 |
| Buyer (Q) Profit (k$) | 12 |
| Production (Q) Tax (k$) | 6 |
| Total Quantity Cost (k$) | 119 |

US-IL-16
The Land of Lincoln

Fig. 063

| INDIANA Production Card | |
|---|---|
| State Commodity Code | 17 |
| Production Coefficient | 0.49 |
| Production Efficiency | 0.73 |
| Required Quantity (kp) | 52 |
| Production Tax (pp) | 0.07 |
| Production Price (pp) | 1.49 |
| Producer (Q) Profit (k$) | 8 |
| Buyer (Q) Profit (k$) | 8 |
| Production (Q) Tax (k$) | 4 |
| Total Quantity Cost (k$) | 77 |

US-IN-17
The Hoosier State

Fig. 064

| IOWA Production Card | |
|---|---|
| State Commodity Code | 20 |
| Production Coefficient | 0.37 |
| Production Efficiency | 0.51 |
| Required Quantity (kp) | 39 |
| Production Tax (pp) | 0.07 |
| Production Price (pp) | 1.37 |
| Producer (Q) Profit (k$) | 5 |
| Buyer (Q) Profit (k$) | 5 |
| Production (Q) Tax (k$) | 3 |
| Total Quantity Cost (k$) | 54 |

US-IA-20
The Hawkeye State

Fig. 065

| KANSAS Production Card | |
|---|---|
| State Commodity Code | 21 |
| Production Coefficient | 0.54 |
| Production Efficiency | 0.82 |
| Required Quantity (kp) | 56 |
| Production Tax (pp) | 0.08 |
| Production Price (pp) | 1.54 |
| Producer (Q) Profit (k$) | 9 |
| Buyer (Q) Profit (k$) | 9 |
| Production (Q) Tax (k$) | 4 |
| Total Quantity Cost (k$) | 86 |

US-KS-21
The Sunflower State

Fig. 066

| KENTUCKY Production Card | |
|---|---|
| State Commodity Code | 23 |
| Production Coefficient | 0.46 |
| Production Efficiency | 0.67 |
| Required Quantity (kp) | 48 |
| Production Tax (pp) | 0.07 |
| Production Price (pp) | 1.46 |
| Producer (Q) Profit (k$) | 7 |
| Buyer (Q) Profit (k$) | 7 |
| Production (Q) Tax (k$) | 4 |
| Total Quantity Cost (k$) | 71 |

US-KY-23
The Bluegrass State

Fig. 067

| LOUISIANA Production Card | |
|---|---|
| State Commodity Code | 24 |
| Production Coefficient | 0.44 |
| Production Efficiency | 0.63 |
| Required Quantity (kp) | 46 |
| Production Tax (pp) | 0.07 |
| Production Price (pp) | 1.44 |
| Producer (Q) Profit (k$) | 7 |
| Buyer (Q) Profit (k$) | 7 |
| Production (Q) Tax (k$) | 3 |
| Total Quantity Cost (k$) | 66 |

US-LA-24
The Pelican State

Fig. 068

| MAINE Production Card | |
|---|---|
| State Commodity Code | 25 |
| Production Coefficient | 0.37 |
| Production Efficiency | 0.51 |
| Required Quantity (kp) | 39 |
| Production Tax (pp) | 0.07 |
| Production Price (pp) | 1.37 |
| Producer (Q) Profit (k$) | 5 |
| Buyer (Q) Profit (k$) | 5 |
| Production (Q) Tax (k$) | 3 |
| Total Quantity Cost (k$) | 53 |

US-ME-25
The Pine Tree State

Fig. 069

| MARYLAND Production Card | |
|---|---|
| State Commodity Code | 26 |
| Production Coefficient | 0.60 |
| Production Efficiency | 0.96 |
| Required Quantity (kp) | 63 |
| Production Tax (pp) | 0.08 |
| Production Price (pp) | 1.60 |
| Producer (Q) Profit (k$) | 10 |
| Buyer (Q) Profit (k$) | 10 |
| Production (Q) Tax (k$) | 5 |
| Total Quantity Cost (k$) | 101 |

US-MD-26
Old Line State

Fig. 070

| MASSACHUSETTS Production Card | |
|---|---|
| State Commodity Code | 27 |
| Production Coefficient | 0.72 |
| Production Efficiency | 1.24 |
| Required Quantity (kp) | 76 |
| Production Tax (pp) | 0.09 |
| Production Price (pp) | 1.72 |
| Producer (Q) Profit (k$) | 13 |
| Buyer (Q) Profit (k$) | 13 |
| Production (Q) Tax (k$) | 7 |
| Total Quantity Cost (k$) | 131 |

US-MA-27
The Bay State

Fig. 071

| MICHIGAN Production Card | |
|---|---|
| State Commodity Code | 30 |
| Production Coefficient | 0.52 |
| Production Efficiency | 0.78 |
| Required Quantity (kp) | 54 |
| Production Tax (pp) | 0.08 |
| Production Price (pp) | 1.52 |
| Producer (Q) Profit (k$) | 8 |
| Buyer (Q) Profit (k$) | 8 |
| Production (Q) Tax (k$) | 4 |
| Total Quantity Cost (k$) | 83 |

US-MI-30
The Great Lake State

Fig. 072

| MINNESOTA Production Card | |
|---|---|
| State Commodity Code | 31 |
| Production Coefficient | 0.44 |
| Production Efficiency | 0.64 |
| Required Quantity (kp) | 46 |
| Production Tax (pp) | 0.07 |
| Production Price (pp) | 1.44 |
| Producer (Q) Profit (k$) | 7 |
| Buyer (Q) Profit (k$) | 7 |
| Production (Q) Tax (k$) | 3 |
| Total Quantity Cost (k$) | 67 |

US-MN-31
Land of 10,000 Lakes

Fig. 073

| MISSISSIPPI Production Card | |
|---|---|
| State Commodity Code | 32 |
| Production Coefficient | 0.31 |
| Production Efficiency | 0.41 |
| Required Quantity (kp) | 33 |
| Production Tax (pp) | 0.07 |
| Production Price (pp) | 1.31 |
| Producer (Q) Profit (k$) | 4 |
| Buyer (Q) Profit (k$) | 4 |
| Production (Q) Tax (k$) | 2 |
| Total Quantity Cost (k$) | 43 |

US-MS-32
The Magnolia State

Fig. 074

| MISSOURI Production Card | |
|---|---|
| State Commodity Code | 34 |
| Production Coefficient | 0.46 |
| Production Efficiency | 0.68 |
| Required Quantity (kp) | 49 |
| Production Tax (pp) | 0.07 |
| Production Price (pp) | 1.46 |
| Producer (Q) Profit (k$) | 7 |
| Buyer (Q) Profit (k$) | 7 |
| Production (Q) Tax (k$) | 4 |
| Total Quantity Cost (k$) | 71 |

US-MO-34
The Show Me State

Fig. 075

| MONTANA Production Card | |
|---|---|
| State Commodity Code | 35 |
| Production Coefficient | 0.40 |
| Production Efficiency | 0.55 |
| Required Quantity (kp) | 42 |
| Production Tax (pp) | 0.07 |
| Production Price (pp) | 1.40 |
| Producer (Q) Profit (k$) | 6 |
| Buyer (Q) Profit (k$) | 6 |
| Production (Q) Tax (k$) | 3 |
| Total Quantity Cost (k$) | 58 |

US-MT-35
The Big Sky State

Fig. 076

| NEBRASKA Production Card | |
|---|---|
| State Commodity Code | 36 |
| Production Coefficient | 0.44 |
| Production Efficiency | 0.64 |
| Required Quantity (kp) | 47 |
| Production Tax (pp) | 0.07 |
| Production Price (pp) | 1.44 |
| Producer (Q) Profit (k$) | 7 |
| Buyer (Q) Profit (k$) | 7 |
| Production (Q) Tax (k$) | 3 |
| Total Quantity Cost (k$) | 67 |

US-NE-36
The Cornhusker State

Fig. 077

| NEVADA Production Card | |
|---|---|
| State Commodity Code | 37 |
| Production Coefficient | 0.53 |
| Production Efficiency | 0.82 |
| Required Quantity (kp) | 56 |
| Production Tax (pp) | 0.08 |
| Production Price (pp) | 1.53 |
| Producer (Q) Profit (k$) | 9 |
| Buyer (Q) Profit (k$) | 9 |
| Production (Q) Tax (k$) | 4 |
| Total Quantity Cost (k$) | 86 |
| US-NV-37 The Silver State | |

Fig. 078

| NEW HAMPSHIRE Production Card | |
|---|---|
| State Commodity Code | 40 |
| Production Coefficient | 0.60 |
| Production Efficiency | 0.97 |
| Required Quantity (kp) | 63 |
| Production Tax (pp) | 0.08 |
| Production Price (pp) | 1.60 |
| Producer (Q) Profit (k$) | 10 |
| Buyer (Q) Profit (k$) | 10 |
| Production (Q) Tax (k$) | 5 |
| Total Quantity Cost (k$) | 102 |
| US-NH-40 The Granite State | |

Fig. 079

| NEW JERSEY Production Card | |
|---|---|
| State Commodity Code | 41 |
| Production Coefficient | 0.68 |
| Production Efficiency | 1.15 |
| Required Quantity (kp) | 72 |
| Production Tax (pp) | 0.08 |
| Production Price (pp) | 1.68 |
| Producer (Q) Profit (k$) | 12 |
| Buyer (Q) Profit (k$) | 12 |
| Production (Q) Tax (k$) | 6 |
| Total Quantity Cost (k$) | 121 |
| US-NJ-41 The Garden State | |

Fig. 080

| NEW MEXICO Production Card | |
|---|---|
| State Commodity Code | 42 |
| Production Coefficient | 0.39 |
| Production Efficiency | 0.53 |
| Required Quantity (kp) | 41 |
| Production Tax (pp) | 0.07 |
| Production Price (pp) | 1.39 |
| Producer (Q) Profit (k$) | 6 |
| Buyer (Q) Profit (k$) | 6 |
| Production (Q) Tax (k$) | 3 |
| Total Quantity Cost (k$) | 56 |
| US-NM-42 The Land of Enchantment | |

Fig. 081

| NEW YORK Production Card | |
|---|---|
| State Commodity Code | 43 |
| Production Coefficient | 0.83 |
| Production Efficiency | 1.52 |
| Required Quantity (kp) | 87 |
| Production Tax (pp) | 0.09 |
| Production Price (pp) | 1.83 |
| Producer (Q) Profit (k$) | 16 |
| Buyer (Q) Profit (k$) | 16 |
| Production (Q) Tax (k$) | 8 |
| Total Quantity Cost (k$) | 160 |
| US-NY-43 The Empire State | |

Fig. 082

| NORTH CAROLINA Production Card | |
|---|---|
| State Commodity Code | 45 |
| Production Coefficient | 0.45 |
| Production Efficiency | 0.65 |
| Required Quantity (kp) | 47 |
| Production Tax (pp) | 0.07 |
| Production Price (pp) | 1.45 |
| Producer (Q) Profit (k$) | 7 |
| Buyer (Q) Profit (k$) | 7 |
| Production (Q) Tax (k$) | 3 |
| Total Quantity Cost (k$) | 69 |
| US-NC-45 The Old North State | |

Fig. 083

| NORTH DAKOTA Production Card | |
|---|---|
| State Commodity Code | 46 |
| Production Coefficient | 0.69 |
| Production Efficiency | 1.16 |
| Required Quantity (kp) | 72 |
| Production Tax (pp) | 0.08 |
| Production Price (pp) | 1.69 |
| Producer (Q) Profit (k$) | 12 |
| Buyer (Q) Profit (k$) | 12 |
| Production (Q) Tax (k$) | 6 |
| Total Quantity Cost (k$) | 122 |
| US-ND-46 The Peace Garden State | |

Fig. 084

| OHIO Production Card | |
|---|---|
| State Commodity Code | 47 |
| Production Coefficient | 0.51 |
| Production Efficiency | 0.77 |
| Required Quantity (kp) | 54 |
| Production Tax (pp) | 0.08 |
| Production Price (pp) | 1.51 |
| Producer (Q) Profit (k$) | 8 |
| Buyer (Q) Profit (k$) | 8 |
| Production (Q) Tax (k$) | 4 |
| Total Quantity Cost (k$) | 81 |
| US-OH-47 The Buckeye State | |

Fig. 085

| OKLAHOMA Production Card | |
|---|---|
| State Commodity Code | 50 |
| Production Coefficient | 0.32 |
| Production Efficiency | 0.42 |
| Required Quantity (kp) | 33 |
| Production Tax (pp) | 0.07 |
| Production Price (pp) | 1.32 |
| Producer (Q) Profit (k$) | 4 |
| Buyer (Q) Profit (k$) | 4 |
| Production (Q) Tax (k$) | 2 |
| Total Quantity Cost (k$) | 44 |
| US-OK-50 The Native America State | |

Fig. 086

| OREGON Production Card | |
|---|---|
| State Commodity Code | 51 |
| Production Coefficient | 0.50 |
| Production Efficiency | 0.75 |
| Required Quantity (kp) | 52 |
| Production Tax (pp) | 0.07 |
| Production Price (pp) | 1.50 |
| Producer (Q) Profit (k$) | 8 |
| Buyer (Q) Profit (k$) | 8 |
| Production (Q) Tax (k$) | 4 |
| Total Quantity Cost (k$) | 78 |

US-OR-51
The Beaver State

Fig. 087

| PENNSYLVANIA Production Card | |
|---|---|
| State Commodity Code | 52 |
| Production Coefficient | 0.60 |
| Production Efficiency | 0.95 |
| Required Quantity (kp) | 63 |
| Production Tax (pp) | 0.08 |
| Production Price (pp) | 1.60 |
| Producer (Q) Profit (k$) | 10 |
| Buyer (Q) Profit (k$) | 10 |
| Production (Q) Tax (k$) | 5 |
| Total Quantity Cost (k$) | 100 |

US-PA-52
The Keystone State

Fig. 088

| RHODE ISLAND Production Card | |
|---|---|
| State Commodity Code | 53 |
| Production Coefficient | 0.72 |
| Production Efficiency | 1.24 |
| Required Quantity (kp) | 76 |
| Production Tax (pp) | 0.09 |
| Production Price (pp) | 1.72 |
| Producer (Q) Profit (k$) | 13 |
| Buyer (Q) Profit (k$) | 13 |
| Production (Q) Tax (k$) | 7 |
| Total Quantity Cost (k$) | 130 |

US-RI-53
The Ocean State

Fig. 089

| SOUTH CAROLINA Production Card | |
|---|---|
| State Commodity Code | 54 |
| Production Coefficient | 0.28 |
| Production Efficiency | 0.36 |
| Required Quantity (kp) | 30 |
| Production Tax (pp) | 0.06 |
| Production Price (pp) | 1.28 |
| Producer (Q) Profit (k$) | 4 |
| Buyer (Q) Profit (k$) | 4 |
| Production (Q) Tax (k$) | 2 |
| Total Quantity Cost (k$) | 38 |

US-SC-54
The Palmetto State

Fig. 090

| SOUTH DAKOTA Production Card | |
|---|---|
| State Commodity Code | 56 |
| Production Coefficient | 0.43 |
| Production Efficiency | 0.61 |
| Required Quantity (kp) | 45 |
| Production Tax (pp) | 0.07 |
| Production Price (pp) | 1.43 |
| Producer (Q) Profit (k$) | 6 |
| Buyer (Q) Profit (k$) | 6 |
| Production (Q) Tax (k$) | 3 |
| Total Quantity Cost (k$) | 64 |

US-SD-56
The Mount Rushmore State

Fig. 091

| TENNESSEE Production Card | |
|---|---|
| State Commodity Code | 57 |
| Production Coefficient | 0.33 |
| Production Efficiency | 0.43 |
| Required Quantity (kp) | 34 |
| Production Tax (pp) | 0.07 |
| Production Price (pp) | 1.33 |
| Producer (Q) Profit (k$) | 5 |
| Buyer (Q) Profit (k$) | 5 |
| Production (Q) Tax (k$) | 2 |
| Total Quantity Cost (k$) | 45 |

US-TN-57
The Volunteer State

Fig. 092

| TEXAS Production Card | |
|---|---|
| State Commodity Code | 60 |
| Production Coefficient | 0.59 |
| Production Efficiency | 0.94 |
| Required Quantity (kp) | 62 |
| Production Tax (pp) | 0.08 |
| Production Price (pp) | 1.59 |
| Producer (Q) Profit (k$) | 10 |
| Buyer (Q) Profit (k$) | 10 |
| Production (Q) Tax (k$) | 5 |
| Total Quantity Cost (k$) | 99 |

US-TX-60
The Lone Star State

Fig. 093

| UTAH Production Card | |
|---|---|
| State Commodity Code | 61 |
| Production Coefficient | 0.39 |
| Production Efficiency | 0.54 |
| Required Quantity (kp) | 41 |
| Production Tax (pp) | 0.07 |
| Production Price (pp) | 1.39 |
| Producer (Q) Profit (k$) | 6 |
| Buyer (Q) Profit (k$) | 6 |
| Production (Q) Tax (k$) | 3 |
| Total Quantity Cost (k$) | 56 |

US-UT-61
The Beehive State

Fig. 094

| VERMONT Production Card | |
|---|---|
| State Commodity Code | 62 |
| Production Coefficient | 0.29 |
| Production Efficiency | 0.38 |
| Required Quantity (kp) | 31 |
| Production Tax (pp) | 0.06 |
| Production Price (pp) | 1.29 |
| Producer (Q) Profit (k$) | 4 |
| Buyer (Q) Profit (k$) | 4 |
| Production (Q) Tax (k$) | 2 |
| Total Quantity Cost (k$) | 40 |

US-VT-62
The Green Mountain State

Fig. 095

| VIRGINIA Production Card | |
|---|---|
| State Commodity Code | 63 |
| Production Coefficient | 0.53 |
| Production Efficiency | 0.81 |
| Required Quantity (kp) | 56 |
| Production Tax (pp) | 0.08 |
| Production Price (pp) | 1.53 |
| Producer (Q) Profit (k$) | 9 |
| Buyer (Q) Profit (k$) | 9 |
| Production (Q) Tax (k$) | 4 |
| Total Quantity Cost (k$) | 86 |

US-VA-63
The Old Dominion State

Fig. 096

| WASHINGTON Production Card | |
|---|---|
| State Commodity Code | 64 |
| Production Coefficient | 0.72 |
| Production Efficiency | 1.23 |
| Required Quantity (kp) | 76 |
| Production Tax (pp) | 0.09 |
| Production Price (pp) | 1.72 |
| Producer (Q) Profit (k$) | 13 |
| Buyer (Q) Profit (k$) | 13 |
| Production (Q) Tax (k$) | 6 |
| Total Quantity Cost (k$) | 130 |

US-WA-64
The Evergreen State

Fig. 097

| WEST VIRGINIA Production Card | |
|---|---|
| State Commodity Code | 65 |
| Production Coefficient | 0.41 |
| Production Efficiency | 0.58 |
| Required Quantity (kp) | 43 |
| Production Tax (pp) | 0.07 |
| Production Price (pp) | 1.41 |
| Producer (Q) Profit (k$) | 6 |
| Buyer (Q) Profit (k$) | 6 |
| Production (Q) Tax (k$) | 3 |
| Total Quantity Cost (k$) | 61 |

US-WV-65
The Mountain State

Fig. 098

| WISCONSIN Production Card | |
|---|---|
| State Commodity Code | 67 |
| Production Coefficient | 0.41 |
| Production Efficiency | 0.57 |
| Required Quantity (kp) | 43 |
| Production Tax (pp) | 0.07 |
| Production Price (pp) | 1.41 |
| Producer (Q) Profit (k$) | 6 |
| Buyer (Q) Profit (k$) | 6 |
| Production (Q) Tax (k$) | 3 |
| Total Quantity Cost (k$) | 60 |

US-WI-67
The Badger State

Fig. 099

| WYOMING Production Card | |
|---|---|
| State Commodity Code | 70 |
| Production Coefficient | 0.63 |
| Production Efficiency | 1.03 |
| Required Quantity (kp) | 66 |
| Production Tax (pp) | 0.08 |
| Production Price (pp) | 1.63 |
| Producer (Q) Profit (k$) | 11 |
| Buyer (Q) Profit (k$) | 11 |
| Production (Q) Tax (k$) | 5 |
| Total Quantity Cost (k$) | 108 |

US-WY-70
The Equality State

Fig. 100

| ALABAMA Manufacturing Card | |
|---|---|
| State Commodity Code | 01 |
| Mfg. Coefficient | 0.12 |
| Mfg. Efficiency | 0.23 |
| Required Quantity (kp) | 35 |
| Mfg. Tax (pp) | 0.09 |
| Mfg. Price (pp) | 1.83 |
| Mfr. Quantity Profit (k$) | 6 |
| Buyer (Q) Profit (k$) | 6 |
| Mfg. (Q) Tax (k$) | 3 |
| Total Quantity Cost (k$) | 63 |
| US-AL-01 The Yellowhammer State | |

Fig. 101

| ALASKA Manufacturing Card | |
|---|---|
| State Commodity Code | 02 |
| Mfg. Coefficient | 0.06 |
| Mfg. Efficiency | 0.13 |
| Required Quantity (kp) | 77 |
| Mfg. Tax (pp) | 0.11 |
| Mfg. Price (pp) | 2.27 |
| Mfr. Quantity Profit (k$) | 18 |
| Buyer (Q) Profit (k$) | 18 |
| Mfg. (Q) Tax (k$) | 9 |
| Total Quantity Cost (k$) | 175 |
| US-AK-02 The Last Frontier | |

Fig. 102

| ARIZONA Manufacturing Card | |
|---|---|
| State Commodity Code | 03 |
| Mfg. Coefficient | 0.12 |
| Mfg. Efficiency | 0.22 |
| Required Quantity (kp) | 36 |
| Mfg. Tax (pp) | 0.09 |
| Mfg. Price (pp) | 1.83 |
| Mfr. Quantity Profit (k$) | 7 |
| Buyer (Q) Profit (k$) | 7 |
| Mfg. (Q) Tax (k$) | 3 |
| Total Quantity Cost (k$) | 65 |
| US-AZ-03 The Grand Canyon State | |

Fig. 103

| ARKANSAS Manufacturing Card | |
|---|---|
| State Commodity Code | 04 |
| Mfg. Coefficient | 0.11 |
| Mfg. Efficiency | 0.20 |
| Required Quantity (kp) | 39 |
| Mfg. Tax (pp) | 0.09 |
| Mfg. Price (pp) | 1.87 |
| Mfr. Quantity Profit (k$) | 7 |
| Buyer (Q) Profit (k$) | 7 |
| Mfg. (Q) Tax (k$) | 4 |
| Total Quantity Cost (k$) | 74 |
| US-AR-04 The Natural State | |

Fig. 104

| CALIFORNIA Manufacturing Card | |
|---|---|
| State Commodity Code | 05 |
| Mfg. Coefficient | 0.06 |
| Mfg. Efficiency | 0.13 |
| Required Quantity (kp) | 76 |
| Mfg. Tax (pp) | 0.11 |
| Mfg. Price (pp) | 2.25 |
| Mfr. Quantity Profit (k$) | 17 |
| Buyer (Q) Profit (k$) | 17 |
| Mfg. (Q) Tax (k$) | 9 |
| Total Quantity Cost (k$) | 171 |
| US-CA-05 The Golden State "Eureka" | |

Fig. 105

| COLORADO Manufacturing Card | |
|---|---|
| State Commodity Code | 06 |
| Mfg. Coefficient | 0.08 |
| Mfg. Efficiency | 0.16 |
| Required Quantity (kp) | 55 |
| Mfg. Tax (pp) | 0.10 |
| Mfg. Price (pp) | 2.02 |
| Mfr. Quantity Profit (k$) | 11 |
| Buyer (Q) Profit (k$) | 11 |
| Mfg. (Q) Tax (k$) | 6 |
| Total Quantity Cost (k$) | 112 |
| US-CO-06 The Centennial State | |

Fig. 106

| CONNECTICUT Manufacturing Card | |
|---|---|
| State Commodity Code | 07 |
| Mfg. Coefficient | 0.07 |
| Mfg. Efficiency | 0.14 |
| Required Quantity (kp) | 64 |
| Mfg. Tax (pp) | 0.11 |
| Mfg. Price (pp) | 2.12 |
| Mfr. Quantity Profit (k$) | 14 |
| Buyer (Q) Profit (k$) | 14 |
| Mfg. (Q) Tax (k$) | 7 |
| Total Quantity Cost (k$) | 136 |
| US-CT-07 The Constitution State | |

Fig. 107

| DELAWARE Manufacturing Card | |
|---|---|
| State Commodity Code | 10 |
| Mfg. Coefficient | 0.07 |
| Mfg. Efficiency | 0.14 |
| Required Quantity (kp) | 63 |
| Mfg. Tax (pp) | 0.11 |
| Mfg. Price (pp) | 2.10 |
| Mfr. Quantity Profit (k$) | 13 |
| Buyer (Q) Profit (k$) | 13 |
| Mfg. (Q) Tax (k$) | 7 |
| Total Quantity Cost (k$) | 132 |
| US-DE-10 The First State | |

Fig. 108

| FLORIDA Manufacturing Card | |
|---|---|
| State Commodity Code | 12 |
| Mfg. Coefficient | 0.09 |
| Mfg. Efficiency | 0.18 |
| Required Quantity (kp) | 47 |
| Mfg. Tax (pp) | 0.10 |
| Mfg. Price (pp) | 1.94 |
| Mfr. Quantity Profit (k$) | 9 |
| Buyer (Q) Profit (k$) | 9 |
| Mfg. (Q) Tax (k$) | 5 |
| Total Quantity Cost (k$) | 90 |
| US-FL-12 The Sunshine State | |

Fig. 109

GEORGIA
Manufacturing Card

| | |
|---|---|
| State Commodity Code | 13 |
| Mfg. Coefficient | 0.08 |
| Mfg. Efficiency | 0.15 |
| Required Quantity (kp) | 57 |
| Mfg. Tax (pp) | 0.10 |
| Mfg. Price (pp) | 2.04 |
| Mfr. Quantity Profit (k$) | 12 |
| Buyer (Q) Profit (k$) | 12 |
| Mfg. (Q) Tax (k$) | 6 |
| Total Quantity Cost (k$) | 116 |

US-GA-13
The Peach State

Fig. 110

HAWAII
Manufacturing Card

| | |
|---|---|
| State Commodity Code | 14 |
| Mfg. Coefficient | 0.13 |
| Mfg. Efficiency | 0.24 |
| Required Quantity (kp) | 33 |
| Mfg. Tax (pp) | 0.09 |
| Mfg. Price (pp) | 1.81 |
| Mfr. Quantity Profit (k$) | 6 |
| Buyer (Q) Profit (k$) | 6 |
| Mfg. (Q) Tax (k$) | 3 |
| Total Quantity Cost (k$) | 60 |

US-HI-14
The Aloha State

Fig. 111

IDAHO
Manufacturing Card

| | |
|---|---|
| State Commodity Code | 15 |
| Mfg. Coefficient | 0.12 |
| Mfg. Efficiency | 0.22 |
| Required Quantity (kp) | 36 |
| Mfg. Tax (pp) | 0.09 |
| Mfg. Price (pp) | 1.84 |
| Mfr. Quantity Profit (k$) | 7 |
| Buyer (Q) Profit (k$) | 7 |
| Mfg. (Q) Tax (k$) | 3 |
| Total Quantity Cost (k$) | 67 |

US-ID-15
The Gem State

Fig. 112

ILLINOIS
Manufacturing Card

| | |
|---|---|
| State Commodity Code | 16 |
| Mfg. Coefficient | 0.06 |
| Mfg. Efficiency | 0.13 |
| Required Quantity (kp) | 71 |
| Mfg. Tax (pp) | 0.11 |
| Mfg. Price (pp) | 2.19 |
| Mfr. Quantity Profit (k$) | 16 |
| Buyer (Q) Profit (k$) | 16 |
| Mfg. (Q) Tax (k$) | 8 |
| Total Quantity Cost (k$) | 155 |

US-IL-16
The Land of Lincoln

Fig. 113

INDIANA
Manufacturing Card

| | |
|---|---|
| State Commodity Code | 17 |
| Mfg. Coefficient | 0.08 |
| Mfg. Efficiency | 0.17 |
| Required Quantity (kp) | 52 |
| Mfg. Tax (pp) | 0.10 |
| Mfg. Price (pp) | 1.99 |
| Mfr. Quantity Profit (k$) | 10 |
| Buyer (Q) Profit (k$) | 10 |
| Mfg. (Q) Tax (k$) | 5 |
| Total Quantity Cost (k$) | 102 |

US-IN-17
The Hoosier State

Fig. 114

IOWA
Manufacturing Card

| | |
|---|---|
| State Commodity Code | 20 |
| Mfg. Coefficient | 0.11 |
| Mfg. Efficiency | 0.20 |
| Required Quantity (kp) | 39 |
| Mfg. Tax (pp) | 0.09 |
| Mfg. Price (pp) | 1.87 |
| Mfr. Quantity Profit (k$) | 7 |
| Buyer (Q) Profit (k$) | 7 |
| Mfg. (Q) Tax (k$) | 4 |
| Total Quantity Cost (k$) | 73 |

US-IA-20
The Hawkeye State

Fig. 115

KANSAS
Manufacturing Card

| | |
|---|---|
| State Commodity Code | 21 |
| Mfg. Coefficient | 0.08 |
| Mfg. Efficiency | 0.16 |
| Required Quantity (kp) | 56 |
| Mfg. Tax (pp) | 0.10 |
| Mfg. Price (pp) | 2.04 |
| Mfr. Quantity Profit (k$) | 11 |
| Buyer (Q) Profit (k$) | 11 |
| Mfg. (Q) Tax (k$) | 6 |
| Total Quantity Cost (k$) | 115 |

US-KS-21
The Sunflower State

Fig. 116

KENTUCKY
Manufacturing Card

| | |
|---|---|
| State Commodity Code | 23 |
| Mfg. Coefficient | 0.09 |
| Mfg. Efficiency | 0.17 |
| Required Quantity (kp) | 48 |
| Mfg. Tax (pp) | 0.10 |
| Mfg. Price (pp) | 1.95 |
| Mfr. Quantity Profit (k$) | 9 |
| Buyer (Q) Profit (k$) | 9 |
| Mfg. (Q) Tax (k$) | 5 |
| Total Quantity Cost (k$) | 94 |

US-KY-23
The Bluegrass State

Fig. 117

LOUISIANA
Manufacturing Card

| | |
|---|---|
| State Commodity Code | 24 |
| Mfg. Coefficient | 0.09 |
| Mfg. Efficiency | 0.18 |
| Required Quantity (kp) | 46 |
| Mfg. Tax (pp) | 0.10 |
| Mfg. Price (pp) | 1.93 |
| Mfr. Quantity Profit (k$) | 9 |
| Buyer (Q) Profit (k$) | 9 |
| Mfg. (Q) Tax (k$) | 4 |
| Total Quantity Cost (k$) | 88 |

US-LA-24
The Pelican State

Fig. 118

| MAINE Manufacturing Card | |
|---|---|
| State Commodity Code | 25 |
| Mfg. Coefficient | 0.11 |
| Mfg. Efficiency | 0.21 |
| Required Quantity (kp) | 39 |
| Mfg. Tax (pp) | 0.09 |
| Mfg. Price (pp) | 1.86 |
| Mfr. Quantity Profit (k$) | 7 |
| Buyer (Q) Profit (k$) | 7 |
| Mfg. (Q) Tax (k$) | 4 |
| Total Quantity Cost (k$) | 72 |

US-ME-25
The Pine Tree State

Fig. 119

| MARYLAND Manufacturing Card | |
|---|---|
| State Commodity Code | 26 |
| Mfg. Coefficient | 0.07 |
| Mfg. Efficiency | 0.14 |
| Required Quantity (kp) | 63 |
| Mfg. Tax (pp) | 0.11 |
| Mfg. Price (pp) | 2.11 |
| Mfr. Quantity Profit (k$) | 13 |
| Buyer (Q) Profit (k$) | 13 |
| Mfg. (Q) Tax (k$) | 7 |
| Total Quantity Cost (k$) | 133 |

US-MD-26
The Old Line State

Fig. 120

| MASSACHUSETTS Manufacturing Card | |
|---|---|
| State Commodity Code | 27 |
| Mfg. Coefficient | 0.06 |
| Mfg. Efficiency | 0.13 |
| Required Quantity (kp) | 76 |
| Mfg. Tax (pp) | 0.11 |
| Mfg. Price (pp) | 2.25 |
| Mfr. Quantity Profit (k$) | 17 |
| Buyer (Q) Profit (k$) | 17 |
| Mfg. (Q) Tax (k$) | 9 |
| Total Quantity Cost (k$) | 171 |

US-MA-27
The Bay State

Fig. 121

| MICHIGAN Manufacturing Card | |
|---|---|
| State Commodity Code | 30 |
| Mfg. Coefficient | 0.08 |
| Mfg. Efficiency | 0.16 |
| Required Quantity (kp) | 54 |
| Mfg. Tax (pp) | 0.10 |
| Mfg. Price (pp) | 2.02 |
| Mfr. Quantity Profit (k$) | 11 |
| Buyer (Q) Profit (k$) | 11 |
| Mfg. (Q) Tax (k$) | 5 |
| Total Quantity Cost (k$) | 110 |

US-MI-30
The Great Lake State

Fig. 122

| MINNESOTA Manufacturing Card | |
|---|---|
| State Commodity Code | 31 |
| Mfg. Coefficient | 0.09 |
| Mfg. Efficiency | 0.18 |
| Required Quantity (kp) | 46 |
| Mfg. Tax (pp) | 0.10 |
| Mfg. Price (pp) | 1.94 |
| Mfr. Quantity Profit (k$) | 9 |
| Buyer (Q) Profit (k$) | 9 |
| Mfg. (Q) Tax (k$) | 4 |
| Total Quantity Cost (k$) | 90 |

US-MN-31
Land of 10,000 Lakes

Fig. 123

| MISSISSIPPI Manufacturing Card | |
|---|---|
| State Commodity Code | 32 |
| Mfg. Coefficient | 0.13 |
| Mfg. Efficiency | 0.24 |
| Required Quantity (kp) | 33 |
| Mfg. Tax (pp) | 0.09 |
| Mfg. Price (pp) | 1.81 |
| Mfr. Quantity Profit (k$) | 6 |
| Buyer (Q) Profit (k$) | 6 |
| Mfg. (Q) Tax (k$) | 3 |
| Total Quantity Cost (k$) | 60 |

US-MS-32
The Magnolia State

Fig. 124

| MISSOURI Manufacturing Card | |
|---|---|
| State Commodity Code | 34 |
| Mfg. Coefficient | 0.09 |
| Mfg. Efficiency | 0.17 |
| Required Quantity (kp) | 49 |
| Mfg. Tax (pp) | 0.10 |
| Mfg. Price (pp) | 1.96 |
| Mfr. Quantity Profit (k$) | 10 |
| Buyer (Q) Profit (k$) | 10 |
| Mfg. (Q) Tax (k$) | 5 |
| Total Quantity Cost (k$) | 96 |

US-MO-34
The Show Me State

Fig. 125

| MONTANA Manufacturing Card | |
|---|---|
| State Commodity Code | 35 |
| Mfg. Coefficient | 0.10 |
| Mfg. Efficiency | 0.19 |
| Required Quantity (kp) | 42 |
| Mfg. Tax (pp) | 0.09 |
| Mfg. Price (pp) | 1.89 |
| Mfr. Quantity Profit (k$) | 8 |
| Buyer (Q) Profit (k$) | 8 |
| Mfg. (Q) Tax (k$) | 4 |
| Total Quantity Cost (k$) | 79 |

US-MT-35
The Big Sky State

Fig. 126

| NEBRASKA Manufacturing Card | |
|---|---|
| State Commodity Code | 36 |
| Mfg. Coefficient | 0.09 |
| Mfg. Efficiency | 0.18 |
| Required Quantity (kp) | 47 |
| Mfg. Tax (pp) | 0.10 |
| Mfg. Price (pp) | 1.94 |
| Mfr. Quantity Profit (k$) | 9 |
| Buyer (Q) Profit (k$) | 9 |
| Mfg. (Q) Tax (k$) | 5 |
| Total Quantity Cost (k$) | 90 |

US-NE-36
The Cornhusker State

Fig. 127

| NEVADA Manufacturing Card | |
|---|---|
| State Commodity Code | 37 |
| Mfg. Coefficient | 0.08 |
| Mfg. Efficiency | 0.16 |
| Required Quantity (kp) | 56 |
| Mfg. Tax (pp) | 0.10 |
| Mfg. Price (pp) | 2.03 |
| Mfr. Quantity Profit (k$) | 11 |
| Buyer (Q) Profit (k$) | 11 |
| Mfg. (Q) Tax (k$) | 6 |
| Total Quantity Cost (k$) | 114 |

US-NV-37
The Silver State

Fig. 128

| NEW HAMPSHIRE Manufacturing Card | |
|---|---|
| State Commodity Code | 40 |
| Mfg. Coefficient | 0.07 |
| Mfg. Efficiency | 0.14 |
| Required Quantity (kp) | 63 |
| Mfg. Tax (pp) | 0.11 |
| Mfg. Price (pp) | 2.11 |
| Mfr. Quantity Profit (k$) | 13 |
| Buyer (Q) Profit (k$) | 13 |
| Mfg. (Q) Tax (k$) | 7 |
| Total Quantity Cost (k$) | 134 |

US-NH-40
The Granite State

Fig. 129

| NEW JERSEY Manufacturing Card | |
|---|---|
| State Commodity Code | 41 |
| Mfg. Coefficient | 0.06 |
| Mfg. Efficiency | 0.13 |
| Required Quantity (kp) | 72 |
| Mfg. Tax (pp) | 0.11 |
| Mfg. Price (pp) | 2.21 |
| Mfr. Quantity Profit (k$) | 16 |
| Buyer (Q) Profit (k$) | 16 |
| Mfg. (Q) Tax (k$) | 8 |
| Total Quantity Cost (k$) | 159 |

US-NJ-41
The Garden State

Fig. 130

| NEW MEXICO Manufacturing Card | |
|---|---|
| State Commodity Code | 42 |
| Mfg. Coefficient | 0.11 |
| Mfg. Efficiency | 0.20 |
| Required Quantity (kp) | 41 |
| Mfg. Tax (pp) | 0.09 |
| Mfg. Price (pp) | 1.88 |
| Mfr. Quantity Profit (k$) | 8 |
| Buyer (Q) Profit (k$) | 8 |
| Mfg. (Q) Tax (k$) | 4 |
| Total Quantity Cost (k$) | 76 |

US-NM-42
The Land of Enchantment

Fig. 131

| NEW YORK Manufacturing Card | |
|---|---|
| State Commodity Code | 43 |
| Mfg. Coefficient | 0.05 |
| Mfg. Efficiency | 0.12 |
| Required Quantity (kp) | 87 |
| Mfg. Tax (pp) | 0.12 |
| Mfg. Price (pp) | 2.38 |
| Mfr. Quantity Profit (k$) | 21 |
| Buyer (Q) Profit (k$) | 21 |
| Mfg. (Q) Tax (k$) | 10 |
| Total Quantity Cost (k$) | 208 |

US-NY-43
The Empire State

Fig. 132

| NORTH CAROLINA Manufacturing Card | |
|---|---|
| State Commodity Code | 45 |
| Mfg. Coefficient | 0.09 |
| Mfg. Efficiency | 0.18 |
| Required Quantity (kp) | 47 |
| Mfg. Tax (pp) | 0.10 |
| Mfg. Price (pp) | 1.94 |
| Mfr. Quantity Profit (k$) | 9 |
| Buyer (Q) Profit (k$) | 9 |
| Mfg. (Q) Tax (k$) | 5 |
| Total Quantity Cost (k$) | 92 |

US-NC-45
The Old North State

Fig. 133

| NORTH DAKOTA Manufacturing Card | |
|---|---|
| State Commodity Code | 46 |
| Mfg. Coefficient | 0.06 |
| Mfg. Efficiency | 0.13 |
| Required Quantity (kp) | 72 |
| Mfg. Tax (pp) | 0.11 |
| Mfg. Price (pp) | 2.21 |
| Mfr. Quantity Profit (k$) | 16 |
| Buyer (Q) Profit (k$) | 16 |
| Mfg. (Q) Tax (k$) | 8 |
| Total Quantity Cost (k$) | 160 |

US-ND-46
The Peace Garden State

Fig. 134

| OHIO Manufacturing Card | |
|---|---|
| State Commodity Code | 47 |
| Mfg. Coefficient | 0.08 |
| Mfg. Efficiency | 0.16 |
| Required Quantity (kp) | 54 |
| Mfg. Tax (pp) | 0.10 |
| Mfg. Price (pp) | 2.01 |
| Mfr. Quantity Profit (k$) | 11 |
| Buyer (Q) Profit (k$) | 11 |
| Mfg. (Q) Tax (k$) | 5 |
| Total Quantity Cost (k$) | 107 |

US-OH-47
The Buckeye State

Fig. 135

| OKLAHOMA Manufacturing Card | |
|---|---|
| State Commodity Code | 50 |
| Mfg. Coefficient | 0.13 |
| Mfg. Efficiency | 0.23 |
| Required Quantity (kp) | 33 |
| Mfg. Tax (pp) | 0.09 |
| Mfg. Price (pp) | 1.82 |
| Mfr. Quantity Profit (k$) | 6 |
| Buyer (Q) Profit (k$) | 6 |
| Mfg. (Q) Tax (k$) | 3 |
| Total Quantity Cost (k$) | 61 |

US-OK-50
The Native America State

Fig. 136

OREGON
Manufacturing Card

| | |
|---|---|
| State Commodity Code | 51 |
| Mfg. Coefficient | 0.08 |
| Mfg. Efficiency | 0.16 |
| Required Quantity (kp) | 52 |
| Mfg. Tax (pp) | 0.10 |
| Mfg. Price (pp) | 2.00 |
| Mfr. Quantity Profit (k$) | 10 |
| Buyer (Q) Profit (k$) | 10 |
| Mfg. (Q) Tax (k$) | 5 |
| Total Quantity Cost (k$) | 105 |

US-OR-51
The Beaver State

Fig. 137

PENNSYLVANIA
Manufacturing Card

| | |
|---|---|
| State Commodity Code | 52 |
| Mfg. Coefficient | 0.07 |
| Mfg. Efficiency | 0.14 |
| Required Quantity (kp) | 63 |
| Mfg. Tax (pp) | 0.11 |
| Mfg. Price (pp) | 2.10 |
| Mfr. Quantity Profit (k$) | 13 |
| Buyer (Q) Profit (k$) | 13 |
| Mfg. (Q) Tax (k$) | 7 |
| Total Quantity Cost (k$) | 132 |

US-PA-52
The Keystone State

Fig. 138

RHODE ISLAND
Manufacturing Card

| | |
|---|---|
| State Commodity Code | 53 |
| Mfg. Coefficient | 0.06 |
| Mfg. Efficiency | 0.13 |
| Required Quantity (kp) | 76 |
| Mfg. Tax (pp) | 0.11 |
| Mfg. Price (pp) | 2.25 |
| Mfr. Quantity Profit (k$) | 17 |
| Buyer (Q) Profit (k$) | 17 |
| Mfg. (Q) Tax (k$) | 8 |
| Total Quantity Cost (k$) | 170 |

US-RI-53
The Ocean State

Fig. 139

SOUTH CAROLINA
Manufacturing Card

| | |
|---|---|
| State Commodity Code | 54 |
| Mfg. Coefficient | 0.14 |
| Mfg. Efficiency | 0.26 |
| Required Quantity (kp) | 30 |
| Mfg. Tax (pp) | 0.09 |
| Mfg. Price (pp) | 1.79 |
| Mfr. Quantity Profit (k$) | 5 |
| Buyer (Q) Profit (k$) | 5 |
| Mfg. (Q) Tax (k$) | 3 |
| Total Quantity Cost (k$) | 53 |

US-SC-54
The Palmetto State

Fig. 140

SOUTH DAKOTA
Manufacturing Card

| | |
|---|---|
| State Commodity Code | 56 |
| Mfg. Coefficient | 0.10 |
| Mfg. Efficiency | 0.18 |
| Required Quantity (kp) | 45 |
| Mfg. Tax (pp) | 0.10 |
| Mfg. Price (pp) | 1.92 |
| Mfr. Quantity Profit (k$) | 9 |
| Buyer (Q) Profit (k$) | 9 |
| Mfg. (Q) Tax (k$) | 4 |
| Total Quantity Cost (k$) | 86 |

US-SD-56
The Mount Rushmore State

Fig. 141

TENNESSEE
Manufacturing Card

| | |
|---|---|
| State Commodity Code | 57 |
| Mfg. Coefficient | 0.13 |
| Mfg. Efficiency | 0.23 |
| Required Quantity (kp) | 34 |
| Mfg. Tax (pp) | 0.09 |
| Mfg. Price (pp) | 1.82 |
| Mfr. Quantity Profit (k$) | 6 |
| Buyer (Q) Profit (k$) | 6 |
| Mfg. (Q) Tax (k$) | 3 |
| Total Quantity Cost (k$) | 62 |

US-TN-57
The Volunteer State

Fig. 142

TEXAS
Manufacturing Card

| | |
|---|---|
| State Commodity Code | 60 |
| Mfg. Coefficient | 0.07 |
| Mfg. Efficiency | 0.15 |
| Required Quantity (kp) | 62 |
| Mfg. Tax (pp) | 0.10 |
| Mfg. Price (pp) | 2.10 |
| Mfr. Quantity Profit (k$) | 13 |
| Buyer (Q) Profit (k$) | 13 |
| Mfg. (Q) Tax (k$) | 7 |
| Total Quantity Cost (k$) | 130 |

US-TX-60
The Lone Star State

Fig. 143

UTAH
Manufacturing Card

| | |
|---|---|
| State Commodity Code | 61 |
| Mfg. Coefficient | 0.11 |
| Mfg. Efficiency | 0.20 |
| Required Quantity (kp) | 41 |
| Mfg. Tax (pp) | 0.09 |
| Mfg. Price (pp) | 1.88 |
| Mfr. Quantity Profit (k$) | 8 |
| Buyer (Q) Profit (k$) | 8 |
| Mfg. (Q) Tax (k$) | 4 |
| Total Quantity Cost (k$) | 77 |

US-UT-61
The Beehive State

Fig. 144

VERMONT
Manufacturing Card

| | |
|---|---|
| State Commodity Code | 62 |
| Mfg. Coefficient | 0.14 |
| Mfg. Efficiency | 0.25 |
| Required Quantity (kp) | 31 |
| Mfg. Tax (pp) | 0.09 |
| Mfg. Price (pp) | 1.80 |
| Mfr. Quantity Profit (k$) | 6 |
| Buyer (Q) Profit (k$) | 6 |
| Mfg. (Q) Tax (k$) | 3 |
| Total Quantity Cost (k$) | 56 |

US-VT-62
The Green Mountain State

Fig. 145

| VIRGINIA Manufacturing Card | |
|---|---|
| State Commodity Code | 63 |
| Mfg. Coefficient | 0.08 |
| Mfg. Efficiency | 0.16 |
| Required Quantity (kp) | 56 |
| Mfg. Tax (pp) | 0.10 |
| Mfg. Price (pp) | 2.03 |
| Mfr. Quantity Profit (k$) | 11 |
| Buyer (Q) Profit (k$) | 11 |
| Mfg. (Q) Tax (k$) | 6 |
| Total Quantity Cost (k$) | 114 |

US-VA-63
The Old Dominion State

Fig. 146

| WASHINGTON Manufacturing Card | |
|---|---|
| State Commodity Code | 64 |
| Mfg. Coefficient | 0.06 |
| Mfg. Efficiency | 0.13 |
| Required Quantity (kp) | 76 |
| Mfg. Tax (pp) | 0.11 |
| Mfg. Price (pp) | 2.25 |
| Mfr. Quantity Profit (k$) | 17 |
| Buyer (Q) Profit (k$) | 17 |
| Mfg. (Q) Tax (k$) | 8 |
| Total Quantity Cost (k$) | 170 |

US-WA-64
The Evergreen State

Fig. 147

| WEST VIRGINIA Manufacturing Card | |
|---|---|
| State Commodity Code | 65 |
| Mfg. Coefficient | 0.10 |
| Mfg. Efficiency | 0.19 |
| Required Quantity (kp) | 43 |
| Mfg. Tax (pp) | 0.10 |
| Mfg. Price (pp) | 1.90 |
| Mfr. Quantity Profit (k$) | 8 |
| Buyer (Q) Profit (k$) | 8 |
| Mfg. (Q) Tax (k$) | 4 |
| Total Quantity Cost (k$) | 82 |

US-WV-65
The Mountain State

Fig. 148

| WISCONSIN Manufacturing Card | |
|---|---|
| State Commodity Code | 67 |
| Mfg. Coefficient | 0.10 |
| Mfg. Efficiency | 0.19 |
| Required Quantity (kp) | 43 |
| Mfg. Tax (pp) | 0.09 |
| Mfg. Price (pp) | 1.90 |
| Mfr. Quantity Profit (k$) | 8 |
| Buyer (Q) Profit (k$) | 8 |
| Mfg. (Q) Tax (k$) | 4 |
| Total Quantity Cost (k$) | 81 |

US-WI-67
The Badger State

Fig. 149

| WYOMING Manufacturing Card | |
|---|---|
| State Commodity Code | 70 |
| Mfg. Coefficient | 0.06 |
| Mfg. Efficiency | 0.14 |
| Required Quantity (kp) | 66 |
| Mfg. Tax (pp) | 0.11 |
| Mfg. Price (pp) | 2.14 |
| Mfr. Quantity Profit (k$) | 14 |
| Buyer (Q) Profit (k$) | 14 |
| Mfg. (Q) Tax (k$) | 7 |
| Total Quantity Cost (k$) | 142 |

US-WY-70
The Equality State

Fig. 150

| ALABAMA | |
|---|---|
| Services Provider Card | |
| State Commodity Code | 01 |
| Services Coefficient | 0.06 |
| Services Efficiency | 0.15 |
| Required Quantity (kp) | 35 |
| Services Tax (pp) | 0.12 |
| Services Price (pp) | 2.40 |
| S.P. Quantity Profit (k$) | 8 |
| Buyer (Q) Profit (k$) | 8 |
| Services (Q) Tax (k$) | 4 |
| Total Quantity Cost (k$) | 83 |
| US-AL-01 | |
| The Yellow hammer State | |

Fig. 151

| ALASKA | |
|---|---|
| Services Provider Card | |
| State Commodity Code | 02 |
| Services Coefficient | 5.44 |
| Services Efficiency | 82.52 |
| Required Quantity (kp) | 77 |
| Services Tax (pp) | 0.76 |
| Services Price (pp) | 15.16 |
| S.P. Quantity Profit (k$) | 117 |
| Buyer (Q) Profit (k$) | 117 |
| Services (Q) Tax (k$) | 59 |
| Total Quantity Cost (k$) | 1174 |
| US-AK-02 | |
| The Last Frontier | |

Fig. 152

| ARIZONA | |
|---|---|
| Services Provider Card | |
| State Commodity Code | 03 |
| Services Coefficient | 0.09 |
| Services Efficiency | 0.22 |
| Required Quantity (kp) | 36 |
| Services Tax (pp) | 0.12 |
| Services Price (pp) | 2.46 |
| S.P. Quantity Profit (k$) | 9 |
| Buyer (Q) Profit (k$) | 9 |
| Services (Q) Tax (k$) | 4 |
| Total Quantity Cost (k$) | 88 |
| US-AZ-03 | |
| The Grand Canyon State | |

Fig. 153

| ARKANSAS | |
|---|---|
| Services Provider Card | |
| State Commodity Code | 04 |
| Services Coefficient | 0.10 |
| Services Efficiency | 0.26 |
| Required Quantity (kp) | 39 |
| Services Tax (pp) | 0.13 |
| Services Price (pp) | 2.53 |
| S.P. Quantity Profit (k$) | 10 |
| Buyer (Q) Profit (k$) | 10 |
| Services (Q) Tax (k$) | 5 |
| Total Quantity Cost (k$) | 100 |
| US-AR-04 | |
| The Natural State | |

Fig. 154

| CALIFORNIA | |
|---|---|
| Services Provider Card | |
| State Commodity Code | 05 |
| Services Coefficient | 0.02 |
| Services Efficiency | 0.07 |
| Required Quantity (kp) | 76 |
| Services Tax (pp) | 0.14 |
| Services Price (pp) | 2.87 |
| S.P. Quantity Profit (k$) | 22 |
| Buyer (Q) Profit (k$) | 22 |
| Services (Q) Tax (k$) | 11 |
| Total Quantity Cost (k$) | 218 |
| US-CA-05 | |
| The Golden State "Eureka" | |

Fig. 155

| COLORADO | |
|---|---|
| Services Provider Card | |
| State Commodity Code | 06 |
| Services Coefficient | 0.11 |
| Services Efficiency | 0.29 |
| Required Quantity (kp) | 55 |
| Services Tax (pp) | 0.14 |
| Services Price (pp) | 2.74 |
| S.P. Quantity Profit (k$) | 15 |
| Buyer (Q) Profit (k$) | 15 |
| Services (Q) Tax (k$) | 8 |
| Total Quantity Cost (k$) | 151 |
| US-CO-06 | |
| The Centennial State | |

Fig. 156

| CONNECTICUT | |
|---|---|
| Services Provider Card | |
| State Commodity Code | 07 |
| Services Coefficient | 0.01 |
| Services Efficiency | 0.02 |
| Required Quantity (kp) | 64 |
| Services Tax (pp) | 0.13 |
| Services Price (pp) | 2.67 |
| S.P. Quantity Profit (k$) | 17 |
| Buyer (Q) Profit (k$) | 17 |
| Services (Q) Tax (k$) | 9 |
| Total Quantity Cost (k$) | 172 |
| US-CT-07 | |
| The Constitution State | |

Fig. 157

| DELAWARE | |
|---|---|
| Services Provider Card | |
| State Commodity Code | 10 |
| Services Coefficient | 0.01 |
| Services Efficiency | 0.03 |
| Required Quantity (kp) | 63 |
| Services Tax (pp) | 0.13 |
| Services Price (pp) | 2.65 |
| S.P. Quantity Profit (k$) | 17 |
| Buyer (Q) Profit (k$) | 17 |
| Services (Q) Tax (k$) | 8 |
| Total Quantity Cost (k$) | 166 |
| US-DE-10 | |
| The First State | |

Fig. 158

| FLORIDA | |
|---|---|
| Services Provider Card | |
| State Commodity Code | 12 |
| Services Coefficient | 0.02 |
| Services Efficiency | 0.04 |
| Required Quantity (kp) | 47 |
| Services Tax (pp) | 0.12 |
| Services Price (pp) | 2.45 |
| S.P. Quantity Profit (k$) | 11 |
| Buyer (Q) Profit (k$) | 11 |
| Services (Q) Tax (k$) | 6 |
| Total Quantity Cost (k$) | 114 |
| US-FL-12 | |
| The Sunshine State | |

Fig. 159

| GEORGIA | |
|---|---|
| Services Provider Card | |
| State Commodity Code | 13 |
| Services Coefficient | 0.03 |
| Services Efficiency | 0.09 |
| Required Quantity (kp) | 57 |
| Services Tax (pp) | 0.13 |
| Services Price (pp) | 2.62 |
| S.P. Quantity Profit (k$) | 15 |
| Buyer (Q) Profit (k$) | 15 |
| Services (Q) Tax (k$) | 7 |
| Total Quantity Cost (k$) | 148 |
| US-GA-13 | |
| The Peach State | |

Fig. 160

| HAWAII | |
|---|---|
| Services Provider Card | |
| State Commodity Code | 14 |
| Services Coefficient | 0.04 |
| Services Efficiency | 0.11 |
| Required Quantity (kp) | 33 |
| Services Tax (pp) | 0.12 |
| Services Price (pp) | 2.35 |
| S.P. Quantity Profit (k$) | 8 |
| Buyer (Q) Profit (k$) | 8 |
| Services (Q) Tax (k$) | 4 |
| Total Quantity Cost (k$) | 78 |
| US-HI-14 | |
| The Aloha State | |

Fig. 161

| IDAHO | |
|---|---|
| Services Provider Card | |
| State Commodity Code | 15 |
| Services Coefficient | 0.27 |
| Services Efficiency | 0.76 |
| Required Quantity (kp) | 36 |
| Services Tax (pp) | 0.14 |
| Services Price (pp) | 2.80 |
| S.P. Quantity Profit (k$) | 10 |
| Buyer (Q) Profit (k$) | 10 |
| Services (Q) Tax (k$) | 5 |
| Total Quantity Cost (k$) | 102 |
| US-ID-15 | |
| The Gem State | |

Fig. 162

| ILLINOIS | |
|---|---|
| Services Provider Card | |
| State Commodity Code | 16 |
| Services Coefficient | 0.03 |
| Services Efficiency | 0.08 |
| Required Quantity (kp) | 71 |
| Services Tax (pp) | 0.14 |
| Services Price (pp) | 2.80 |
| S.P. Quantity Profit (k$) | 20 |
| Buyer (Q) Profit (k$) | 20 |
| Services (Q) Tax (k$) | 10 |
| Total Quantity Cost (k$) | 198 |
| US-IL-16 | |
| The Land of Lincoln | |

Fig. 163

| INDIANA | |
|---|---|
| Services Provider Card | |
| State Commodity Code | 17 |
| Services Coefficient | 0.03 |
| Services Efficiency | 0.08 |
| Required Quantity (kp) | 52 |
| Services Tax (pp) | 0.13 |
| Services Price (pp) | 2.55 |
| S.P. Quantity Profit (k$) | 13 |
| Buyer (Q) Profit (k$) | 13 |
| Services (Q) Tax (k$) | 7 |
| Total Quantity Cost (k$) | 131 |
| US-IN-17 | |
| The Hoosier State | |

Fig. 164

| IOWA | |
|---|---|
| Services Provider Card | |
| State Commodity Code | 20 |
| Services Coefficient | 0.10 |
| Services Efficiency | 0.26 |
| Required Quantity (kp) | 39 |
| Services Tax (pp) | 0.13 |
| Services Price (pp) | 2.53 |
| S.P. Quantity Profit (k$) | 10 |
| Buyer (Q) Profit (k$) | 10 |
| Services (Q) Tax (k$) | 5 |
| Total Quantity Cost (k$) | 99 |
| US-IA-20 | |
| The Hawkeye State | |

Fig. 165

| KANSAS | |
|---|---|
| Services Provider Card | |
| State Commodity Code | 21 |
| Services Coefficient | 0.16 |
| Services Efficiency | 0.47 |
| Required Quantity (kp) | 56 |
| Services Tax (pp) | 0.14 |
| Services Price (pp) | 2.88 |
| S.P. Quantity Profit (k$) | 16 |
| Buyer (Q) Profit (k$) | 16 |
| Services (Q) Tax (k$) | 8 |
| Total Quantity Cost (k$) | 162 |
| US-KS-21 | |
| The Sunflower State | |

Fig. 166

| KENTUCKY | |
|---|---|
| Services Provider Card | |
| State Commodity Code | 23 |
| Services Coefficient | 0.05 |
| Services Efficiency | 0.13 |
| Required Quantity (kp) | 48 |
| Services Tax (pp) | 0.13 |
| Services Price (pp) | 2.55 |
| S.P. Quantity Profit (k$) | 12 |
| Buyer (Q) Profit (k$) | 12 |
| Services (Q) Tax (k$) | 6 |
| Total Quantity Cost (k$) | 123 |
| US-KY-23 | |
| The Bluegrass State | |

Fig. 167

| LOUISIANA | |
|---|---|
| Services Provider Card | |
| State Commodity Code | 24 |
| Services Coefficient | 0.07 |
| Services Efficiency | 0.17 |
| Required Quantity (kp) | 46 |
| Services Tax (pp) | 0.13 |
| Services Price (pp) | 2.54 |
| S.P. Quantity Profit (k$) | 12 |
| Buyer (Q) Profit (k$) | 12 |
| Services (Q) Tax (k$) | 6 |
| Total Quantity Cost (k$) | 116 |
| US-LA-24 | |
| The Pelican State | |

Fig. 168

| MAINE | |
|---|---|
| Services Provider Card | |
| State Commodity Code | 25 |
| Services Coefficient | 0.15 |
| Services Efficiency | 0.40 |
| Required Quantity (kp) | 39 |
| Services Tax (pp) | 0.13 |
| Services Price (pp) | 2.62 |
| S.P. Quantity Profit (k$) | 10 |
| Buyer (Q) Profit (k$) | 10 |
| Services (Q) Tax (k$) | 5 |
| Total Quantity Cost (k$) | 102 |
| US-ME-25 | |
| The Pine Tree State | |

Fig. 169

| MARYLAND | |
|---|---|
| Services Provider Card | |
| State Commodity Code | 26 |
| Services Coefficient | 0.01 |
| Services Efficiency | 0.03 |
| Required Quantity (kp) | 63 |
| Services Tax (pp) | 0.13 |
| Services Price (pp) | 2.66 |
| S.P. Quantity Profit (k$) | 17 |
| Buyer (Q) Profit (k$) | 17 |
| Services (Q) Tax (k$) | 8 |
| Total Quantity Cost (k$) | 168 |
| US-MD-26 | |
| The Old Line State | |

Fig. 170

| MASSACHUSETTS | |
|---|---|
| Services Provider Card | |
| State Commodity Code | 27 |
| Services Coefficient | 0.01 |
| Services Efficiency | 0.03 |
| Required Quantity (kp) | 76 |
| Services Tax (pp) | 0.14 |
| Services Price (pp) | 2.83 |
| S.P. Quantity Profit (k$) | 22 |
| Buyer (Q) Profit (k$) | 22 |
| Services (Q) Tax (k$) | 11 |
| Total Quantity Cost (k$) | 215 |
| US-MA-27 | |
| The Bay State | |

Fig. 171

| MICHIGAN | |
|---|---|
| Services Provider Card | |
| State Commodity Code | 30 |
| Services Coefficient | 0.06 |
| Services Efficiency | 0.15 |
| Required Quantity (kp) | 54 |
| Services Tax (pp) | 0.13 |
| Services Price (pp) | 2.64 |
| S.P. Quantity Profit (k$) | 14 |
| Buyer (Q) Profit (k$) | 14 |
| Services (Q) Tax (k$) | 7 |
| Total Quantity Cost (k$) | 143 |
| US-MI-30 | |
| The Great Lake State | |

Fig. 172

| MINNESOTA | |
|---|---|
| Services Provider Card | |
| State Commodity Code | 31 |
| Services Coefficient | 0.09 |
| Services Efficiency | 0.23 |
| Required Quantity (kp) | 46 |
| Services Tax (pp) | 0.13 |
| Services Price (pp) | 2.59 |
| S.P. Quantity Profit (k$) | 12 |
| Buyer (Q) Profit (k$) | 12 |
| Services (Q) Tax (k$) | 6 |
| Total Quantity Cost (k$) | 120 |
| US-MN-31 | |
| Land of 10,000 Lakes | |

Fig. 173

| MISSISSIPPI | |
|---|---|
| Services Provider Card | |
| State Commodity Code | 32 |
| Services Coefficient | 0.09 |
| Services Efficiency | 0.23 |
| Required Quantity (kp) | 33 |
| Services Tax (pp) | 0.12 |
| Services Price (pp) | 2.44 |
| S.P. Quantity Profit (k$) | 8 |
| Buyer (Q) Profit (k$) | 8 |
| Services (Q) Tax (k$) | 4 |
| Total Quantity Cost (k$) | 80 |
| US-MS-32 | |
| The Magnolia State | |

Fig. 174

| MISSOURI | |
|---|---|
| Services Provider Card | |
| State Commodity Code | 34 |
| Services Coefficient | 0.07 |
| Services Efficiency | 0.17 |
| Required Quantity (kp) | 49 |
| Services Tax (pp) | 0.13 |
| Services Price (pp) | 2.58 |
| S.P. Quantity Profit (k$) | 13 |
| Buyer (Q) Profit (k$) | 13 |
| Services (Q) Tax (k$) | 6 |
| Total Quantity Cost (k$) | 126 |
| US-MO-34 | |
| The Show Me State | |

Fig. 175

| MONTANA | |
|---|---|
| Services Provider Card | |
| State Commodity Code | 35 |
| Services Coefficient | 0.81 |
| Services Efficiency | 3.13 |
| Required Quantity (kp) | 42 |
| Services Tax (pp) | 0.19 |
| Services Price (pp) | 3.89 |
| S.P. Quantity Profit (k$) | 16 |
| Buyer (Q) Profit (k$) | 16 |
| Services (Q) Tax (k$) | 8 |
| Total Quantity Cost (k$) | 162 |
| US-MT-35 | |
| The Big Sky State | |

Fig. 176

| NEBRASKA | |
|---|---|
| Services Provider Card | |
| State Commodity Code | 36 |
| Services Coefficient | 0.23 |
| Services Efficiency | 0.67 |
| Required Quantity (kp) | 47 |
| Services Tax (pp) | 0.14 |
| Services Price (pp) | 2.87 |
| S.P. Quantity Profit (k$) | 13 |
| Buyer (Q) Profit (k$) | 13 |
| Services (Q) Tax (k$) | 7 |
| Total Quantity Cost (k$) | 134 |
| US-NE-36 | |
| The Cornhusker State | |

Fig. 177

| NEVADA Services Provider Card | |
|---|---|
| State Commodity Code | 37 |
| Services Coefficient | 0.21 |
| Services Efficiency | 0.63 |
| Required Quantity (kp) | 56 |
| Services Tax (pp) | 0.15 |
| Services Price (pp) | 2.97 |
| S.P. Quantity Profit (k$) | 17 |
| Buyer (Q) Profit (k$) | 17 |
| Services (Q) Tax (k$) | 8 |
| Total Quantity Cost (k$) | 167 |
| US-NV-37 The Silver State | |

Fig. 178

| NEW HAMPSHIRE Services Provider Card | |
|---|---|
| State Commodity Code | 40 |
| Services Coefficient | 0.04 |
| Services Efficiency | 0.11 |
| Required Quantity (kp) | 63 |
| Services Tax (pp) | 0.14 |
| Services Price (pp) | 2.72 |
| S.P. Quantity Profit (k$) | 17 |
| Buyer (Q) Profit (k$) | 17 |
| Services (Q) Tax (k$) | 9 |
| Total Quantity Cost (k$) | 173 |
| US-NH-40 The Granite State | |

Fig. 179

| NEW JERSEY Services Provider Card | |
|---|---|
| State Commodity Code | 41 |
| Services Coefficient | 0.01 |
| Services Efficiency | 0.02 |
| Required Quantity (kp) | 72 |
| Services Tax (pp) | 0.14 |
| Services Price (pp) | 2.77 |
| S.P. Quantity Profit (k$) | 20 |
| Buyer (Q) Profit (k$) | 20 |
| Services (Q) Tax (k$) | 10 |
| Total Quantity Cost (k$) | 200 |
| US-NJ-41 The Garden State | |

Fig. 180

| NEW MEXICO Services Provider Card | |
|---|---|
| State Commodity Code | 42 |
| Services Coefficient | 0.34 |
| Services Efficiency | 1.01 |
| Required Quantity (kp) | 41 |
| Services Tax (pp) | 0.15 |
| Services Price (pp) | 2.98 |
| S.P. Quantity Profit (k$) | 12 |
| Buyer (Q) Profit (k$) | 12 |
| Services (Q) Tax (k$) | 6 |
| Total Quantity Cost (k$) | 121 |
| US-NM-42 The Land of Enchantment | |

Fig. 181

| NEW YORK Services Provider Card | |
|---|---|
| State Commodity Code | 43 |
| Services Coefficient | 0.02 |
| Services Efficiency | 0.05 |
| Required Quantity (kp) | 87 |
| Services Tax (pp) | 0.15 |
| Services Price (pp) | 3.01 |
| S.P. Quantity Profit (k$) | 26 |
| Buyer (Q) Profit (k$) | 26 |
| Services (Q) Tax (k$) | 13 |
| Total Quantity Cost (k$) | 263 |
| US-NY-43 The Empire State | |

Fig. 182

| NORTH CAROLINA Services Provider Card | |
|---|---|
| State Commodity Code | 45 |
| Services Coefficient | 0.03 |
| Services Efficiency | 0.07 |
| Required Quantity (kp) | 47 |
| Services Tax (pp) | 0.12 |
| Services Price (pp) | 2.49 |
| S.P. Quantity Profit (k$) | 12 |
| Buyer (Q) Profit (k$) | 12 |
| Services (Q) Tax (k$) | 6 |
| Total Quantity Cost (k$) | 118 |
| US-NC-45 The Old North State | |

Fig. 183

| NORTH DAKOTA Services Provider Card | |
|---|---|
| State Commodity Code | 46 |
| Services Coefficient | 0.54 |
| Services Efficiency | 2.15 |
| Required Quantity (kp) | 72 |
| Services Tax (pp) | 0.20 |
| Services Price (pp) | 3.96 |
| S.P. Quantity Profit (k$) | 29 |
| Buyer (Q) Profit (k$) | 29 |
| Services (Q) Tax (k$) | 14 |
| Total Quantity Cost (k$) | 287 |
| US-ND-46 The Peace Garden State | |

Fig. 184

| OHIO Services Provider Card | |
|---|---|
| State Commodity Code | 47 |
| Services Coefficient | 0.02 |
| Services Efficiency | 0.06 |
| Required Quantity (kp) | 54 |
| Services Tax (pp) | 0.13 |
| Services Price (pp) | 2.55 |
| S.P. Quantity Profit (k$) | 14 |
| Buyer (Q) Profit (k$) | 14 |
| Services (Q) Tax (k$) | 7 |
| Total Quantity Cost (k$) | 137 |
| US-OH-47 The Buckeye State | |

Fig. 185

| OKLAHOMA Services Provider Card | |
|---|---|
| State Commodity Code | 50 |
| Services Coefficient | 0.10 |
| Services Efficiency | 0.25 |
| Required Quantity (kp) | 33 |
| Services Tax (pp) | 0.12 |
| Services Price (pp) | 2.46 |
| S.P. Quantity Profit (k$) | 8 |
| Buyer (Q) Profit (k$) | 8 |
| Services (Q) Tax (k$) | 4 |
| Total Quantity Cost (k$) | 82 |
| US-OK-50 The Native America State | |

Fig. 186

| OREGON | |
|---|---|
| Services Provider Card | |
| State Commodity Code | 51 |
| Services Coefficient | 0.14 |
| Services Efficiency | 0.38 |
| Required Quantity (kp) | 52 |
| Services Tax (pp) | 0.14 |
| Services Price (pp) | 2.77 |
| S.P. Quantity Profit (k$) | 14 |
| Buyer (Q) Profit (k$) | 14 |
| Services (Q) Tax (k$) | 7 |
| Total Quantity Cost (k$) | 145 |
| US-OR-51 | |
| The Beaver State | |

Fig. 187

| PENNSYLVANIA | |
|---|---|
| Services Provider Card | |
| State Commodity Code | 52 |
| Services Coefficient | 0.02 |
| Services Efficiency | 0.06 |
| Required Quantity (kp) | 63 |
| Services Tax (pp) | 0.13 |
| Services Price (pp) | 2.67 |
| S.P. Quantity Profit (k$) | 17 |
| Buyer (Q) Profit (k$) | 17 |
| Services (Q) Tax (k$) | 8 |
| Total Quantity Cost (k$) | 168 |
| US-PA-52 | |
| The Keystone State | |

Fig. 188

| RHODE ISLAND | |
|---|---|
| Services Provider Card | |
| State Commodity Code | 53 |
| Services Coefficient | 0.01 |
| Services Efficiency | 0.02 |
| Required Quantity (kp) | 76 |
| Services Tax (pp) | 0.14 |
| Services Price (pp) | 2.82 |
| S.P. Quantity Profit (k$) | 21 |
| Buyer (Q) Profit (k$) | 21 |
| Services (Q) Tax (k$) | 11 |
| Total Quantity Cost (k$) | 214 |
| US-RI-53 | |
| The Ocean State | |

Fig. 189

| SOUTH CAROLINA | |
|---|---|
| Services Provider Card | |
| State Commodity Code | 54 |
| Services Coefficient | 0.04 |
| Services Efficiency | 0.08 |
| Required Quantity (kp) | 30 |
| Services Tax (pp) | 0.12 |
| Services Price (pp) | 2.30 |
| S.P. Quantity Profit (k$) | 7 |
| Buyer (Q) Profit (k$) | 7 |
| Services (Q) Tax (k$) | 3 |
| Total Quantity Cost (k$) | 68 |
| US-SC-54 | |
| The Palmetto State | |

Fig. 190

| SOUTH DAKOTA | |
|---|---|
| Services Provider Card | |
| State Commodity Code | 56 |
| Services Coefficient | 0.51 |
| Services Efficiency | 1.72 |
| Required Quantity (kp) | 45 |
| Services Tax (pp) | 0.17 |
| Services Price (pp) | 3.38 |
| S.P. Quantity Profit (k$) | 15 |
| Buyer (Q) Profit (k$) | 15 |
| Services (Q) Tax (k$) | 8 |
| Total Quantity Cost (k$) | 152 |
| US-SD-56 | |
| The Mount Rushmore State | |

Fig. 191

| TENNESSEE | |
|---|---|
| Services Provider Card | |
| State Commodity Code | 57 |
| Services Coefficient | 0.04 |
| Services Efficiency | 0.08 |
| Required Quantity (kp) | 34 |
| Services Tax (pp) | 0.12 |
| Services Price (pp) | 2.34 |
| S.P. Quantity Profit (k$) | 8 |
| Buyer (Q) Profit (k$) | 8 |
| Services (Q) Tax (k$) | 4 |
| Total Quantity Cost (k$) | 80 |
| US-TN-57 | |
| The Volunteer State | |

Fig. 192

| TEXAS | |
|---|---|
| Services Provider Card | |
| State Commodity Code | 60 |
| Services Coefficient | 0.05 |
| Services Efficiency | 0.15 |
| Required Quantity (kp) | 62 |
| Services Tax (pp) | 0.14 |
| Services Price (pp) | 2.73 |
| S.P. Quantity Profit (k$) | 17 |
| Buyer (Q) Profit (k$) | 17 |
| Services (Q) Tax (k$) | 8 |
| Total Quantity Cost (k$) | 170 |
| US-TX-60 | |
| The Lone Star State | |

Fig. 193

| UTAH | |
|---|---|
| Services Provider Card | |
| State Commodity Code | 61 |
| Services Coefficient | 0.15 |
| Services Efficiency | 0.41 |
| Required Quantity (kp) | 41 |
| Services Tax (pp) | 0.13 |
| Services Price (pp) | 2.64 |
| S.P. Quantity Profit (k$) | 11 |
| Buyer (Q) Profit (k$) | 11 |
| Services (Q) Tax (k$) | 5 |
| Total Quantity Cost (k$) | 107 |
| US-UT-61 | |
| The Beehive State | |

Fig. 194

| VERMONT | |
|---|---|
| Services Provider Card | |
| State Commodity Code | 62 |
| Services Coefficient | 0.09 |
| Services Efficiency | 0.22 |
| Required Quantity (kp) | 31 |
| Services Tax (pp) | 0.12 |
| Services Price (pp) | 2.41 |
| S.P. Quantity Profit (k$) | 7 |
| Buyer (Q) Profit (k$) | 7 |
| Services (Q) Tax (k$) | 4 |
| Total Quantity Cost (k$) | 74 |
| US-VT-62 | |
| The Green Mountain State | |

Fig. 195

| VIRGINIA | |
|---|---|
| Services Provider Card | |
| State Commodity Code | 63 |
| Services Coefficient | 0.03 |
| Services Efficiency | 0.08 |
| Required Quantity (kp) | 56 |
| Services Tax (pp) | 0.13 |
| Services Price (pp) | 2.60 |
| S.P. Quantity Profit (k$) | 15 |
| Buyer (Q) Profit (k$) | 15 |
| Services (Q) Tax (k$) | 7 |
| Total Quantity Cost (k$) | 145 |
| US-VA-63 | |
| The Old Dominion State | |

Fig. 196

| WASHINGTON | |
|---|---|
| Services Provider Card | |
| State Commodity Code | 64 |
| Services Coefficient | 0.06 |
| Services Efficiency | 0.16 |
| Required Quantity (kp) | 76 |
| Services Tax (pp) | 0.15 |
| Services Price (pp) | 2.93 |
| S.P. Quantity Profit (k$) | 22 |
| Buyer (Q) Profit (k$) | 22 |
| Services (Q) Tax (k$) | 11 |
| Total Quantity Cost (k$) | 221 |
| US-WA-64 | |
| The Evergreen State | |

Fig. 197

| WEST VIRGINIA | |
|---|---|
| Services Provider Card | |
| State Commodity Code | 65 |
| Services Coefficient | 0.08 |
| Services Efficiency | 0.20 |
| Required Quantity (kp) | 43 |
| Services Tax (pp) | 0.13 |
| Services Price (pp) | 2.53 |
| S.P. Quantity Profit (k$) | 11 |
| Buyer (Q) Profit (k$) | 11 |
| Services (Q) Tax (k$) | 5 |
| Total Quantity Cost (k$) | 109 |
| US-WV-65 | |
| The Mountain State | |

Fig. 198

| WISCONSIN | |
|---|---|
| Services Provider Card | |
| State Commodity Code | 67 |
| Services Coefficient | 0.07 |
| Services Efficiency | 0.16 |
| Required Quantity (kp) | 43 |
| Services Tax (pp) | 0.12 |
| Services Price (pp) | 2.50 |
| S.P. Quantity Profit (k$) | 11 |
| Buyer (Q) Profit (k$) | 11 |
| Services (Q) Tax (k$) | 5 |
| Total Quantity Cost (k$) | 106 |
| US-WI-67 | |
| The Badger State | |

Fig. 199

| WYOMING | |
|---|---|
| Services Provider Card | |
| State Commodity Code | 70 |
| Services Coefficient | 0.99 |
| Services Efficiency | 4.73 |
| Required Quantity (kp) | 66 |
| Services Tax (pp) | 0.24 |
| Services Price (pp) | 4.79 |
| S.P. Quantity Profit (k$) | 32 |
| Buyer (Q) Profit (k$) | 32 |
| Services (Q) Tax (k$) | 16 |
| Total Quantity Cost (k$) | 318 |
| US-WY-70 | |
| The Equality State | |

Fig. 200

| ALABAMA | |
|---|---|
| Purchase/Sale Trading Card | |
| State Commodity Code | 01 |
| Trading Coefficient | 0.05 |
| Trading Efficiency | 0.15 |
| Required Quantity (kp) | 35 |
| P/S Trading Tax (pp) | 0.16 |
| P/S Trading Price (pp) | 3.11 |
| Trader (Q) Profit (k$) | 11 |
| Buyer (Q) Profit (k$) | 11 |
| P/S Trader (Q) Profit (k$) | 5 |
| Total Quantity Cost (k$) | 108 |
| US-AL-01 | |
| The Yellowhammer State | |

Fig. 201

| ALASKA | |
|---|---|
| Purchase/Sale Trading Card | |
| State Commodity Code | 02 |
| Trading Coefficient | 6.E-04 |
| Trading Efficiency | 0.01 |
| Required Quantity (kp) | 77 |
| P/S Trading Tax (pp) | 0.95 |
| P/S Trading Price (pp) | 18.96 |
| P/S Trader (Q) Profit (k$) | 147 |
| Buyer (Q) Profit (k$) | 147 |
| P/S Trading (Q) Tax (k$) | 73 |
| Total Quantity Cost (k$) | 1468 |
| US-AK-02 | |
| The Last Frontier | |

Fig. 202

| ARIZONA | |
|---|---|
| Purchase/Sale Trading Card | |
| State Commodity Code | 03 |
| Trading Coefficient | 0.03 |
| Trading Efficiency | 0.11 |
| Required Quantity (kp) | 36 |
| P/S Trading Tax (pp) | 0.16 |
| P/S Trading Price (pp) | 3.16 |
| P/S Trader (Q) Profit (k$) | 11 |
| Buyer (Q) Profit (k$) | 11 |
| P/S Trading (Q) Tax (k$) | 6 |
| Total Quantity Cost (k$) | 112 |
| US-AZ-03 | |
| The Grand Canyon State | |

Fig. 203

| ARKANSAS | |
|---|---|
| Purchase/Sale Trading Card | |
| State Commodity Code | 04 |
| Trading Coefficient | 0.03 |
| Trading Efficiency | 0.10 |
| Required Quantity (kp) | 39 |
| P/S Trading Tax (pp) | 0.16 |
| P/S Trading Price (pp) | 3.23 |
| P/S Trader (Q) Profit (k$) | 13 |
| Buyer (Q) Profit (k$) | 13 |
| P/S Trading (Q) Tax (k$) | 6 |
| Total Quantity Cost (k$) | 128 |
| US-AR-04 | |
| The Natural State | |

Fig. 204

| CALIFORNIA | |
|---|---|
| Purchase/Sale Trading Card | |
| State Commodity Code | 05 |
| Trading Coefficient | 0.13 |
| Trading Efficiency | 0.50 |
| Required Quantity (kp) | 76 |
| P/S Trading Tax (pp) | 0.20 |
| P/S Trading Price (pp) | 3.94 |
| P/S Trader (Q) Profit (k$) | 30 |
| Buyer (Q) Profit (k$) | 30 |
| P/S Trading (Q) Tax (k$) | 15 |
| Total Quantity Cost (k$) | 299 |
| US-CA-05 | |
| The Golden State "Eureka" | |

Fig. 205

| COLORADO | |
|---|---|
| Purchase/Sale Trading Card | |
| State Commodity Code | 06 |
| Trading Coefficient | 0.03 |
| Trading Efficiency | 0.10 |
| Required Quantity (kp) | 55 |
| P/S Trading Tax (pp) | 0.18 |
| P/S Trading Price (pp) | 3.51 |
| P/S Trader (Q) Profit (k$) | 19 |
| Buyer (Q) Profit (k$) | 19 |
| P/S Trading (Q) Tax (k$) | 10 |
| Total Quantity Cost (k$) | 194 |
| US-CO-06 | |
| The Centennial State | |

Fig. 206

| CONNECTICUT | |
|---|---|
| Purchase/Sale Trading Card | |
| State Commodity Code | 07 |
| Trading Coefficient | 0.34 |
| Trading Efficiency | 1.42 |
| Required Quantity (kp) | 64 |
| P/S Trading Tax (pp) | 0.21 |
| P/S Trading Price (pp) | 4.23 |
| P/S Trader (Q) Profit (k$) | 27 |
| Buyer (Q) Profit (k$) | 27 |
| P/S Trading (Q) Tax (k$) | 14 |
| Total Quantity Cost (k$) | 272 |
| US-CT-07 | |
| The Constitution State | |

Fig. 207

| DELAWARE | |
|---|---|
| Purchase/Sale Trading Card | |
| State Commodity Code | 10 |
| Trading Coefficient | 0.26 |
| Trading Efficiency | 1.02 |
| Required Quantity (kp) | 63 |
| P/S Trading Tax (pp) | 0.20 |
| P/S Trading Price (pp) | 4.00 |
| P/S Trader (Q) Profit (k$) | 25 |
| Buyer (Q) Profit (k$) | 25 |
| P/S Trading (Q) Tax (k$) | 13 |
| Total Quantity Cost (k$) | 250 |
| US-DE-10 | |
| The First State | |

Fig. 208

| FLORIDA | |
|---|---|
| Purchase/Sale Trading Card | |
| State Commodity Code | 12 |
| Trading Coefficient | 0.17 |
| Trading Efficiency | 0.59 |
| Required Quantity (kp) | 47 |
| P/S Trading Tax (pp) | 0.17 |
| P/S Trading Price (pp) | 3.49 |
| P/S Trader (Q) Profit (k$) | 16 |
| Buyer (Q) Profit (k$) | 16 |
| P/S Trading (Q) Tax (k$) | 8 |
| Total Quantity Cost (k$) | 162 |
| US-FL-12 | |
| The Sunshine State | |

Fig. 209

| GEORGIA | |
|---|---|
| Purchase/Sale Trading Card | |
| State Commodity Code | 13 |
| Trading Coefficient | 0.09 |
| Trading Efficiency | 0.33 |
| Required Quantity (kp) | 57 |
| P/S Trading Tax (pp) | 0.18 |
| P/S Trading Price (pp) | 3.51 |
| P/S Trader (Q) Profit (k$) | 20 |
| Buyer (Q) Profit (k$) | 20 |
| P/S Trading (Q) Tax (k$) | 10 |
| Total Quantity Cost (k$) | 199 |
| US-GA-13 | |
| The Peach State | |

Fig. 210

| HAWAII | |
|---|---|
| Purchase/Sale Trading Card | |
| State Commodity Code | 14 |
| Trading Coefficient | 0.07 |
| Trading Efficiency | 0.21 |
| Required Quantity (kp) | 33 |
| P/S Trading Tax (pp) | 0.15 |
| P/S Trading Price (pp) | 3.10 |
| P/S Trader (Q) Profit (k$) | 10 |
| Buyer (Q) Profit (k$) | 10 |
| P/S Trading (Q) Tax (k$) | 5 |
| Total Quantity Cost (k$) | 103 |
| US-HI-14 | |
| The Aloha State | |

Fig. 211

| IDAHO | |
|---|---|
| Purchase/Sale Trading Card | |
| State Commodity Code | 15 |
| Trading Coefficient | 0.01 |
| Trading Efficiency | 0.04 |
| Required Quantity (kp) | 36 |
| P/S Trading Tax (pp) | 0.18 |
| P/S Trading Price (pp) | 3.53 |
| P/S Trader (Q) Profit (k$) | 13 |
| Buyer (Q) Profit (k$) | 13 |
| P/S Trading (Q) Tax (k$) | 6 |
| Total Quantity Cost (k$) | 128 |
| US-ID-15 | |
| The Gem State | |

Fig. 212

| ILLINOIS | |
|---|---|
| Purchase/Sale Trading Card | |
| State Commodity Code | 16 |
| Trading Coefficient | 0.11 |
| Trading Efficiency | 0.43 |
| Required Quantity (kp) | 71 |
| P/S Trading Tax (pp) | 0.19 |
| P/S Trading Price (pp) | 3.81 |
| P/S Trader (Q) Profit (k$) | 27 |
| Buyer (Q) Profit (k$) | 27 |
| P/S Trading (Q) Tax (k$) | 14 |
| Total Quantity Cost (k$) | 270 |
| US-IL-16 | |
| The Land of Lincoln | |

Fig. 213

| INDIANA | |
|---|---|
| Purchase/Sale Trading Card | |
| State Commodity Code | 17 |
| Trading Coefficient | 0.10 |
| Trading Efficiency | 0.33 |
| Required Quantity (kp) | 52 |
| P/S Trading Tax (pp) | 0.17 |
| P/S Trading Price (pp) | 3.43 |
| P/S Trader (Q) Profit (k$) | 18 |
| Buyer (Q) Profit (k$) | 18 |
| P/S Trading (Q) Tax (k$) | 9 |
| Total Quantity Cost (k$) | 177 |
| US-IN-17 | |
| The Hoosier State | |

Fig. 214

| IOWA | |
|---|---|
| Purchase/Sale Trading Card | |
| State Commodity Code | 20 |
| Trading Coefficient | 0.03 |
| Trading Efficiency | 0.09 |
| Required Quantity (kp) | 39 |
| P/S Trading Tax (pp) | 0.16 |
| P/S Trading Price (pp) | 3.23 |
| P/S Trader (Q) Profit (k$) | 13 |
| Buyer (Q) Profit (k$) | 13 |
| P/S Trading (Q) Tax (k$) | 6 |
| Total Quantity Cost (k$) | 127 |
| US-IA-20 | |
| The Hawkeye State | |

Fig. 215

| KANSAS | |
|---|---|
| Purchase/Sale Trading Card | |
| State Commodity Code | 21 |
| Trading Coefficient | 0.02 |
| Trading Efficiency | 0.07 |
| Required Quantity (kp) | 56 |
| P/S Trading Tax (pp) | 0.18 |
| P/S Trading Price (pp) | 3.65 |
| P/S Trader (Q) Profit (k$) | 21 |
| Buyer (Q) Profit (k$) | 21 |
| P/S Trading (Q) Tax (k$) | 10 |
| Total Quantity Cost (k$) | 206 |
| US-KS-21 | |
| The Sunflower State | |

Fig. 216

| KENTUCKY | |
|---|---|
| Purchase/Sale Trading Card | |
| State Commodity Code | 23 |
| Trading Coefficient | 0.06 |
| Trading Efficiency | 0.19 |
| Required Quantity (kp) | 48 |
| P/S Trading Tax (pp) | 0.17 |
| P/S Trading Price (pp) | 3.33 |
| P/S Trader (Q) Profit (k$) | 16 |
| Buyer (Q) Profit (k$) | 16 |
| P/S Trading (Q) Tax (k$) | 8 |
| Total Quantity Cost (k$) | 161 |
| US-KY-23 | |
| The Bluegrass State | |

Fig. 217

| LOUISIANA | |
|---|---|
| Purchase/Sale Trading Card | |
| State Commodity Code | 24 |
| Trading Coefficient | 0.05 |
| Trading Efficiency | 0.15 |
| Required Quantity (kp) | 46 |
| P/S Trading Tax (pp) | 0.16 |
| P/S Trading Price (pp) | 3.29 |
| P/S Trader (Q) Profit (k$) | 15 |
| Buyer (Q) Profit (k$) | 15 |
| P/S Trading (Q) Tax (k$) | 8 |
| Total Quantity Cost (k$) | 151 |
| US-LA-24 | |
| The Pelican State | |

Fig. 218

| MAINE | |
|---|---|
| Purchase/Sale Trading Card | |
| State Commodity Code | 25 |
| Trading Coefficient | 0.02 |
| Trading Efficiency | 0.07 |
| Required Quantity (kp) | 39 |
| P/S Trading Tax (pp) | 0.17 |
| P/S Trading Price (pp) | 3.32 |
| P/S Trader (Q) Profit (k$) | 13 |
| Buyer (Q) Profit (k$) | 13 |
| P/S Trading (Q) Tax (k$) | 6 |
| Total Quantity Cost (k$) | 129 |
| US-ME-25 | |
| The Pine Tree State | |

Fig. 219

| MARYLAND | |
|---|---|
| Purchase/Sale Trading Card | |
| State Commodity Code | 26 |
| Trading Coefficient | 0.25 |
| Trading Efficiency | 1.02 |
| Required Quantity (kp) | 63 |
| P/S Trading Tax (pp) | 0.20 |
| P/S Trading Price (pp) | 4.00 |
| P/S Trader (Q) Profit (k$) | 25 |
| Buyer (Q) Profit (k$) | 25 |
| P/S Trading (Q) Tax (k$) | 13 |
| Total Quantity Cost (k$) | 253 |
| US-MD-26 | |
| The Old Line State | |

Fig. 220

| MASSACHUSETTS | |
|---|---|
| Purchase/Sale Trading Card | |
| State Commodity Code | 27 |
| Trading Coefficient | 0.34 |
| Trading Efficiency | 1.55 |
| Required Quantity (kp) | 76 |
| P/S Trading Tax (pp) | 0.23 |
| P/S Trading Price (pp) | 4.51 |
| P/S Trader (Q) Profit (k$) | 34 |
| Buyer (Q) Profit (k$) | 34 |
| P/S Trading (Q) Tax (k$) | 17 |
| Total Quantity Cost (k$) | 342 |
| US-MA-27 | |
| The Bay State | |

Fig. 221

| MICHIGAN | |
|---|---|
| Purchase/Sale Trading Card | |
| State Commodity Code | 30 |
| Trading Coefficient | 0.05 |
| Trading Efficiency | 0.18 |
| Required Quantity (kp) | 54 |
| P/S Trading Tax (pp) | 0.17 |
| P/S Trading Price (pp) | 3.43 |
| P/S Trader (Q) Profit (k$) | 19 |
| Buyer (Q) Profit (k$) | 19 |
| P/S Trading (Q) Tax (k$) | 9 |
| Total Quantity Cost (k$) | 187 |
| US-MI-30 | |
| The Great Lake State | |

Fig. 222

| MINNESOTA | |
|---|---|
| Purchase/Sale Trading Card | |
| State Commodity Code | 31 |
| Trading Coefficient | 0.03 |
| Trading Efficiency | 0.11 |
| Required Quantity (kp) | 46 |
| P/S Trading Tax (pp) | 0.17 |
| P/S Trading Price (pp) | 3.33 |
| P/S Trader (Q) Profit (k$) | 15 |
| Buyer (Q) Profit (k$) | 15 |
| P/S Trading (Q) Tax (k$) | 8 |
| Total Quantity Cost (k$) | 155 |
| US-MN-31 | |
| Land of 10,000 Lakes | |

Fig. 223

| MISSISSIPPI | |
|---|---|
| Purchase/Sale Trading Card | |
| State Commodity Code | 32 |
| Trading Coefficient | 0.03 |
| Trading Efficiency | 0.10 |
| Required Quantity (kp) | 33 |
| P/S Trading Tax (pp) | 0.16 |
| P/S Trading Price (pp) | 3.12 |
| P/S Trader (Q) Profit (k$) | 10 |
| Buyer (Q) Profit (k$) | 10 |
| P/S Trading (Q) Tax (k$) | 5 |
| Total Quantity Cost (k$) | 103 |
| US-MS-32 | |
| The Magnolia State | |

Fig. 224

| MISSOURI | |
|---|---|
| Purchase/Sale Trading Card | |
| State Commodity Code | 34 |
| Trading Coefficient | 0.05 |
| Trading Efficiency | 0.15 |
| Required Quantity (kp) | 49 |
| P/S Trading Tax (pp) | 0.17 |
| P/S Trading Price (pp) | 3.34 |
| P/S Trader (Q) Profit (k$) | 16 |
| Buyer (Q) Profit (k$) | 16 |
| P/S Trading (Q) Tax (k$) | 8 |
| Total Quantity Cost (k$) | 163 |
| US-MO-34 | |
| The Show Me State | |

Fig. 225

| MONTANA | |
|---|---|
| Purchase/Sale Trading Card | |
| State Commodity Code | 35 |
| Trading Coefficient | 0.00 |
| Trading Efficiency | 0.02 |
| Required Quantity (kp) | 42 |
| P/S Trading Tax (pp) | 0.24 |
| P/S Trading Price (pp) | 4.87 |
| P/S Trader (Q) Profit (k$) | 20 |
| Buyer (Q) Profit (k$) | 20 |
| P/S Trading (Q) Tax (k$) | 10 |
| Total Quantity Cost (k$) | 203 |
| US-MT-35 | |
| The Big Sky State | |

Fig. 226

| NEBRASKA | |
|---|---|
| Purchase/Sale Trading Card | |
| State Commodity Code | 36 |
| Trading Coefficient | 0.01 |
| Trading Efficiency | 0.05 |
| Required Quantity (kp) | 47 |
| P/S Trading Tax (pp) | 0.18 |
| P/S Trading Price (pp) | 3.63 |
| P/S Trader (Q) Profit (k$) | 17 |
| Buyer (Q) Profit (k$) | 17 |
| P/S Trading (Q) Tax (k$) | 8 |
| Total Quantity Cost (k$) | 169 |
| US-NE-36 | |
| The Cornhusker State | |

Fig. 227

| NEVADA | |
|---|---|
| Purchase/Sale Trading Card | |
| State Commodity Code | 37 |
| Trading Coefficient | 0.01 |
| Trading Efficiency | 0.05 |
| Required Quantity (kp) | 56 |
| P/S Trading Tax (pp) | 0.19 |
| P/S Trading Price (pp) | 3.76 |
| P/S Trader (Q) Profit (k$) | 21 |
| Buyer (Q) Profit (k$) | 21 |
| P/S Trading (Q) Tax (k$) | 11 |
| Total Quantity Cost (k$) | 211 |
| US-NV-37 | |
| The Silver State | |

Fig. 228

| NEW HAMPSHIRE | |
|---|---|
| Purchase/Sale Trading Card | |
| State Commodity Code | 40 |
| Trading Coefficient | 0.08 |
| Trading Efficiency | 0.27 |
| Required Quantity (kp) | 63 |
| P/S Trading Tax (pp) | 0.18 |
| P/S Trading Price (pp) | 3.61 |
| P/S Trader (Q) Profit (k$) | 23 |
| Buyer (Q) Profit (k$) | 23 |
| P/S Trading (Q) Tax (k$) | 11 |
| Total Quantity Cost (k$) | 229 |
| US-NH-40 | |
| The Granite State | |

Fig. 229

| NEW JERSEY | |
|---|---|
| Purchase/Sale Trading Card | |
| State Commodity Code | 41 |
| Trading Coefficient | 0.53 |
| Trading Efficiency | 2.62 |
| Required Quantity (kp) | 72 |
| P/S Trading Tax (pp) | 0.25 |
| P/S Trading Price (pp) | 4.93 |
| P/S Trader (Q) Profit (k$) | 36 |
| Buyer (Q) Profit (k$) | 36 |
| P/S Trading (Q) Tax (k$) | 18 |
| Total Quantity Cost (k$) | 355 |
| US-NJ-41 | |
| The Garden State | |

Fig. 230

| NEW MEXICO | |
|---|---|
| Purchase/Sale Trading Card | |
| State Commodity Code | 42 |
| Trading Coefficient | 0.01 |
| Trading Efficiency | 0.03 |
| Required Quantity (kp) | 41 |
| P/S Trading Tax (pp) | 0.19 |
| P/S Trading Price (pp) | 3.76 |
| P/S Trader (Q) Profit (k$) | 15 |
| Buyer (Q) Profit (k$) | 15 |
| P/S Trading (Q) Tax (k$) | 8 |
| Total Quantity Cost (k$) | 152 |
| US-NM-42 | |
| The Land of Enchantment | |

Fig. 231

| NEW YORK | |
|---|---|
| Purchase/Sale Trading Card | |
| State Commodity Code | 43 |
| Trading Coefficient | 0.19 |
| Trading Efficiency | 0.80 |
| Required Quantity (kp) | 87 |
| P/S Trading Tax (pp) | 0.22 |
| P/S Trading Price (pp) | 4.32 |
| P/S Trader (Q) Profit (k$) | 38 |
| Buyer (Q) Profit (k$) | 38 |
| P/S Trading (Q) Tax (k$) | 19 |
| Total Quantity Cost (k$) | 378 |
| US-NY-43 | |
| The Empire State | |

Fig. 232

| NORTH CAROLINA | |
|---|---|
| Purchase/Sale Trading Card | |
| State Commodity Code | 45 |
| Trading Coefficient | 0.10 |
| Trading Efficiency | 0.34 |
| Required Quantity (kp) | 47 |
| P/S Trading Tax (pp) | 0.17 |
| P/S Trading Price (pp) | 3.36 |
| P/S Trader (Q) Profit (k$) | 16 |
| Buyer (Q) Profit (k$) | 16 |
| P/S Trading (Q) Tax (k$) | 8 |
| Total Quantity Cost (k$) | 159 |
| US-NC-45 | |
| The Old North State | |

Fig. 233

| NORTH DAKOTA | |
|---|---|
| Purchase/Sale Trading Card | |
| State Commodity Code | 46 |
| Trading Coefficient | 0.01 |
| Trading Efficiency | 0.03 |
| Required Quantity (kp) | 72 |
| P/S Trading Tax (pp) | 0.25 |
| P/S Trading Price (pp) | 4.97 |
| P/S Trader (Q) Profit (k$) | 36 |
| Buyer (Q) Profit (k$) | 36 |
| P/S Trading (Q) Tax (k$) | 18 |
| Total Quantity Cost (k$) | 360 |
| US-ND-46 | |
| The Peace Garden State | |

Fig. 234

| OHIO | |
|---|---|
| Purchase/Sale Trading Card | |
| State Commodity Code | 47 |
| Trading Coefficient | 0.14 |
| Trading Efficiency | 0.48 |
| Required Quantity (kp) | 54 |
| P/S Trading Tax (pp) | 0.18 |
| P/S Trading Price (pp) | 3.54 |
| P/S Trader (Q) Profit (k$) | 19 |
| Buyer (Q) Profit (k$) | 19 |
| P/S Trading (Q) Tax (k$) | 9 |
| Total Quantity Cost (k$) | 190 |
| US-OH-47 | |
| The Buckeye State | |

Fig. 235

| OKLAHOMA | |
|---|---|
| Purchase/Sale Trading Card | |
| State Commodity Code | 50 |
| Trading Coefficient | 0.03 |
| Trading Efficiency | 0.09 |
| Required Quantity (kp) | 33 |
| P/S Trading Tax (pp) | 0.16 |
| P/S Trading Price (pp) | 3.14 |
| P/S Trader (Q) Profit (k$) | 10 |
| Buyer (Q) Profit (k$) | 10 |
| P/S Trading (Q) Tax (k$) | 5 |
| Total Quantity Cost (k$) | 105 |
| US-OK-50 | |
| The Native America State | |

Fig. 236

| OREGON | |
|---|---|
| Purchase/Sale Trading Card | |
| State Commodity Code | 51 |
| Trading Coefficient | 0.02 |
| Trading Efficiency | 0.08 |
| Required Quantity (kp) | 52 |
| P/S Trading Tax (pp) | 0.18 |
| P/S Trading Price (pp) | 3.52 |
| P/S Trader (Q) Profit (k$) | 18 |
| Buyer (Q) Profit (k$) | 18 |
| P/S Trading (Q) Tax (k$) | 9 |
| Total Quantity Cost (k$) | 184 |
| US-OR-51 | |
| The Beaver State | |

Fig. 237

| PENNSYLVANIA | |
|---|---|
| Purchase/Sale Trading Card | |
| State Commodity Code | 52 |
| Trading Coefficient | 0.14 |
| Trading Efficiency | 0.54 |
| Required Quantity (kp) | 63 |
| P/S Trading Tax (pp) | 0.19 |
| P/S Trading Price (pp) | 3.73 |
| P/S Trader (Q) Profit (k$) | 23 |
| Buyer (Q) Profit (k$) | 23 |
| P/S Trading (Q) Tax (k$) | 12 |
| Total Quantity Cost (k$) | 234 |
| US-PA-52 | |
| The Keystone State | |

Fig. 238

| RHODE ISLAND | |
|---|---|
| Purchase/Sale Trading Card | |
| State Commodity Code | 53 |
| Trading Coefficient | 0.45 |
| Trading Efficiency | 2.18 |
| Required Quantity (kp) | 76 |
| P/S Trading Tax (pp) | 0.24 |
| P/S Trading Price (pp) | 4.81 |
| P/S Trader (Q) Profit (k$) | 36 |
| Buyer (Q) Profit (k$) | 36 |
| P/S Trading (Q) Tax (k$) | 18 |
| Total Quantity Cost (k$) | 364 |
| US-RI-53 | |
| The Ocean State | |

Fig. 239

| SOUTH CAROLINA | |
|---|---|
| Purchase/Sale Trading Card | |
| State Commodity Code | 54 |
| Trading Coefficient | 0.08 |
| Trading Efficiency | 0.26 |
| Required Quantity (kp) | 30 |
| P/S Trading Tax (pp) | 0.15 |
| P/S Trading Price (pp) | 3.07 |
| P/S Trader (Q) Profit (k$) | 9 |
| Buyer (Q) Profit (k$) | 9 |
| P/S Trading (Q) Tax (k$) | 5 |
| Total Quantity Cost (k$) | 91 |
| US-SC-54 | |
| The Palmetto State | |

Fig. 240

| SOUTH DAKOTA | |
|---|---|
| Purchase/Sale Trading Card | |
| State Commodity Code | 56 |
| Trading Coefficient | 0.01 |
| Trading Efficiency | 0.03 |
| Required Quantity (kp) | 45 |
| P/S Trading Tax (pp) | 0.21 |
| P/S Trading Price (pp) | 4.24 |
| P/S Trader (Q) Profit (k$) | 19 |
| Buyer (Q) Profit (k$) | 19 |
| P/S Trading (Q) Tax (k$) | 10 |
| Total Quantity Cost (k$) | 191 |
| US-SD-56 | |
| The Mount Rushmore State | |

Fig. 241

| TENNESSEE | |
|---|---|
| Purchase/Sale Trading Card | |
| State Commodity Code | 57 |
| Trading Coefficient | 0.08 |
| Trading Efficiency | 0.26 |
| Required Quantity (kp) | 34 |
| P/S Trading Tax (pp) | 0.16 |
| P/S Trading Price (pp) | 3.13 |
| P/S Trader (Q) Profit (k$) | 11 |
| Buyer (Q) Profit (k$) | 11 |
| P/S Trading (Q) Tax (k$) | 5 |
| Total Quantity Cost (k$) | 107 |
| US-TN-57 | |
| The Volunteer State | |

Fig. 242

| TEXAS | |
|---|---|
| Purchase/Sale Trading Card | |
| State Commodity Code | 60 |
| Trading Coefficient | 0.06 |
| Trading Efficiency | 0.20 |
| Required Quantity (kp) | 62 |
| P/S Trading Tax (pp) | 0.18 |
| P/S Trading Price (pp) | 3.57 |
| P/S Trader (Q) Profit (k$) | 22 |
| Buyer (Q) Profit (k$) | 22 |
| P/S Trading (Q) Tax (k$) | 11 |
| Total Quantity Cost (k$) | 222 |
| US-TX-60 | |
| The Lone Star State | |

Fig. 243

| UTAH | |
|---|---|
| Purchase/Sale Trading Card | |
| State Commodity Code | 61 |
| Trading Coefficient | 0.02 |
| Trading Efficiency | 0.07 |
| Required Quantity (kp) | 41 |
| P/S Trading Tax (pp) | 0.17 |
| P/S Trading Price (pp) | 3.35 |
| P/S Trader (Q) Profit (k$) | 14 |
| Buyer (Q) Profit (k$) | 14 |
| P/S Trading (Q) Tax (k$) | 7 |
| Total Quantity Cost (k$) | 136 |
| US-UT-61 | |
| The Beehive State | |

Fig. 244

| VERMONT | |
|---|---|
| Purchase/Sale Trading Card | |
| State Commodity Code | 62 |
| Trading Coefficient | 0.03 |
| Trading Efficiency | 0.10 |
| Required Quantity (kp) | 31 |
| P/S Trading Tax (pp) | 0.15 |
| P/S Trading Price (pp) | 3.09 |
| P/S Trader (Q) Profit (k$) | 10 |
| Buyer (Q) Profit (k$) | 10 |
| P/S Trading (Q) Tax (k$) | 5 |
| Total Quantity Cost (k$) | 96 |
| US-VT-62 | |
| The Green Mountain State | |

Fig. 245

| VIRGINIA | |
|---|---|
| Purchase/Sale Trading Card | |
| State Commodity Code | 63 |
| Trading Coefficient | 0.10 |
| Trading Efficiency | 0.37 |
| Required Quantity (kp) | 56 |
| P/S Trading Tax (pp) | 0.18 |
| P/S Trading Price (pp) | 3.52 |
| P/S Trader (Q) Profit (k$) | 20 |
| Buyer (Q) Profit (k$) | 20 |
| P/S Trading (Q) Tax (k$) | 10 |
| Total Quantity Cost (k$) | 197 |
| US-VA-63 | |
| The Old Dominion State | |

Fig. 246

| WASHINGTON | |
|---|---|
| Purchase/Sale Trading Card | |
| State Commodity Code | 64 |
| Trading Coefficient | 0.06 |
| Trading Efficiency | 0.21 |
| Required Quantity (kp) | 76 |
| P/S Trading Tax (pp) | 0.19 |
| P/S Trading Price (pp) | 3.82 |
| P/S Trader (Q) Profit (k$) | 29 |
| Buyer (Q) Profit (k$) | 29 |
| P/S Trading (Q) Tax (k$) | 14 |
| Total Quantity Cost (k$) | 289 |
| US-WA-64 | |
| The Evergreen State | |

Fig. 247

| WEST VIRGINIA | |
|---|---|
| Purchase/Sale Trading Card | |
| State Commodity Code | 65 |
| Trading Coefficient | 0.04 |
| Trading Efficiency | 0.13 |
| Required Quantity (kp) | 43 |
| P/S Trading Tax (pp) | 0.16 |
| P/S Trading Price (pp) | 3.26 |
| P/S Trader (Q) Profit (k$) | 14 |
| Buyer (Q) Profit (k$) | 14 |
| P/S Trading (Q) Tax (k$) | 7 |
| Total Quantity Cost (k$) | 141 |
| US-WV-65 | |
| The Mountain State | |

Fig. 248

| WISCONSIN | |
|---|---|
| Purchase/Sale Trading Card | |
| State Commodity Code | 67 |
| Trading Coefficient | 0.05 |
| Trading Efficiency | 0.15 |
| Required Quantity (kp) | 43 |
| P/S Trading Tax (pp) | 0.16 |
| P/S Trading Price (pp) | 3.24 |
| P/S Trader (Q) Profit (k$) | 14 |
| Buyer (Q) Profit (k$) | 14 |
| P/S Trading (Q) Tax (k$) | 7 |
| Total Quantity Cost (k$) | 138 |
| US-WI-67 | |
| The Badger State | |

Fig. 249

| WYOMING | |
|---|---|
| Purchase/Sale Trading Card | |
| State Commodity Code | 70 |
| Trading Coefficient | 3.E-03 |
| Trading Efficiency | 0.02 |
| Required Quantity (kp) | 66 |
| P/S Trading Tax (pp) | 0.30 |
| P/S Trading Price (pp) | 6.01 |
| P/S Trader (Q) Profit (k$) | 40 |
| Buyer (Q) Profit (k$) | 40 |
| P/S Trading (Q) Tax (k$) | 20 |
| Total Quantity Cost (k$) | 398 |
| US-WY-70 | |
| The Equality State | |

Fig. 250

ALABAMA

AL

01

STATE

US-AL-01

The Yellowhammer State

Fig. 251

ALASKA

AK

02

STATE

US-AK-02

The Last Frontier State

Fig. 252

ARIZONA

AZ

03

STATE

US-AZ-03

The Grand Canyon State

Fig. 253

ARKANSAS

AR

04

STATE

US-AR-04

The Natural State

Fig. 254

CALIFORNIA

CA

05

STATE

US-CA-05

The Golden State "Eureka"

Fig. 255

COLORADO

CO

06

STATE

US-CO-06

The Centennial State

Fig. 256

CONNECTICUT

CT

07

STATE

US-CT-07

The Constitution State

Fig. 257

DELAWARE

DE

10

STATE

US-DE-10

The First State

Fig. 258

FLORIDA

FL

12

STATE

US-FL-12

The Sunshine State

Fig. 259

GEORGIA
GA
13
STATE
US-GA-13
The Peach State

Fig. 260

HAWAII
HI
14
STATE
US-HI-14
The Aloha State

Fig. 261

IDAHO
ID
15
STATE
US-ID-15
The Gem State

Fig. 262

ILLINOIS
IL
16
STATE
US-IL-16
The Land of Lincoln

Fig. 263

INDIANA
IN
17
STATE
US-IN-17
The Hoosier State

Fig. 264

IOWA
IA
20
STATE
US-IA-20
The Hawkeye State

Fig. 265

KANSAS
KS
21
STATE
US-KS-21
The Sunflower State

Fig. 266

KENTUCKY
KY
23
STATE
US-KY-23
The Bluegrass State

Fig. 267

LOUISIANA
LA
24
STATE
US-LA-24
The Pelican State

Fig. 268

MAINE
ME
25
STATE
US-ME-25
The Pine Tree State

Fig. 269

MARYLAND
MD
26
STATE
US-MD-26
The Old-Line State

Fig. 270

MASSACHUSETTS
MA
27
STATE
US-MA-27
The Bay State

Fig. 271

MICHIGAN
MI
30
STATE
US-MI-30
The Great Lake State

Fig. 272

MINNESOTA
MN
31
STATE
US-MN-31
Land of 10,000 Lakes

Fig. 273

MISSISSIPPI
MS
32
STATE
US-MS-32
The Magnolia State

Fig. 274

MISSOURI
MO
34
STATE
US-MO-34
The Show Me State

Fig. 275

MONTANA
MT
35
STATE
US-MT-35
The Big Sky State

Fig. 276

NEBRASKA
NE
36
STATE
US-NE-36
The Cornhusker State

Fig. 277

NEVADA

NV

37

STATE

US-NV-37
The Silver State

Fig. 278

NEW HAMPSHIRE

NH

40

STATE

US-NH-40
the Granite State

Fig. 279

NEW JERSEY

NJ

41

STATE

US-NJ-41
The Garden State

Fig. 280

NEW MEXICO

NM

42

STATE

US-NM-42
The Land of Enchantment

Fig. 281

NEW YORK

NY

43

STATE

US-NY-43
The Empire State

Fig. 282

NORTH CAROLINA

NC

45

STATE

US-NC-45
The Old North State

Fig. 283

NORTH DAKOTA

ND

46

STATE

US-ND-46
The Peace Garden State

Fig. 284

OHIO

OH

47

STATE

US-OH-47
The Buckeye State

Fig. 285

OKLAHOMA

OK

50

STATE

US-OK-50
The Native America State

Fig. 286

OREGON

OR

51

STATE

US-OR-51
The Beaver State

Fig. 287

PENNSYLVANIA

PA

52

STATE

US-PA-52
The Keystone State

Fig. 288

RHODE ISLAND

RI

53

STATE

US-RI-53
The Ocean State

Fig. 289

SOUTH CAROLINA

SC

54

STATE

US-SC-54
The Palmetto State

Fig. 290

SOUTH DAKOTA

SD

56

STATE

US-SD-56
The Mount Rushmore State

Fig. 291

TENNESSEE

TN

57

STATE

US-TN-57
The Volunteer State

Fig. 292

TEXAS

TX

60

STATE

US-TX-60
The Lone Star State

Fig. 293

UTAH

UT

61

STATE

US-UT-61
The Beehive State

Fig. 294

VERMONT

VT

62

STATE

US-VT-62
The Green Mountain State

Fig. 295

VIRGINIA

VA

63

STATE

US-VA-63

The Old Dominion State

Fig. 296

WASHINGTON

WA

64

STATE

US-WA-64

The Evergreen State

Fig. 297

WEST VIRGINIA

WV

65

STATE

US-WV-65

The Mountain State

Fig. 298

WISCONSIN

WI

67

STATE

US-WI-67

The Badger State

Fig. 299

WYOMING

WY

70

STATE

US-WY-70

The Equality State

Fig. 300

ALABAMA
AL
01
PRODUCTION
US-AL-01
The Yellowhammer State

Fig. 301

ALASKA
AK
02
PRODUCTION
US-AK-02
The Last Frontier State

Fig. 302

ARIZONA
AZ
03
PRODUCTION
US-AZ-03
The Grand Canyon State

Fig. 303

ARKANSAS
AR
04
PRODUCTION
US-AR-04
The Natural State

Fig. 304

CALIFORNIA
CA
05
PRODUCTION
US-CA-05
The Golden State "Eureka"

Fig. 305

COLORADO
CO
06
PRODUCTION
US-CO-06
The Centennial State

Fig. 306

CONNECTICUT
CT
07
PRODUCTION
US-CT-07
The Constitution State

Fig. 307

DELAWARE
DE
10
PRODUCTION
US-DE-10
The First State

Fig. 308

FLORIDA
FL
12
PRODUCTION
US-FL-12
The Sunshine State

Fig. 309

GEORGIA
GA
13
PRODUCTION
US-GA-13
The Peach State

Fig. 310

HAWAII
HI
14
PRODUCTION
US-HI-14
The Aloha State

Fig. 311

IDAHO
ID
15
PRODUCTION
US-ID-15
The Gem State

Fig. 312

ILLINOIS
IL
16
PRODUCTION
US-IL-16
The Land of Lincoln

Fig. 313

INDIANA
IN
17
PRODUCTION
US-IN-17
The Hoosier State

Fig. 314

IOWA
IA
20
PRODUCTION
US-IA-20
The Hawkeye State

Fig. 315

KANSAS
KS
21
PRODUCTION
US-KS-21
The Sunflower State

Fig. 316

KENTUCKY
KY
23
PRODUCTION
US-KY-23
The Bluegrass State

Fig. 317

LOUISIANA
LA
24
PRODUCTION
US-LA-24
The Pelican State

Fig. 318

MAINE
ME
25
PRODUCTION
US-ME-25
The Pine Tree State

Fig. 319

MARYLAND
MD
26
PRODUCTION
US-MD-26
The Old-Line State

Fig. 320

MASSACHUSETTS
MA
27
PRODUCTION
US-MA-27
The Bay State

Fig. 321

MICHIGAN
MI
30
PRODUCTION
US-MI-30
The Great Lake State

Fig. 322

MINNESOTA
MN
31
PRODUCTION
US-MN-31
Land of 10,000 Lakes

Fig. 323

MISSISSIPPI
MS
32
PRODUCTION
US-MS-32
The Magnolia State

Fig. 324

MISSOURI
MO
34
PRODUCTION
US-MO-34
The Show Me State

Fig. 325

MONTANA
MT
35
PRODUCTION
US-MT-35
The Big Sky State

Fig. 326

NEBRASKA
NE
36
PRODUCTION
US-NE-36
The Cornhusker State

Fig. 327

NEVADA
NV
37
PRODUCTION
US-NV-37
The Silver State

Fig. 328

NEW HAMPSHIRE
NH
40
PRODUCTION
US-NH-40
the Granite State

Fig. 329

NEW JERSEY
NJ
41
PRODUCTION
US-NJ-41
The Garden State

Fig. 330

NEW MEXICO
NM
42
PRODUCTION
US-NM-42
The Land of Enchantment

Fig. 331

NEW YORK
NY
43
PRODUCTION
US-NY-43
The Empire State

Fig. 332

NORTH CAROLINA
NC
45
PRODUCTION
US-NC-45
The Old North State

Fig. 333

NORTH DAKOTA
ND
46
PRODUCTION
US-ND-46
The Peace Garden State

Fig. 334

OHIO
OH
47
PRODUCTION
US-OH-47
The Buckeye State

Fig. 335

OKLAHOMA
OK
50
PRODUCTION
US-OK-50
The Native America State

Fig. 336

OREGON
OR
51
PRODUCTION
US-OR-51
The Beaver State

Fig. 337

PENNSYLVANIA
PA
52
PRODUCTION
US-PA-52
The Keystone State

Fig. 338

RHODE ISLAND
RI
53
PRODUCTION
US-RI-53
The Ocean State

Fig. 339

SOUTH CAROLINA
SC
54
PRODUCTION
US-SC-54
The Palmetto State

Fig. 340

SOUTH DAKOTA
SD
56
PRODUCTION
US-SD-56
The Mount Rushmore State

Fig. 341

TENNESSEE
TN
57
PRODUCTION
US-TN-57
The Volunteer State

Fig. 342

TEXAS
TX
60
PRODUCTION
US-TX-60
The Lone Star State

Fig. 343

UTAH
UT
61
PRODUCTION
US-UT-61
The Beehive State

Fig. 344

VERMONT
VT
62
PRODUCTION
US-VT-62
The Green Mountain State

Fig. 345

VIRGINIA

VA

63

PRODUCTION

US-VA-63

The Old Dominion State

Fig. 346

WASHINGTON

WA

64

PRODUCTION

US-WA-64

The Evergreen State

Fig. 347

WEST VIRGINIA

WV

65

PRODUCTION

US-WV-65

The Mountain State

Fig. 348

WISCONSIN

WI

67

PRODUCTION

US-WI-67

The Badger State

Fig. 349

WYOMING

WY

70

PRODUCTION

US-WY-70

The Equality State

Fig. 350

ALABAMA
AL
01
MANUFACTURING
US-AL-01
The Yellowhammer State

Fig. 351

ALASKA
AK
02
MANUFACTURING
US-AK-02
The Last Frontier State

Fig. 352

ARIZONA
AZ
03
MANUFACTURING
US-AZ-03
The Grand Canyon State

Fig. 353

ARKANSAS
AR
04
MANUFACTURING
US-AR-04
The Natural State

Fig. 354

CALIFORNIA
CA
05
MANUFACTURING
US-CA-05
The Golden State "Eureka"

Fig. 355

COLORADO
CO
06
MANUFACTURING
US-CO-06
The Centennial State

Fig. 356

CONNECTICUT
CT
07
MANUFACTURING
US-CT-07
The Constitution State

Fig. 357

DELAWARE
DE
10
MANUFACTURING
US-DE-10
The First State

Fig. 358

FLORIDA
FL
12
MANUFACTURING
US-FL-12
The Sunshine State

Fig. 359

GEORGIA
GA
13
MANUFACTURING
US-GA-13
The Peach State

Fig. 360

HAWAII
HI
14
MANUFACTURING
US-HI-14
The Aloha State

Fig. 361

IDAHO
ID
15
MANUFACTURING
US-ID-15
The Gem State

Fig. 362

ILLINOIS
IL
16
MANUFACTURING
US-IL-16
The Land of Lincoln

Fig. 363

INDIANA
IN
17
MANUFACTURING
US-IN-17
The Hoosier State

Fig. 364

IOWA
IA
20
MANUFACTURING
US-IA-20
The Hawkeye State

Fig. 365

KANSAS
KS
21
MANUFACTURING
US-KS-21
The Sunflower State

Fig. 366

KENTUCKY
KY
23
MANUFACTURING
US-KY-23
The Bluegrass State

Fig. 367

LOUISIANA
LA
24
MANUFACTUTING
US-LA-24
The Pelican State

Fig. 368

MAINE
ME
25
MANUFACTURING
US-ME-25
The Pine Tree State

Fig. 369

MARYLAND
MD
26
MANUFACTURING
US-MD-26
The Old-Line State

Fig. 370

MASSACHUSETTS
MA
27
MANUFACTURING
US-MA-27
The Bay State

Fig. 371

MICHIGAN
MI
30
MANUFACTURING
US-MI-30
The Great Lake State

Fig. 372

MINNESOTA
MN
31
MANUFACTURING
US-MN-31
Land of 10,000 Lakes

Fig. 373

MISSISSIPPI
MS
32
MANUFACTURING
US-MS-32
The Magnolia State

Fig. 374

MISSOURI
MO
34
MANUFACTURING
US-MO-34
The Show Me State

Fig. 375

MONTANA
MT
35
MANUFACTURING
US-MT-35
The Big Sky State

Fig. 376

NEBRASKA
NE
36
MANUFACTURING
US-NE-36
The Cornhusker State

Fig. 377

VIRGINIA

VA

63

MANUFACTURING

US-VA-63

The Old Dominion State

Fig. 396

WASHINGTON

WA

64

MANUFACTURING

US-WA-64

The Evergreen State

Fig. 397

WEST VIRGINIA

WV

65

MANUFACTURING

US-WV-65

The Mountain State

Fig. 398

WISCONSIN

WI

67

MANUFACTURING

US-WI-67

The Badger State

Fig. 399

WYOMING

WY

70

MANUFACTURING

US-WY-70

The Equality State

Fig. 400

ALABAMA

AL

01

SERVICES

US-AL-01

The Yellowhammer State

Fig. 401

ALASKA

AK

02

SERVICES

US-AK-02

The Last Frontier State

Fig. 402

ARIZONA

AZ

03

SERVICES

US-AZ-03

The Grand Canyon State

Fig. 403

ARKANSAS

AR

04

SERVICES

US-AR-04

The Natural State

Fig. 404

CALIFORNIA

CA

05

SERVICES

US-CA-05

The Golden State "Eureka"

Fig. 405

COLORADO

CO

06

SERVICES

US-CO-06

The Centennial State

Fig. 406

CONNECTICUT

CT

07

SERVICES

US-CT-07

The Constitution State

Fig. 407

DELAWARE

DE

10

SERVICES

US-DE-10

The First State

Fig. 408

FLORIDA

FL

12

SERVICES

US-FL-12

The Sunshine State

Fig. 409

GEORGIA

GA

13

SERVICES

US-GA-13
The Peach State

Fig. 410

HAWAII

HI

14

SERVICES

US-HI-14
The Aloha State

Fig. 411

IDAHO

ID

15

SERVICES

US-ID-15
The Gem State

Fig. 412

ILLINOIS

IL

16

SERVICES

US-IL-16
The Land of Lincoln

Fig. 413

INDIANA

IN

17

SERVICES

US-IN-17
The Hoosier State

Fig. 414

IOWA

IA

20

SERVICES

US-IA-20
The Hawkeye State

Fig. 415

KANSAS

KS

21

SERVICES

US-KS-21
The Sunflower State

Fig. 416

KENTUCKY

KY

23

SERVICES

US-KY-23
The Bluegrass State

Fig. 417

LOUISIANA

LA

24

SERVICES

US-LA-24
The Pelican State

Fig. 418

MAINE
ME
25
SERVICES
US-ME-25
The Pine Tree State

Fig. 419

MARYLAND
MD
26
SERVICES
US-MD-26
The Old-Line State

Fig. 420

MASSACHUSETTS
MA
27
SERVICES
US-MA-27
The Bay State

Fig. 421

MICHIGAN
MI
30
SERVICES
US-MI-30
The Great Lake State

Fig. 422

MINNESOTA
MN
31
SERVICES
US-MN-31
Land of 10,000 Lakes

Fig. 423

MISSISSIPPI
MS
32
SERVICES
US-MS-32
The Magnolia State

Fig. 424

MISSOURI
MO
34
SERVICES
US-MO-34
The Show Me State

Fig. 425

MONTANA
MT
35
SERVICES
US-MT-35
The Big Sky State

Fig. 426

NEBRASKA
NE
36
SERVICES
US-NE-36
The Cornhusker State

Fig. 427

NEVADA
NV
37
SERVICES
US-NV-37
The Silver State

Fig. 428

NEW HAMPSHIRE
NH
40
SERVICES
US-NH-40
the Granite State

Fig. 429

NEW JERSEY
NJ
41
SERVICES
US-NJ-41
The Garden State

Fig. 430

NEW MEXICO
NM
42
SERVICES
US-NM-42
The Land of Enchantment

Fig. 431

NEW YORK
NY
43
SERVICES
US-NY-43
The Empire State

Fig. 432

NORTH CAROLINA
NC
45
SERVICES
US-NC-45
The Old North State

Fig. 433

NORTH DAKOTA
ND
46
SERVICES
US-ND-46
The Peace Garden State

Fig. 434

OHIO
OH
47
SERVICES
US-OH-47
The Buckeye State

Fig. 435

OKLAHOMA
OK
50
SERVICES
US-OK-50
The Native America State

Fig. 436

OREGON

OR

51

SERVICES

US-OR-51
The Beaver State

Fig. 437

PENNSYLVANIA

PA

52

SERVICES

US-PA-52
The Keystone State

Fig. 438

RHODE ISLAND

RI

53

SERVICES

US-RI-53
The Ocean State

Fig. 439

SOUTH CAROLINA

SC

54

SERVICES

US-SC-54
The Palmetto State

Fig. 440

SOUTH DAKOTA

SD

56

SERVICES

US-SD-56
The Mount Rushmore State

Fig. 441

TENNESSEE

TN

57

SERVICES

US-TN-57
The Volunteer State

Fig. 442

TEXAS

TX

60

SERVICES

US-TX-60
The Lone Star State

Fig. 443

UTAH

UT

61

SERVICES

US-UT-61
The Beehive State

Fig. 444

VERMONT

VT

62

SERVICES

US-VT-62
The Green Mountain State

Fig. 445

VIRGINIA

VA

63

SERVICES

US-VA-63
The Old Dominion State

Fig. 446

WASHINGTON

WA

64

SERVICES

US-WA-64
The Evergreen State

Fig. 447

WEST VIRGINIA

WV

65

SERVICES

US-WV-65
The Mountain State

Fig. 448

WISCONSIN

WI

67

SERVICES

US-WI-67
The Badger State

Fig. 449

WYOMING

WY

70

SERVICES

US-WY-70
The Equality State

Fig. 450

ALABAMA

AL

01

PURCHASE

US-AL-01

The Yellowhammer State

Fig. 451

ALASKA

AK

02

PURCHASE

US-AK-02

The Last Frontier State

Fig. 452

ARIZONA

AZ

03

PURCHASE

US-AZ-03

The Grand Canyon State

Fig. 453

ARKANSAS

AR

04

PURCHASE

US-AR-04

The Natural State

Fig. 454

CALIFORNIA

CA

05

PURCHASE

US-CA-05

The Golden State "Eureka"

Fig. 455

COLORADO

CO

06

PURCHASE

US-CO-06

The Centennial State

Fig. 456

CONNECTICUT

CT

07

PURCHASE

US-CT-07

The Constitution State

Fig. 457

DELAWARE

DE

10

PURCHASE

US-DE-10

The First State

Fig. 458

FLORIDA

FL

12

PURCHASE

US-FL-12

The Sunshine State

Fig. 459

GEORGIA

GA

13

PURCHASE

US-GA-13
The Peach State

Fig. 460

HAWAII

HI

14

PURCHASE

US-HI-14
The Aloha State

Fig. 461

IDAHO

ID

15

PURCHASE

US-ID-15
The Gem State

Fig. 462

ILLINOIS

IL

16

PURCHASE

US-IL-16
The Land of Lincoln

Fig. 463

INDIANA

IN

17

PURCHASE

US-IN-17
The Hoosier State

Fig. 464

IOWA

IA

20

PURCHASE

US-IA-20
The Hawkeye State

Fig. 465

KANSAS

KS

21

PURCHASE

US-KS-21
The Sunflower State

Fig. 466

KENTUCKY

KY

23

PURCHASE

US-KY-23
The Bluegrass State

Fig. 467

LOUISIANA

LA

24

PURCHASE

US-LA-24
The Pelican State

Fig. 468

MAINE

ME

25

PURCHASE

US-ME-25
The Pine Tree State

Fig. 469

MARYLAND

MD

26

PURCHASE

US-MD-26
The Old-Line State

Fig. 470

MASSACHUSETTS

MA

27

PURCHASE

US-MA-27
The Bay State

Fig. 471

MICHIGAN

MI

30

PURCHASE

US-MI-30
The Great Lake State

Fig. 472

MINNESOTA

MN

31

PURCHASE

US-MN-31
Land of 10,000 Lakes

Fig. 473

MISSISSIPPI

MS

32

PURCHASE

US-MS-32
The Magnolia State

Fig. 474

MISSOURI

MO

34

PURCHASE

US-MO-34
The Show Me State

Fig. 475

MONTANA

MT

35

PURCHASE

US-MT-35
The Big Sky State

Fig. 476

NEBRASKA

NE

36

PURCHASE

US-NE-36
The Cornhusker State

Fig. 477

NEVADA

NV

37

PURCHASE

US-NV-37

The Silver State

Fig. 478

NEW HAMPSHIRE

NH

40

PURCHASE

US-NH-40 the Granite State

Fig. 479

NEW JERSEY

NJ

41

PURCHASE

US-NJ-41

The Garden State

Fig. 480

NEW MEXICO

NM

42

PURCHASE

US-NM-42

The Land of Enchantment

Fig. 481

NEW YORK

NY

43

PURCHASE

US-NY-43

The Empire State

Fig. 482

NORTH CAROLINA

NC

45

PURCHASE

US-NC-45

The Old North State

Fig. 483

NORTH DAKOTA

ND

46

PURCHASE

US-ND-46

The Peace Garden State

Fig. 484

OHIO

OH

47

PURCHASE

US-OH-47

The Buckeye State

Fig. 485

OKLAHOMA

OK

50

PURCHASE

US-OK-50

The Native America State

Fig. 486

OREGON

OR

51

PURCHASE

US-OR-51
The Beaver State

Fig. 487

PENNSYLVANIA

PA

52

PURCHASE

US-PA-52
The Keystone State

Fig. 488

RHODE ISLAND

RI

53

PURCHASE

US-RI-53
The Ocean State

Fig. 489

SOUTH CAROLINA

SC

54

PURCHASE

US-SC-54
The Palmetto State

Fig. 490

SOUTH DAKOTA

SD

56

PURCHASE

US-SD-56
The Mount Rushmore State

Fig. 491

TENNESSEE

TN

57

PURCHASE

US-TN-57
The Volunteer State

Fig. 492

TEXAS

TX

60

PURCHASE

US-TX-60
The Lone Star State

Fig. 493

UTAH

UT

61

PURCHASE

US-UT-61
The Beehive State

Fig. 494

VERMONT

VT

62

PURCHASE

US-VT-62
The Green Mountain State

Fig. 495

VIRGINIA

VA

63

PURCHASE

US-VA-63

The Old Dominion State

Fig. 496

WASHINGTON

WA

64

PURCHASE

US-WA-64

The Evergreen State

Fig. 497

WEST VIRGINIA

WV

65

PURCHASE

US-WV-65

The Mountain State

Fig. 498

WISCONSIN

WI

67

PURCHASE

US-WI-67

The Badger State

Fig. 499

WYOMING

WY

70

PURCHASE

US-WY-70

The Equality State

Fig. 500

PHASE ONE
P1
00
STATE
LEGANCY PURCHASE

Fig. 501

PHASE ONE
P1
00
STATE
LEGANCY SALE

Fig. 502

PHASE TWO
P2
11
PRODUCTION
LEGANCY PURCHASE

Fig. 503

PHASE TWO
P2
11
PRODUCTION
LEGANCY SALE

Fig. 504

PHASE THREE
P3
22
MANUFACTURING
LEGANCY PURCHASE

Fig. 505

PHASE THREE
P3
22
MANUFACTURING
LEGANCY PURCHASE

Fig. 506

PHASE FOUR
P4
33
SERVICES
LEGANCY PURCHASE

Fig. 507

PHASE FOUR
P4
33
SERVICES
LEGANCY SALE

Fig. 508

PHASE FIVE
P5
44
PURCHASE
LEGANCY PURCHASE

Fig. 509

PHASE FIVE

P5

55

PURCHASE

LEGANCY SALE

Fig. 510

BONUS

BO

71

BONUS

BONUS

Fig. 511

PENALTY

PE

72

PENALTY

PENALTY

Fig. 512

PRIVILEGE

PA

73

ACQUIRE

ACQUIRE

Fig. 513

PRIVILEGE

PL

74

LOSS

LOSS

Fig. 514

BARTERING

BA

75

BARTERING

BARTERING

Fig. 515

DELEGATION

DE

76

DELEGATION

DELEGATION

Fig. 516

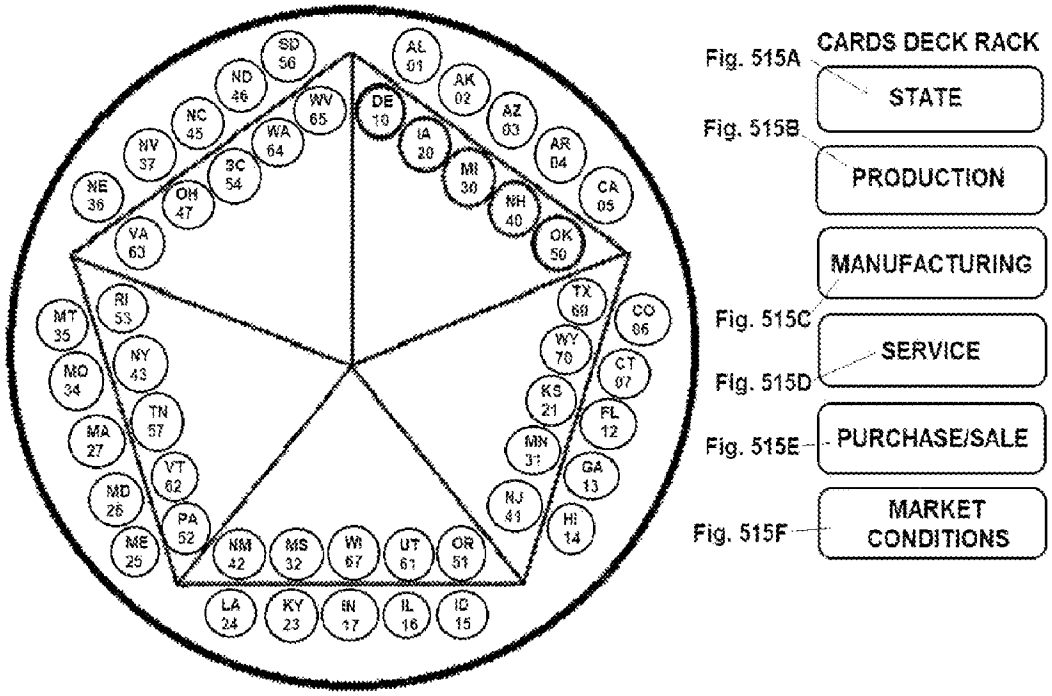
Fig. 515: Discloses a view of the preferred mode of invention in a general form.
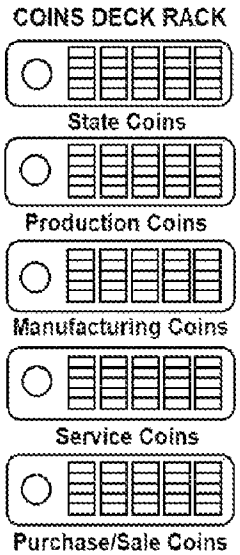
Fig. 515G Fig. 516: Discloses a view of the customized dice details.

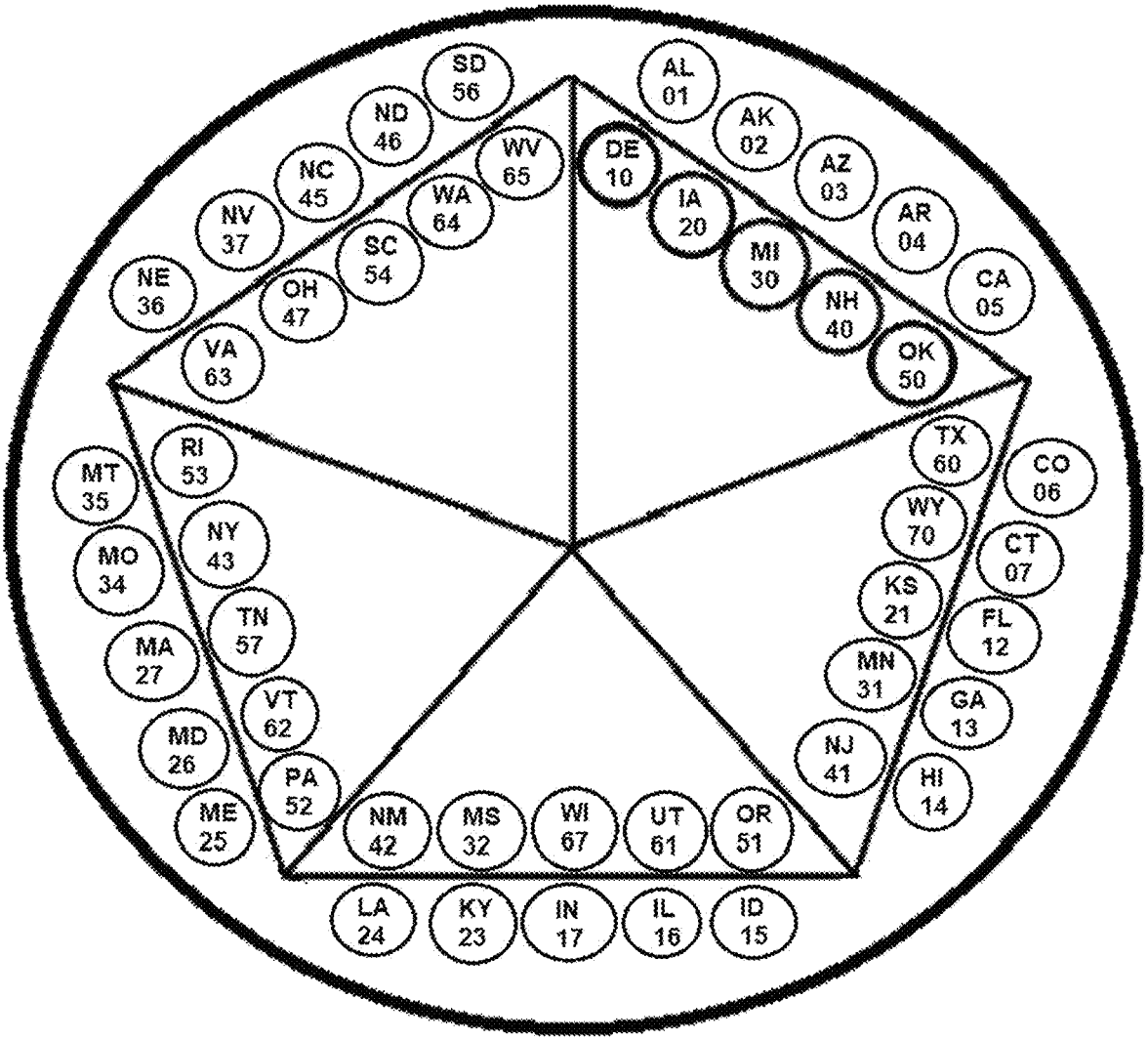
Fig. 517: Discloses a view of the formal game board details.

FAIRTRADE MARKET BOARD GAME

BACKGROUND OF THE INVENTION

Technical Field

1. This game is for entertainment and an experimental model for applying a new economic theory, studying acceptance and successful application of this theoretical model by individuals, and getting feedback on the concluded modifications after the real trial.
2. The present invention relates to the economic field and clarification of fairtrade aspects in the unfree market theory. The board game is supposed to be applied through the market, commodity trading, production, manufacturing, service providing, and marketing.
3. The game's goal is to make its player wealthier by selling, buying, and delivering services through other support operations. Later, the player switches from a buyer to a merchant and then toggles again from a prove product producer into the conversion industries manufacturer.

Background Art

Board games relating to the economy, marketing, and commerce have a long history. Typically, most board games are inspired by commerce and based upon the notion that the game-winner is the player who gains the highest amount of money compared to other players.

General Problem with Background Art

1. The central point of the inventor's discovery is the recognition that many commercially related games failed to appreciate the importance of knowing the real and compensated price of the commodity. They also mostly failed to understand the disciplines, the know-how, and high-tech knowledge involved in the product in terms of durability, regional availability, and technical compatibility with other competitors.
2. The proper value for a commodity depends on the production, manufacturing, resources, the government's contribution to estimate the tax, and when these added taxes should be paid. This invention introduces a vital aspect, which is the right way to share the sales profits between sale parties in every phase of the sale process and revealing the end-user consumer rights in all these shares.
3. The game tries to find the intermediate dealers, who could organize and manage the whole trade process under what we call the fairtrade market, involving the sale parties, the producers, and consumers in connection with knowing each other.
4. The game reveals the inherent rights lost by the sale parties. The parties are representing the producer, the end consumer, interim dealers, and the government.
5. We need to learn more about this process, assign the procedures that should be followed, and rules controlling all transactions in every phase. In these procedures, we shall show the benefits of the end consumer and the producer, because they build the entire market. After finding the proper market by any dealer, the next step will be marketing. Marketing will be the responsibility of all individuals. They can easily participate in it and ensure that there are no monopolistic practices in the market.
6. The benefits that have been gained from the whole market can be divided equally over the whole individuals.

7. All people can participate in marketing the commodities of their consumption in the first degree. The people's participation in all related processes can convert one's role to another very smoothly between production, marketing, and consumption.
8. We may acquire the gained profits, that is still ensured, and available these profits to all. The fairtrade market does not define the monopoly of production, marketing, and the fairtrade market to follow a single definition.
9. We must teach people commerce through their different phases of education. Other financial crises and pandemics have shown the need for producers to act legally, ethically, and responsibly to execute their duties. By this, the individuals must manage all commercial processes from production, pricing, marketing, etc., the producer must subdivide the production facilities too. Ensure that all practices are kept away from any monopolistic aspects by activating the participation of proactive individuals.
10. The game's rules give producers and consumers these rights, with a high degree of transparency, accordance, and clear vision of targeted markets and dividing the centralization of production to benefit the consumers and encourage these partnerships. This partnership is what we prospected from the intermediate dealers to do.
11. The failure of intermediate dealers in collaboration with both parties of the production and consumption, and removing them away from the missions of marketing, contrary to involving them, caused them to compete with the producers and consumers and follow the imposing price policy. This failure could lead to the destruction of the consumer base, as most consumers eventually deplete their wealth.
12. On the contrary, we attain a reduction in the number of marketing individuals who can participate meaningfully in trade. These commercial practices reduce the number of persons who can buy products from intermediate dealers. As a result, the intermediate dealers are cornering the market after having gained exclusive market control. This behavior is destructive not only to consumers but also in the long term to intermediate dealers themselves (it mirrors this fact not only in artificial simulation games but also in real-world trade and commerce).
13. The present invention game tries to reconstruct the fairtrade market by ruling it and supplying it with new prospects. These rules and regulations will govern the game transactions when they are spread among all market players. We then verify the mutual sharing of profits, organizing, and distributing of benefits among market parties.
14. We can generate an ideal model by applying the acquisition forms obtained from the game. In a more optimistic scenario, socially survive in the long term (leading to a consumer base's survival, which could otherwise acquire products from the markets). All games and real-world commerce participants must cooperate in the market (real or artificial) to survive the consumers themselves and survive the market system.

Specific Problems with Background Art Including:

1. In this board game, we have realized that the game is exclusively based on maximizing the benefits to both producer and consumer.
2. Several survival effects occur for both parties when the first party owns the production facility that needs continuous development. The second party owns the market and pays the price of the commodity in full. So, both parties reserve the most benefits from different aspects.

3. The game is a running example of a new perspective for an economic theory based on the fairtrade market, not on the free market as it does, sharing gains among end consumers and producers from one side and all interim dealers on the other side.
4. The markets have a considerable amount of opportunities to cover all participants as market players. Ensuring everybody's benefits based on the size of their contribution and sometimes consumers can convert into a trader or producer and vice versa, the producers do not monopolize the market.
5. Community individuals' participation ensures the balance among producers, manufacturers, service providers, traders, and consumers. This contribution can generate a social survival of individuals' cooperation and grant many opportunities to individuals.

BRIEF SUMMARY OF THE INVENTION

Technical Problem

1. This game prevents market discrimination or polarization toward one party, whether this party is domestic or international.
2. The game represents a trial test of its constituents related to the fairtrade market rules and regulations.

Technical Solution

1. This game is primarily for fun and entertainment.
2. We are introducing new embodiments of the distribution of profits between the sale parties. These embodiments would add to the sale parties' eligibility to get benefits of the sale, which differs from what is followed in the current free market? So, from here, the terminology of the game fairtrade (unfree) market is revealed.
3. This game measures players' abilities to accept these embodiments, practices, and rights embedded into the game and shows how much the satisfaction of players or sale parties to these embodiments. The game resorts these rights to the sale parties the rights and benefits they deserve.
4. The sale parties are covered and satisfied sale parties with these rights and can exercise them in the real market, which will turn this free market into a fairtrade market.
5. This game can show the effectiveness and validity of these embodiments from practical aspects.
6. The game is exploring the extent to which players who represent actual sales parties are accepting these embodiments.

Advantageous Effects

1. This game has transformed gameplay from being heavily dependent on randomly generated numbers by the dice to be smarter by introducing more strategic selective options among the various available options that determine a player's next steps. The bias resulting from better planning, smart use of tools, and access to success based on these smart options and smart use tools define strategic planning success.
2. The game is analogous to the fairtrade reality between people and encourages market players to do the same lucrative practices on the actual market.
3. The game gives each player the advantage of choosing between multiple opportunities and multiple fair chances of acquiring benefits. Market benefits are tremendous enough to cover all participants in each phase of the trade process. Everybody can help themselves and simultaneously help others, especially those who are close to them.
4. Encouraging benefits gained will be inspired by individuals of all ages, with all situations emphasizing that many chances are available everywhere, where the consumer exists.
5. We are generating recognition, among players, about the new market rules and the fairness of these rules.
6. Eventually, market players' satisfaction with these rules is essential, as a mandatory regulator of the modern fairtrade market.
7. The game is generating an optimistic feeling in all players participating in the market.
8. The game's rules verify benefits to all participants. The results of profits that the players will gain will reflect the fairness of the market's rules.
9. The players' positive emotions encourage everyone to learn these rules in their lives, giving serious consideration to whether these new rules are fair and help support the market with competitors, individuals and the community.
10. The game gives its players equal chances and offers opportunities to select from the options that can identify their orientations, so helping them fast.

BRIEF DESCRIPTION OF DRAWINGS

FIGS. 001 through 050: Show Fifty Cards of the State's Information in Phase 1.

FIGS. 051 through 100: Show Fifty Cards of the Production's Rules in Phase 2.

FIGS. 101 through 150: Show Fifty Cards of the Manufacturing's Rules in Phase 3.

FIGS. 151 through 200: Show Fifty Cards of the Service's Rules in Phase 4.

FIGS. 201 through 250: Show Fifty Cards of the Purchase/Sale's Trading Rules in Phase 5.

FIGS. 251 through 300: Show Fifty Backside Views of the State Cards in Phase 1.

FIGS. 301 through 350: Show Fifty Backside Views of the Production Cards in Phase 2.

FIGS. 351 through 400: Show Fifty Backside Views of the Manufacturing Cards in Phase 3.

FIGS. 401 through 450: Show Fifty Backside Views of the Service Rules Cards from Phase 4.

FIGS. 451 through 500: Show Fifty Backside Views of the Purchase/Sale Cards in Phase 5.

FIGS. 501 through 514: Show the Details of the Market Condition Cards.

FIG. 515: Discloses a View of the Preferred Mode of Invention in a General Form FIG. 515A: Shows Game Board with Spaces for State Cards Deck.

FIG. 515B: Shows a Game Board with Spaces for Production Cards Deck.

FIG. 515C: Shows a Game Board with Spaces for Manufacturing Cards Deck.

FIG. 515D: Shows a Game Board with Spaces for Services Cards Deck.

FIG. 515E: Shows the Game Board with Spaces for Purchase/Sale Trading Cards Deck.

FIG. 515F: Shows the Game Board with Spaces for Market Conditions Cards.

FIG. 515G: Shows a Game Board with Spaces for Coin Chips Deck.

FIG. 516: Disclose a View of the Customized Dice Details.

FIG. 517: Discloses a view of the Formal Game Board Details.

BRIEF DESCRIPTION OF THE INVENTION

Figure 378:
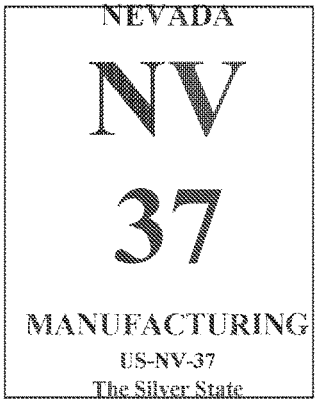

1. We can use this game as a fun-filled, entertaining game for family and friends. Another aim is to integrate the constituents of the game's rules, regulations, and embodiments to facilitate real market life and develop its nature to benefit from the game to the real market by practicing the game and enhancing its rules.
2. This game creates self-convictions and self-learning situations to accept and interact with the game's practices, mainly when over one player participates in the game's commercial practices. We will find some players who prefer to practice the current participants in free-market reality. We will see the emergence of new convictions because of the interaction between the beliefs in different practices.
3. Market rules appear to be a fair aspect of business practitioners when market players exchange their economic roles during the play.
4. The educational and moral outcome is that the reasons for happiness, empowerment, fulfillment, integrity, and conscientiousness are attained.
5. The game seeks to establish economic rules that govern financial performance and avoid cornering practices in the market. The game increases the causes of cooperation, interdependence and encourages a model of self-learning and endearment in mutual benefit.
6. The game stimulates the complementarity between members of society, enhances individuals' effectiveness, and the health effects of the economy in the beloved community.
7. The game increases beneficial transactions between society members and reinforces habits that would help through daily traditions and rituals. The game enhances healthy initiatives of individuals and self-disciplines, leading to the world's happiness.
8. The game's other goal is to relieve pressure on the government by creating a balance mechanism in markets.
9. The game is raising in this mechanism the rights of individuals in the commodity's sales history and enabling them to become successful societal tools. It creates a fairtrade market for producers, increases partnership between them, and helps develop individuals' performance to become traders, producers, and the markets' movers.
10. The game generates players' satisfaction with the opportunity to learn through practices, accept new rules, and thus satisfy those rights from distributing wealth and profits between parties involved in the sale.
11. The game broadens the participation of consumers, which represents the heart of the market for producers. The game players will not become a deaf base exhausted by every active market maker and impose its rules on consumers' broad base. The market maker takes advantage of that because this is the consumer's unilateral consumer isolation and weakness.
12. We notice all the unbalanced mechanisms in the market through shrinking salaries, pensions, increasing community support packages, insurance, and community care provided by the government and civil society organizations, rising in demand to the point where it cannot meet everyone's needs.
13. Deficiency in community support generates an explosion, especially in crises, pandemics, and unexpected natural disasters. Side effects resulting from the unbalanced domestic level mechanisms can extend to affect some international agreements or treaties between governments.
14. Suppose that deteriorated practices have been rampant and not controlled. In that case, these market practices will generate in society through individuals, a state of lack of self-reliance, shortness, the limited financial security of individuals, weak or evaporate savings, and a lack of ambition.
15. Lack of motivation and creation of emotional changes, love of self, selfishness, superficiality, and brazen reference practices lead, in their entirety, to darken the thinking and blur the image, the lack of ambition, morals, and finally, failure and selfishness. Society members are viewed as losers and winners, not winners and winners, or are losing practices for everyone, which will be unlawful or amoral. Loss of morality and reference practices are losing the individual straightness and integrity and may lead them to death in prison and crime.
16. Quite the opposite is what we hope of exercises in this game of learning principles of mutual wealth and interdependence through societal economics. These principles increase the individual's activity and effectiveness of mobilizing energies and capabilities of prosperity and development among society members.
17. Serving society and meeting their needs would be reflected through the individuals' contribution to developing partnerships with intermediate dealers and producers. These partnerships can generate benefits to all participants by applying the rules, embodiments, and mechanisms of the game that stimulate and reinforce the spread of opportunities among players.
18. The mixture of random and optional in the game is one of the essential components of the present invention. Everyone feels that an abundance of opportunities is available to everyone and provide them with wealth. We are securing stable periodic gains and income.
19. Recurrent consequences by nature tell that nothing invisible in any country's economy makes it inapparent. But it is mandatory sharing balanced mechanisms by entire people locally and internationally in the fairtrade market and cornered by some in the free market does not account for most clients' biased market.
20. It is not the genius of the biased market's players that leads some to be wealthy, but injustice in the distribution of wealth, the inaction of some in seizing opportunities. The right is reaping income periodically.
21. Pricing mechanisms have been incorporated into the game by distributing profits between parties of sale and government. These mechanisms are accompanied by trade transactions and affected by four coefficients imposed by the state's market realities, one per every phase. The efficacy of applying these four coefficients in the game is evidenced by facilitating functions offered to practitioners for sale, integration between these gains, profits until the end consumer, and government.
22. The game's embodiments also include cognitive, educational, and knowledge tools about American states, opportunities, and success experiences. They show that fundamental elements of progress can be multiplied, copied, and regenerated in all states, not limited to one state, but all other states could enjoy it.

23. Other embodiments may be used, and structural changes may be made without deviating from the invention's scope.
24. Blessing income increased business, and happiness conditions associated with integrity and cooperation in serving others and feeling happy and prosperous generate momentum through community characters' participation to represent their emotional status.
25. Players can extract information after the completion of the game round. It is expected that each player will answer the skill questions posed by other players from the reality of state cards to contribute to the strengthening of information learned from the game.

DETAILED DESCRIPTION OF THE INVENTION

Definitions and Terms

The following description should not limit the invention, but instead should be defined in the body of specification that relates to the preferred mode of the invention. Accordingly, features recited in the body should not be construed as essential features of the invention unless explicitly indicated. Further, any reference in the body to the expression "invention" should only be construed to imply a recommendation to the preferred embodiments.

1. FIG. 515 discloses the preferred mode of the invention, as depicted by the game.
2. The game presented with the current invention consists of a game board, game cards, coin chips, customized dice (dodecahedron pentagonal prism), and rules.
3. From the previous embodiments, we can divide the game cards into five different types of cards: state cards, production cards, manufacturer cards, services cards, and purchase/sale trading cards. Additionally, the relation between them, all these cards are playing one after the other, all belong to the same commodity of the same state.
4. We have shown a full description and details of the game cards from the attached sheets and figures.
5. The present game provides a simple explanation of tournament steps and interrelation. The five-card set in the previous order represents five trade phases stacked in one state spot. In this case, the player can get back all the money paid with the profit or keep it all and continue to gain other states' commodity stacks.
6. In the following subsections, the reader will find in the first subsection how this game works as conceptional postulates prepare for the theory hypotheses. The second subsection describes the game's embodiments to execute the game mission, a simple explanation reciting the games' embodiments. The third subsection cares about how the tournament takes place.

How does this Invention Work?

1. The unit price value of any commodity is unified, equal to one dollar.
2. The sale process includes four phases. The first is the production of any natural or raw products. The second is the manufacturing by using the conversion industry to convert any product into another more beneficial product with the aid of talent, creativity, and technology. The third phase is the services. It means any added service to facilitate the sale like shipping, packaging, logistics, etc. The fourth phase concerns the trading of final products to the consumer directly or indirectly.
3. The profits in each phase depend on two sources. The first source is the phase profit, which is determined for the seller over the phase commodity's total quantity cost. The second source is the state phase coefficient, which grants the seller a percentage determined by the state's price. These profits are shared between the seller and buyer; both are also shared in state tax as a burden.
4. The lowest default selling profit is 2.5% in all phases after the production phase. The dealers can change their profits to zero or negative percentages as a commercial promotion. When calculating the price increase for a profit at each sequential phase, the growth should not exceed 25%, Without considering the additional phase increment due to the state phase coefficient. When considering all the price increments, that does not prevent the price from falling to less if the commodity was offered at a promotional price lower than the original price with different discount rates according to the seller's desire. The seller can decrease the product price by lowering his profit percentage but maintain the buyer's profit percentage steady without change because the buyer discount percentage equivalent to the buyer profits represents the buyer right in the current and preceding sales.
5. The prescribed percentages for the seller and buyer, as a profit, equal twice the state purpose phase tax (SPPT). Both pay the tax expenses, which equals one the SPPT. The state purpose phase price (SPPP) will then equal twenty times the SPPT. The buyer and the seller equally get twice the SPPT (10% of the SPPP), and the state tax earns once the SPPT (5% of the SPPP).
6. In any phase of the sale process, whatever the dealer is, if the buyer purchases a product from the producer, the buyer will get a lump sum 10% discount on the commodity price, as a discount from the (SPPP) limit, including the added price increment due to the state phase coefficient.
7. Thus, when the first buyer offers the bought item for sale to the next buyer, its price will still be the same. If the first buyer put up the product for sale in the next phase, now he became a dealer, the dealer price includes his profits due to the added phase advantage and the state phase coefficient's price increment.
8. In each phase, the seller is responsible for cutting state tax from the buyer and repaying it to the state Governor who has the state privilege.
9. The advertised shown price of a commodity shall always be offered to the buyer. The buyer's payment price is the price provided after a 10% discount, representing the buyer's right to profit due to the first phase purchase. In this case, the seller is considered to have bought the commodity for the end-user buyer by proxy. In other words, the 10% price for the source producer is temporarily transferred to the first buyer. Then it is inclusively transferred to the second buyer if the first buyer has become an intermediate dealer. This inclusive transfer includes the previous phase profits. The first buyer only benefits to the extent of its rate in the added services tariff, and the state phase coefficient.
10. As the buyer has the right to return his profits from the preceding phase, the declared price of a commodity represents the state issuing price from the origin. The price paid describes what the price became as a result after successive sale service tariffs have been accumulated from the current and previous phase paid taxes.

11. The arithmetic relationship between the phases' prices can always be approximated according to the level of the phases of a sale. After completing a purchase from the production phase, the promotional price becomes the offered price of the product grows to one and half times (1.5) the SIP, two times (2.0) the SIP in the manufacturing phase, three times (3.0) the SIP in the services phase, four times (4.0) the SIP in the purchase/sale trading phase, representing the price paid for selling, and during which a value-added tax is collected.
12. Engagement of payments with the state in all sale-phases prevents commodity overpricing. Also, if the seller wants to exceed the price limit in one phase, as it requires from him to share with the state half the increment in the price for any more price increment higher than the price limit, which has been set for the phase, the price cannot be undone.
13. The sellers will be careful not to exaggerate the margin price, as the commodities may sell and freeze their money capitals' movement. The price limit will force them to sell at a price less than the taxed price.
14. Hence, it is clear to us that the updated price needs to be a mandatory issue; it must be imposed immediately (i.e., the tax upon the issuing), the advantage of having updated higher prices for the buyer benefits.
15. The state issuing tax (SIT) limit of the producer will always represent the root price. While the taxed price is the last price after adding the several phases profits, from which the price paid is derived from the paid tax. The price paid is resulting after deducting the buyer's shared profits from all the previous sale phases.
16. The proposed higher profit percentage in every phase will not exceed 25%. If a lower percentage is used in one phase to decrease the seller profit, the buyer profits and state tax percentages will stay steady in the four phases without any change. The seller percentage in any phase may change only as of the sale desires. The end consumer's final price is limited to four times the price limit at products the first issue, including all terminal profits and taxes.

What are the Embodiments of the Invention?

Figure 516A:
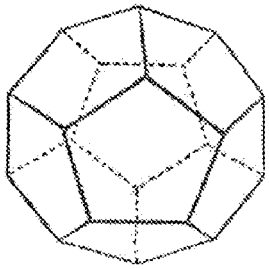
FIGS. 516A & 516B: Show the Views of the Dodecahedron Prism Dice.
Figure 516C:
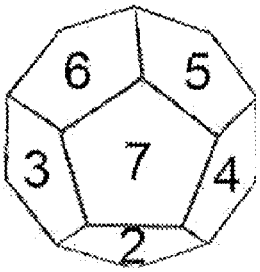
FIGS. 516C & 516D: Show the Views of the Numbered Dice.
Figure 516E:
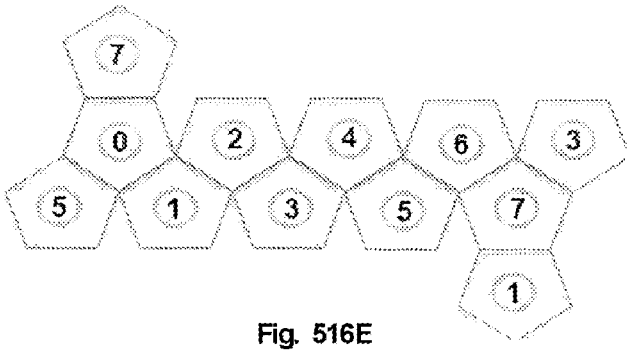
FIGS. 516E & 516F: Disclose the Difference Between two Numbered Dices.
Figure 516B:
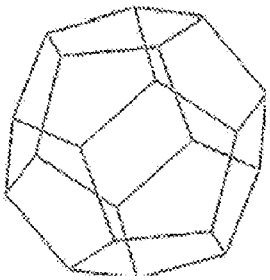
Figure 516D:
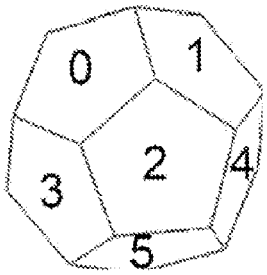
Figure 516F:
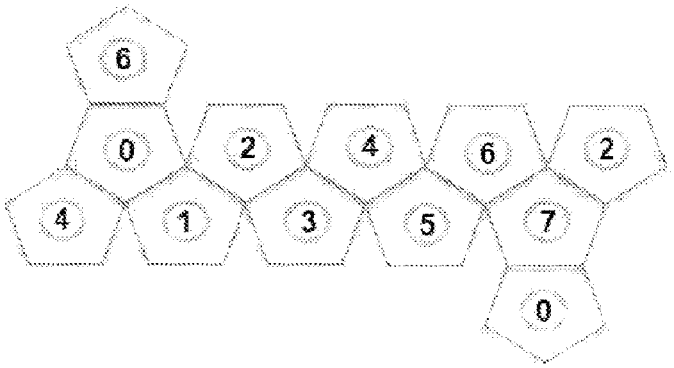

1. GAME CARDS: In one embodiment, the game six types of game cards, every state having five cards set, must be stacked one over the other until complete with a specific order. The five purpose cards for one state may be dispersed among the players, resulting in competition between them and holding the interactive negotiation and bartering deals. The game has six different types of cards: state cards, production cards, manufacturing cards, services cards, purchase/sale cards, and market condition cards. In the following section, each type of card is explained in detail. The first card is devoted to the commodity's state, and the second card is dedicated to commodity production in the state. The standard point here is that the next sale steps are complementary. Every step affects the next steps and gradually limits the following options. The third card is dedicated to commodity manufacturing, the fourth card is dedicated to commodity services, and the fifth card is dedicated to commodity purchase or sale in the state. Every card is associated with a coin chip, so we have two-hundred-fifty-coin chips.
2. COIN CHIPS (MOCKY MONEY): In one embodiment, the game does not need extra game funds to meet all game liabilities. The coin chips are divided into five categories. The first coin category has the state's name and gives its holder the privilege of collecting state taxes and bears the state code and commodity code. The following four coins are designated for each of the sale's four operations (purposes' phases), and each purpose phase is assigned a custom color. Barter's processes can facilitate clearing operations between players. Every purpose phase has a coin placed on the state's spot on the board. The coins are classified on their respective racks and are organized on the sides of the game. The state governor holds the state card, and he will get taxes for the sale and purchase commodities belonging to his state. The state's Governor can get money by collecting state taxes from the players for every transaction in the state. Also, he gets taxes from any transaction. It takes place among the players even without the state's Governor involvement in the transaction. Such state tax income to the Governor represents an option of the community reimbursement. The state governor receives money in exchange for the privilege assignment. The state governor Could also gain a lower price if he wishes to obtain his state commodity after-tax deduction. As a result, the state's privileged owner will pay less to others and hold his benefits thereof. The details of the coin chips are shown in FIG. 515G.
3. GAME BOARD (1): In one embodiment, the game has one centerboard and 2 to 5 player spaces. The players engage in the game for approximately an hour without necessarily requiring electronic equipment and or the early retirement of some players due to lack of game funds or other strategic or physical reasons. However, the game can be played without using electronics. Game board containing the positions of states in the form of circular rings. The circular ring containing the state alphabetic code, and the commodity numerical code was written over the state ring. The player puts five coins, beginning with the first state's coin, which is associated with the state card. The details of the game board are shown in FIG. 515.
4. GAME BOARD (2): In one embodiment, the game has multiple starting points, where each player can start from any state. There is no starting point or track to follow. The game board has a five-sided pentagonal shape with a middle area to throw the dice. It's divided into five triangles; each base of the triangle is one side of the pentagonal shape. Ten circles are placed around either side of each triangle base (upper and lower the base) so that the total number of states around the five-bases of the pentagonal shape gets fifty states. Inside each circle shall be the letters code and the integers code referring to the state name and the state's commodity code, such as US-CA-00. This latest numerical code represents the iconic commodity code for the state. The details of the game board are shown in FIG. 515.
5. PAIR OF DICE: The dice pair are thrown every time the player wants to specify a state. Every dice is composed of a customized dodecahedron prism of pentagonal faces, and every face contains an integer number from zero up to seven. We can also assign a color for every number to begin from zero, given to red color to six appointed to violet color, and number seven is given to back color. The details of the customized dodecahedron pentagonal dice are shown in FIGS. 516(A, B, C, D, E, F).
   a. Each dice shall have eight numbers. The method is used to assign the selected state from the two thrown dice. There are eight numbers to indicate the number of commodity classifications, and each face carries a number from zero to seven.
   b. The dice are labeled with the eight numbers. To distribute these eight integer numbers, let's first see how we label the dice faces. We take eight pentagonal faces and label them with integers from zero to seven. Then there will remain four faces from the dodecahedron pentagonal prism; these four faces will take the even numbers from zero to seven, i.e., getting 0, 2, 4, and 6. Every number will be associated with one color in addition to the black.

c. In the second dice, we label eight faces with a number from zero to seven, then the remaining four faces as we tag them with the odd numbers (1, 3, 5, and 7) for the set from zero to seven.

d. The player throws the dice pair and reads the numbers the dice carry on the upper surfaces. The player now has two options to play once you can read it from low to high numbers or vice versa. That will depend on player selection. The complete assignments from dice pair readings will give the sixty-four options (8×8=64), remove from them the eight (8) numbers with equal repeated two integers like 00; 11; 22; 33; 44; 55; 66; 77), this set of numbers constitute a group called market regulations cards. The remaining number of options after the subtraction will equal fifty-six (56). We also assigned the two integers numbers higher than 70, like (71, 72, 73, 74, 75, 76) to constitute another six (6) members group called the market rules cards. Both market regulation cards and market rules cards constitute the market conditions group. After subtracting both market groups mentioned above, the total remaining state label codes shall be fifty (50). These codes are labeled on state cards corresponding to the fifty states. Each state is associated with one commodity and has five-purposes (phases) cards. As mentioned earlier (★♥♣♠♦), every purpose takes one symbol of the previous symbols. All the fifty commodities, every one commodity has four purposes and will sum up the number of all-purpose cards equal (5×50) multiplied up to 250 cards. Another fourteen cards were assigned for the market conditions. The total number of game cards will be 264.

6. STATE CARDS: Plurality of state cards are present in the game, and these cards are fifty cards. State cards are used to give information about one state of the United States of America. To play a state card, the player must throw the dice pair and grab the selected state card. Then the player will get the state privilege, and he will be the Governor for this state. He can collect taxes for any transaction carried out on the state land. Each state has a card containing data on the state capital, largest city, total area (TA)/rank, population (P)/rank, mean household income (MHI)/rank, gross domestic production (GDP)/rank, altitude, the state's iconic commodity, universal time zone, average climate temperature, most significant companies, and iconic state landmarks. Details of each state card can be found in FIGS. 001 through 050 for the frontside views, and the FIGS. 251 through 300 for the backside views.

7. PRODUCTION CARDS: Plurality of production cards are present in the game corresponding to each state's production power. These cards are played to offer the other players the state capability of production for a commodity. The production card gives information about: the state commodity code (SCC), the state's production coefficient (SPC), the state's production efficiency (SPE), state required quantity (SRQ), state issuing tax (SIT), state issuing price (SIP), state production tax (SPT), state production price (SPP), state producer quantity profit (SPQPr), state buyer quantity profit (SBQPr), state production quantity tax (SPQT) paid by the sale parties, and the commodity total quantity cost (TQC). Details of each production card can be found in FIGS. 051 through 100 for the frontside views, and the FIGS. 301 through 350 for the backside views.

Figure 379:
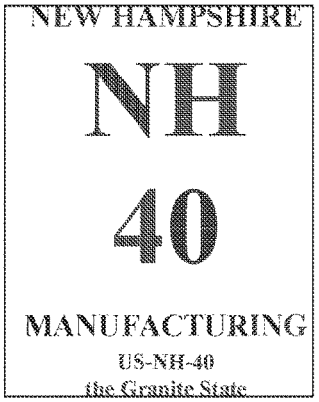
Figure 380:
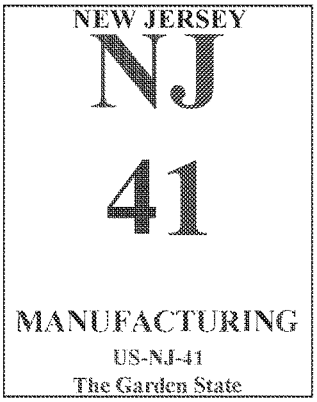
Figure 381:
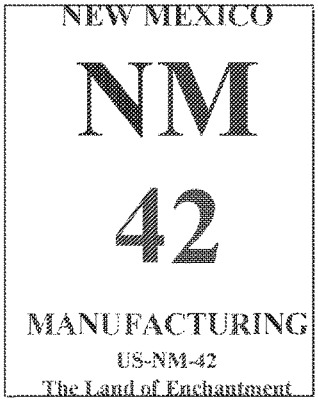
Figure 382:
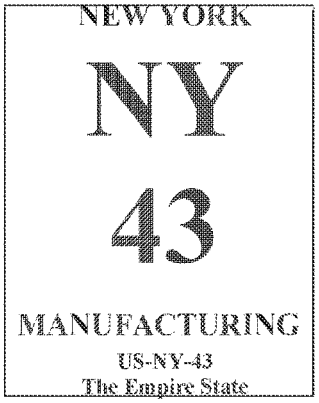
Figure 383:
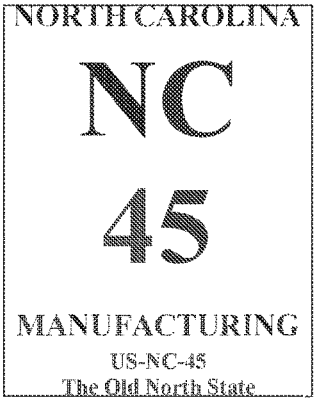
Figure 384:
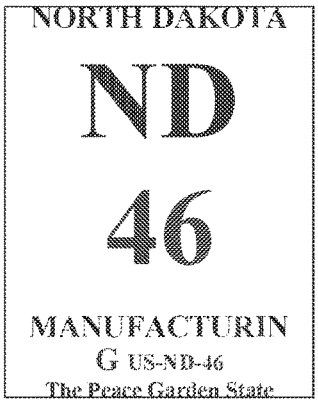
Figure 385:
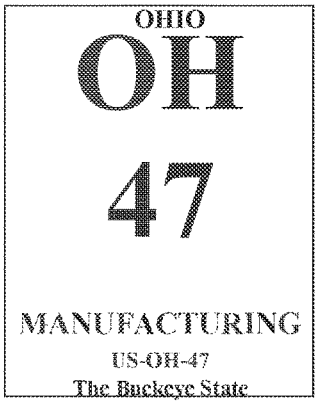
Figure 386:
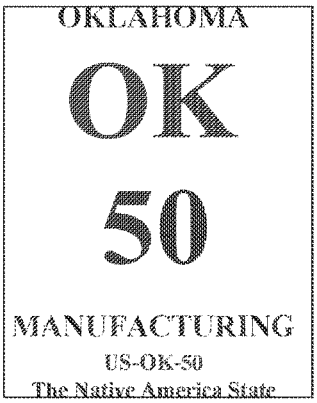
Figure 387:
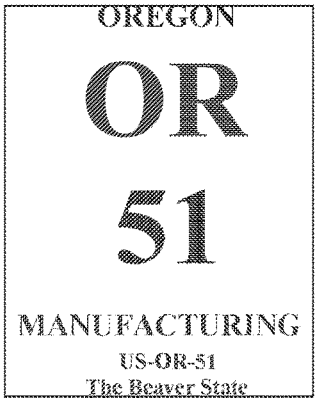
Figure 388:
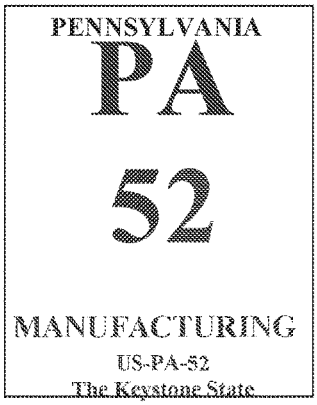
Figure 389:
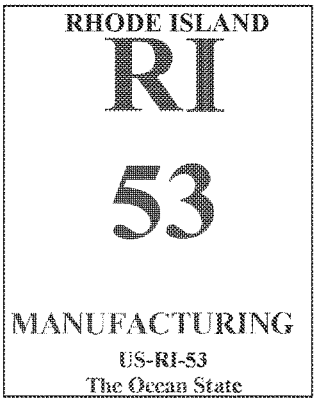
Figure 390:
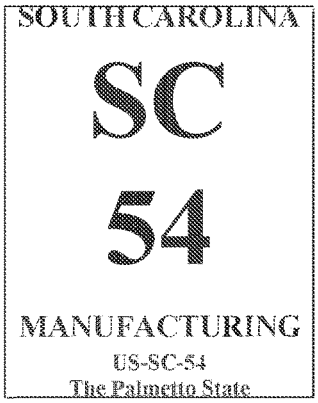
Figure 391:
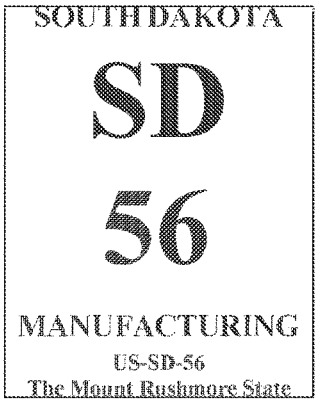
Figure 392:
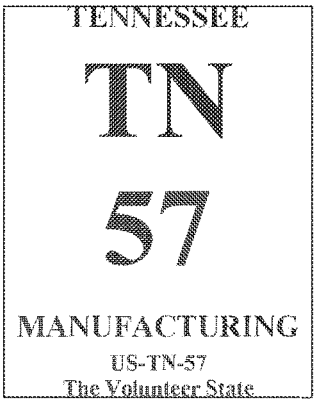
Figure 393:
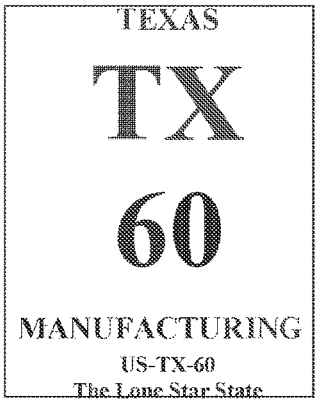
Figure 394:
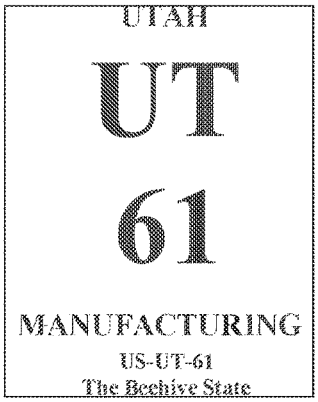
Figure 395:
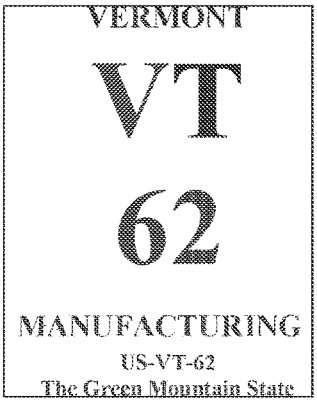

8. MANUFACTURING CARDS: Plurality of manufacturing cards are present in the game. These cards provide the needed information about the state capability in conversion industries for the nominated commodity. However, the manufacturing card is randomly drawn through the game with dice thrown on the board's center area. The manufacturing card includes information about: the state commodity code (SCC), the state's manufacturing coefficient (SMC), the state's manufacturing efficiency (SME), state required quantity (SRQ), state manufacturing tax (SMT), state manufacturing price (SMP), state manufacturer quantity profit (SMQPr), state buyer quantity profit (SBQPr), state manufacturing quantity tax (SMQT) paid by the sale parties, and the commodity total quantity cost (TQC). Details of each manufacturing card can be found in FIGS. 101 through 150 for the frontside views, and the FIGS. 351 through 400 for the backside views.

9. SERVICES CARDS: Plurality of service cards is present in the game corresponding to each state's service, and these cards are played to offer the other players the state capability of services for a particular commodity, and the service card gives information about: the state commodity code (SCC), the state's services coefficient (SSC), the state's services efficiency (SSE), state required quantity (SRQ), state services tax (SST), state services price (SSP), state services-provider quantity profit (SSQPr), state buyer quantity profit (SBQPr), state services quantity tax (SSQT) paid by the sale parties, and the commodity services total quantity cost. Details of each service card can be found in FIGS. 151 through 200 for the frontside views, and the FIGS. 401 through 450 for the backside views.

10. PURCHASE/SALE TRADING CARDS: Plurality of purchase/sale trading cards are present in the game corresponding to each state's purchase/sale. These cards are played to offer the other players the state capability of trading for a commodity. The purchase/sale trading card gives information about: the state commodity code (SCC), the state's trading coefficient (STC), the state's trading efficiency (STE), state required quantity (SRQ), state trading tax (STT), state trading price (STP), state trader quantity profit (STQPr), state buyer quantity profit (SBQPr), state trading quantity tax (STQT) paid by the sale parties, and the commodity total quantity cost (TQC). Details of each purchase/sale trading card can be found in FIGS. 201 through 250 for the frontside views, and the FIGS. 451 through 500 for the backside views.

11. PILE OF FIVE STACKED CONS & CARDS: So far, each state has a set of five coins stacked over the state's spot on the game board in the order as follows: state card, production card, manufacturer card, services card, purchase/sale trading card. Every state has a unique commodity to trade. The player can arrange another set of five corresponding commodity cards in front of him if he can. Color group categories classify the commodities. Inside each group category, the commodities are classified in numbers from zero up to seven. So, we have seven color categories classified inside every color, we have eight products and take the integer from zero to seven. For example (R0, R1, R2, R3, R4, R5, R6, R7) "R" here refers to red color.

12. MARKET CONDITIONS CARDS: These cards specify additional functions, which are related to some customized action tools. The player can perform these action tools with the rest of the players' participation if they get the activation code for one of these tools after the dice rolling. Whereas, at any phase of the game, the player can stop playing and request to perform some operations after obtaining the appropriate operational code card for the transaction to be completed. The player can keep the activation code card and postpone that process for a suitable later time. The market conditions cards consist of the market regulations cards that include the eight cards of repeated two integers like 00; 11; 22; 33; 44; 55; 66; 77 and market rules cards that were assigned for the cards with two integers numbers higher than 70, that is (71, 72, 73, 74, 75, 76). The market regulation cards manage the actions as follows. The card-carrying code "00" is assigned for the purchase delegacy, the code "11" is given for the sale delegacy in the second phase. The card-carrying code "22" is designated for the purchase delegacy, and the code "33" is assigned for the sale delegacy in the third phase. The card-carrying code "44" is assigned for the purchase delegacy, and the code "55" is assigned for the sale delegacy in the fourth phase. The card-carrying code "66" is assigned for the purchase delegacy, and the code "77" is assigned for the sale delegacy in the fifth phase. Whereas, the market rule cards manage the actions as follows; the card-carrying code "71" is set for the bonus. The card-carrying code "72" is assigned for penalties, the code "73" is assigned for the state's privilege acquisition. The card-carrying code "74" is given for the state's privilege loss, the code "75" is assigned for bartering. The card-carrying code "76" is given for delegation. Details of each market condition card can be found in FIGS. 501 through 514.

13. Some of the strategic game embodiments include:
    a. The game is available for use by any person aged about eight years of age with primary language, literacy, and computational skills. The benefits can include social interaction opportunities, strategic planning, computation, comprehension of written material, attention to detail, and opportunities to understand some of the market's fairtrade concepts.
    b. In one embodiment, the game of the present invention comprises a five-card set for fifty states. Coin ships can be used to infer the state's performed and remaining purposes. Further, everyone's set of stacked cards piled for one state must include the sale process's five purposes. We are restricted now with one commodity for every state, but further cards for several commodities belonging to one state can be added.
    c. In one embodiment, the game can also be implemented using at least one of the following: (i) software, (ii) firmware, (iii) electronic apparatus, and by way of play by a distance playing in electronic forms of communication, including the internet connections.
    d. The player can exchange any sold commodity purpose card at any phase of the game's sale process by completing a game round or getting an action tool through the activation code.
    e. All state commodities plurality with five purposes phases could be managed and shared by all players representing (shareholder certificate) commodity cards.
    f. A player can trade a commodity purpose card in one trade phase by selling it to the state's holder.

Players can exchange the same commodity card again in another phase preceding or succeeding to the first one. In this case, instead of selling the commodity to the state's holder or another player, the player can sell it to the player holding the before or next purpose phase card of the state's commodity. According to the shared profits, the exchange process is managed for the sale price, as mentioned in the purpose card's transaction data.

How does the Tournament Take Place?

There are several play modes. The first is the long round mode, which is played with five players, and the short round mode, which is played with a few players less than five players, beginning with two players. The players in the elongated mode can follow different strategies than in the shortened round mode. Every player can grab the whole cards and coins belonging to one purpose in the long round mode. The first player, for example, keeps state cards and coins, and the second player keeps production cards and coins, the third player holds manufacturing cards and coins, the fourth player holds services cards and coins, and the fifth player keeps purchase/sale trading cards and coins. Then every player organizes his cards depending on the labeled commodity code. i.e., the cards can be classified into eight groups (00, 01, 02, 03, 04, 05, 06, and 07). Each group stacks seven cards and seven coins that have begun with the same commodity code and begin together. For example, in the group labeled zero-zero (00), there are seven cards (in front of him), and so on until we reach group code number begins with seven (70). The player can then grab any card and coin directly from the related group to the commodity code. In another strategy for the long round game mode, each player from the five players can grab all-purpose cards of ten commodity cards and coins, i.e., fifty cards and fifty coins. They can be arranged in two squares (5×5), every square has 25 cards, above every card the corresponding coin is placed. In this case, all the cards and coins may belong to one purpose. When the player needs a selected card and coin, he gets them from the player having them in his group. When the player finishes the play with the prior ten cards and coins, they can grab another ten commodity cards and coins, so on until all cards and coins finish. The short round mode of play is made for simplicity and reducing the round time. They can start playing with only five states; everyone is selecting a place by one edge from the pentagonal shaped board. Two players can begin the game in this case. The whole-purposes cards and coins of five states being in front of each player. In the short round mode, each player selects five state cards and five state coins. The cards will conform to about 25 cards and 25 coins. The player can organize the five state cards as follows. The player makes a square on each side composed of five cards, places the cards face down, atop each card the player puts the associated coin on the card. Then the play begins on the playing board and throws the dice. When the players finish the five cards, they can grab the next five cards, and so on.

1. SETTING UP THE GAME: For the sake of playing a short round game, every player takes the five purpose phase cards and coins associated with the states to appear in front of him. In this way, the player can easily pick up any card or coin needed by the player upon the turn. It places all coins beside each other, the cards place where their faces down because we label them from the back with its name, code, and purpose. All coins are placed over the corresponding cards.
2. PLAYING A TURN: Every player must throw the dice pair in the initial phase, where each upper face of the dice is labeled with a number starting from zero up to seven. Then the two numbers taken from the upper faces of the dice pair will be added together. The player with the highest sum will play the first. The other players will be the second, ordered the players descendingly. The round direction is defined depending on the order of getting the dice pair sum from the highest to lowest. Then, each state has a commodity associated with a commodity code. For each commodity next to the state card, there are five sale purposes associated with five-card phases. Each card contains sale data and executive instructions for sale. The five purpose phase cards will be used in a unified sequence order as follows: the first purpose phase card is for the state privilege, the second purpose phase card is for the producer, the third purpose phase card is for the manufacturer, the fourth purpose phase card is for services providers that support production with operations and marketing, and the fifth purpose phase card is for purchase/sale trading. The last phase step represents the consumption or for the needs of the end-user.

3. THROWING THE PAIR OF DICE: When the first player, who will start the game, is determined, he will throw the dice pair and get the two integer numbers. The player will read them from the dice pair's upper surfaces and get two reading options that depend on where he could read it from higher to lower or lower to higher order. The player decides either one or selects which state he will choose. It needs some strategic experience with state information and the available economic data of the selected state.
4. PLAYING STATE CARD: The state cards are marked with state code and commodity code through which the player selects from them. In this case, the player reads the two integers from the upper faces of both dice. If the two integers are the same, he will get an active tool of market regulation to implement first, if he wants or keeps it for later use because there is a market regulation action associated with equal integer's double digits. When the player gets two different numbers, for example (1 & 4), he has two options to play, so he selects one. He can play in the state labeled 14 or the side state tagged with 41 if the state's first phase step is completed. Every state is labeled with a number composed of two integers referring to the commodity state's code. So, these two integers will indicate the iconic product of the state. The player who gets the state card reads its data and information and places the state coin on its spot on the game board.
5. So, when the player gets the same state for the second time, the player must go to the next phase of the state in the same order. The player will draw for the next purpose phase card of the state card or begin drawing a new state card. Every player is looking and competing to draw the state card because he gets the state privilege and becomes the Governor. The state privilege enables the Governor to collect the state taxes, ensuring a stable income for every transaction will carry out on the state land, for state commodity. The first player begins to choose the state, reading the content of the state privilege card. At the same time, he will put the state's coin over the state spot on the game board.
6. PLAYING STATE COIN: At the state phase, the player keeps the state card in his hands. He will put the state's coin on the state spot on the playing board. This transaction is represented by adding the first coin of the five coins that must be stacked over the state spot on the game board.
   a. The next step is for the second player to play on the remaining comprehensive options to own another available state or get the second purpose in the pre-owned state. In that case, he will pay the tax to the state Governor. If any player wants to barter some commodity with other players immediately, he needs to get an activation card code. If the player wants to buy the Governor privilege, he needs to pay the Governor the privilege price. The next players will then continue playing on the remaining options.
   b. After the state phase, demand for the commodity rises, and purchase from the producer begins, and allows others to offer those commodities in the sale and offers continuously. Bartering can be done, especially under the enforcement of random activation tools, when the activation code card is raised through the game. Any player who has a current commodity purpose can sell it among the players as a commodity and get the seller's profit, as mentioned on the purpose phase card in his recorded balance. The buyer gets his profit as a discount or gains his record balance. Also, the seller pays tax to the state's Governor, added to the Governor recorded balance. The player can hold all the commodity cards until completing all the five stacked piles, and then players negotiate about in bilateral deals. The player who has completed the stacked coins on a state can regain the full money with profit and bonus or temporarily hold the states' card with him. The winner is the one who gets as much as possible money wealth over his competitor. The winner will bias most of the board's money toward himself
   c. Some players will try to survive from bankruptcy by obtaining money urgently, or the player can get additional money in the interim sale reap. For example, whenever the player completes a full sale of a commodity, he recovers the full payback with profits. The player will receive a reward equivalent (100%) of the commodity total quantity cost of the whole order quantity plus a bonus (10%) of the end-user buyer's benefit.
   d. The players compete to complete the sale cycle to get more money to the end-user buyer's full commodity total quantity cost than getting the seller's phase profit only. In addition to that, he gets the end buyer's bonus that equals (10%) extra, which includes profits from the previous sale purpose phases.
   e. Players try to acquire the following purpose for the state's commodity, and the state that the competing (rival) player seeks bargains purposes with them. Conversely, the player negotiates with other players about getting the concerned state's purpose, especially if he has an activation tool code.
   f. Exchange operations on purposes are limited to five necessary activities that are following the inclusive instruction rules for every commodity. These rules are applied through all the market conditions and the assumptions of the theory. We can symbolize the sale process as follows. The state privilege purpose (★) takes the symbol of the star, the production purpose takes the symbol of the heart (♥), the manufacturing purpose takes the Spade (♣), the purpose of the service takes the Club (♠), and the purchase and sale trading purpose will take the Diamond symbol (♦). These symbols (★, ♥, ♣, ♠, and ♦) will be ordered in the same arrangement.
   g. After completing the five stacked coins pile, the players start negotiations, and deals may be established between the players. Every time the players complete a game turnaround, they can temporarily stop the game for bartering with each other or when a player gets one activation tool code.
7. PLAYING PRODUCTION CARD: Players thrive to acquire rich empty available states first and become the Governor, receive the state privilege, collect the taxes for and sale transactions carried out for commodities corresponding to his states. Players compete to acquire the following purpose after the commodity's state production card. The rival player will seek the same production card of the same rich states. The next procedure will be to draw the manufacturing card by a player despite if the player is having or not the state privilege coin.

8. PLAYING PRODUCTION COIN: When the production card is drawn by one player, a production coin chip associated with this state's production card is dragged too and placed over the state coin in the state spot on the game board. Each player can recognize his respective state's production commodity coin by keeping the state card in his hands. Here, the same negotiation steps and deals may be established between the players as pre-described in playing the state card.
9. PLAYING MANUFACTURING CARD: Sometimes, if the player has the card and coin of production, he does not have the state card. As we said before, in any situation, the players can discuss inter-exchange the coins between each other and make deals about that.
10. PLAYING MANUFACTURING COIN: When the manufacturing card is drawn by one player, a manufacturing coin associated with this state manufacturing card is drawn too and placed over the state production coin. Each player can recognize his respective state's manufacturing commodity coin by keeping the state card in his hands. Here, the same negotiation steps and deals may be established between the players as pre-described in playing the state card.
11. PLAYING SERVICE CARD: The fourth phase card is the service card, it could add services to the commodity like the ease in logistics, or packaging, etc., all kinds of services that facilitate the sale process through the service phase.
12. PLAYING SERVICE COIN: When one player draws the service card, a service coin chip associated with this state service card is drawn and placed over the state manufacturing coin. Each player can recognize his respective state's service commodity coin by keeping the state card in his hands. Here, the same negotiation steps and deals may be established between the players as pre-described in playing the state card.
13. PLAYING PURCHASE/SALE TRADING CARD: The player sells the commodity he has acquired to the purchaser or another player. Each player has some coin that will try completing the five coins set to win the full cost as a record in his wealth. Nevertheless, the player can sell and buy individual coins for only the profits mentioned in the state's purchase/sale trading card are shared among sale partners as a phase profit. The seller collects the tax and pays the tax to the state Governor. If the buyer is himself the state Governor, the Governor can deduct the tax in his favor.
14. PLAYING PURCHASE/SALE TRADING COIN: When the purchase/sale card is drawn by one player, a purchase/sale trading coin associated with this state's purchase/sale trading card is drawn too and placed over the state's services coin. Each player can recognize his respective state's purchase/sale trading coin by keeping the state card in his hands. Here, the player follows the same negotiation steps, and deals may be established between the players as pre-described in playing the state card.
15. PLAYING MARKET REGULATIONS CARDS: The market regulations card set consists of eight cards, divided into four subsets according to the sale phases (production, manufacturing, services, and trading), with two cards in each phase subset, one for purchase delegacy action and the other for sale delegacy action. The codes (00 & 11) were used as activation codes for purchase and sale in the production phase, respectively. The codes (22 & 33) were used as an activation code for purchase and sale for the manufacturing phase. The codes (44 & 55) used as activation code for purchase and sale for the services phase, respectively. The codes (66 & 77) used as an activation code for purchase and sale for the p/s trading phase, respectively. Whoever the player obtains one of these tool codes enables him to implement immediately or postpone it, and in both cases, all the players are obligated to implement. If a player gets a second tool, he loses his right to the first. Likewise, no player may obtain two active tools of any kind at the same time. If any other player gets the tool in the first player's hands, the first player's right loses, and the right passes to the second player. The kinds of active tools belong to the activation code of market regulation cards. The following properties are managing the active tool code of the market regulations cards.
   a. The phase's action tool code can be used in the succeeding phases, and it is not permissible to use an action tool from the advanced phases in the preceding phases.
   b. Suppose two players receive the purchase delegacy code and sale delegacy code cards in the same phase for the same state for two different states. In that case, the right of execution is for the player who holds a state privilege if both acquired two-state privileges, the right of execution goes to the player whose state has a greater production total quantity cost value.
   c. If two players possess a purchase delegation code cards in different phases, the right of execution goes first to the player in the lower phase, and then the right goes to the next player.
   d. Purchase and sale are equivalent to sales operations. Selling does not take priority precedence over purchasing or vice versa.
16. PLAYING MARKET RULES CARDS: This set consists of six cards are called to execute an action tool when the activation code card is drawn, takes codes, and named as follows, the card with the activation code (71) used as a bonus action tool, the card with the activation code (72) used as a penalty action tool, the card with the activation code (73) used as an acquiring privilege action tool, the card with the activation code (74) used as a relinquishing privilege action tool, the card with the activation code (75) used as a bartering action tool, the card with the activation code (76) used as a delegation action tool. The following properties shall implement these active tool codes for market rules' cards.
   a. BONUS CARD:
      i. The bonus card enables the player to switch between states in different phases. If he has one purpose phase in a state, he can exchange it freely with another new purpose phase belonging to another state.
      ii. Players can play on both available states options that have been gotten after rolling the dice over, choosing one option between them, and if a single chance is performed, they may roll the dice again for an additional round.
      iii. The bonus card doubles the chances of playing for the rewarded bonus cardholder. A player should not have more than one bonus card at the same time.
      iv. The bonus card enables the player to roll the dice twice to double the playing chances.

b. PENALTY CARD:

i. If the player postpones the bonus card and gets a penalty card, his right to the bonus is forfeited.

ii. If the player has or receives a penalty card, he drops the right to use it, and he should return it to the regulation cards deck.

iii. If the player does not have any of the above cases, if the player gets a penalty card and the player does not have a bonus card as an active tool to deactivate the penalty card, he shall refrain from playing one round.

c. PRIVILEGE RELINQUISHMENT CARD:

i. We have learned from above that it is impossible to relinquish or acquire the right of the state privilege in a sale between players at a bartering stage after a completed round except in the case of one condition, which is the existence of at least one purpose coin is placed over the state coin. The assignment is made in exchange for the total quantity cost of the purpose commodity. The privilege relinquishment involuntarily implements without the above condition, if a player gets a privilege relinquishment card. In current cases, where a player has gotten a privilege relinquishment card, he can relinquish or acquire the state privilege, even if no purpose coin exists over the state privilege coin.

ii. Suppose the player obtains a privilege relinquishment card that has lost the privilege while possessing some state cards and coins. In that case, he shall be obligated to assign which state privilege from his states he will relinquish without charge (i. e., the exchange takes place for zero value of one state).

iii. Each player who holds the privilege relinquishment card or has the privilege acquisition card chooses both the state and the player subjected to the state's privilege transaction.

iv. The privilege acquisition tool card deactivates the privilege relinquishment tool card and acquires protection to one state, which the player holds if the player has the privilege acquisition card and keeps it for protection purposes.

d. PRIVILEGE ACQUISITION CARD:

i. The players involuntarily implement a privilege acquisition card if a player gets it. With the same procedures and conditions followed in the privilege relinquishment card action tool.

ii. Whoever obtains the privilege acquisition card can proceed with the acquisition of the state privilege. If the holder of the state accepts the offer, the acquisition process will be completed.

iii. One player's eligibility holds a previous bonus card or has not received a penalty card while playing to obtain the relinquished state. If these conditions do not exist, the eligibility goes to the player who gets a privilege acquisition card. In the absence of prior cases, the state offered to whoever accepts the state privilege acquisition. If two players compete to acquire the state, the first privilege owner chooses to whom will devolve the state privilege.

iv. The privilege acquisition execution will begin by taking the state privilege from the player who holds the previous penalty card or who did not receive a bonus card while prior playing.

e. BARTERING CARD:

i. If a player obtains a bartering card, he can negotiate and set off a bartering to acquire and seize the rest of the coins set within the state or between two states.

ii. The player and the bartering partners settle the differences clearance in profits with the other player who owns the exchange card, to perform a balanced bartering.

f. DELEGATION CARD:

i. The delegation card enables either the state governor or the owner of one state's purpose to carry out a closed delegation between them to let one partner acquire the whole state's purposes set or replace one of them in place of the other.

ii. After the delegation between the sale's two parties, one of them will be the whole seller, and the other will be the entire purchaser or vice versa.

iii. Suppose a player possesses all state commodity purpose's coins as a subset. He can delegate with the state Governor on state privilege transfer with this card.

iv. In the delegation about privilege transfer, the state privilege will go to the buyer, and the player becomes the buyer while the past Governor becomes the seller. It is well known that the end buyer profit will always be hugely higher than the seller profit.

17. END OF CARD DRAW: Each player keeps drawing purpose phase cards with its associated coins, placing the coin over the past stacked ones until completing the five stacking coins. In return, each player places five-coin chips atop each other in the state spot on the game board and keeps in his hands the associated purpose cards set of the states up to five cards.

18. INTERSTITIAL DEALS AND BARTERING: The privilege of relinquishment or acquisition may be granted to another player on the condition that there is at least one coin upon the state coin. Here, the state privilege price shall be set at the commodity's total quantity cost concerning the purpose phase card. From time to time, after completing a game round, the players will strive to barter with each other to collect the state's set of all purposes in the hand of one player, whatever he is. Each state holder shall strive to complete the five coins and cards set in his hands to become the buyer and obtain the state commodity's total quantity cost. Namely, in the conventional sale of a purpose phase coin, the transaction's exchange price is listed in the state's purpose phase card for the shared profits of the seller, buyer, and state tax. That means the player can get his profit for one transaction within one purpose, earn money quickly, without waiting to complete the stacking of all purpose's coins set. The marketing is done by selling or relinquishing a commodity's purpose phase privilege to another player according to the listed price in the profit field item to the concerning state's purpose phase card.

19. WINNING THE GAME: The game's winner is the one who gets the highest money record. Upon completing a pile of five stacked state coins and cards, the player receives the total quantity cost. The incomes for all players are recorded in one sheet. When a player is bartering with another player, they register the bartering results of settlement clearance in the form of an income record for everyone or one against the other. Players who do not have state privilege can trade commodity coins in different sales purposes phases. The player can choose between both strategies by calculating the settlement clearance and partners' profits. One strategy aims to trade part of the stack coins the player owns, or the second strategy strives to get all state's purpose phase privileges and reap a lot of money payback. The player can return the whole pile of completed cards and coins to the card and coin decks, get money, replace them with equivalent money credit records, and reward the additional 10% bonus. In this case, the game can reopen with a full option, and the difference is just a record for one player against the rest of the players. One player can hold a records' sheet for all players.

Rules and Concepts Used Thereof

As described earlier, the use is focused on training commodity trade and preparing consumers, future buyers, and end-users to the concepts concerning the fairtrade market theory, strategic market management. The profits gained from the fairtrade market will be beneficial to all sales parties. More details about this theory implementation are managed by the rules, regulations, and embodiments concerning below:

1. In the conventional free market, the buyer does not have the right to determine the price (first issue price limit, phase price limit, and end-user price). The buyer is following the market policy of the asking and bidding. The free market policy makes the prices dramatically change. On the contrary, the issue price limit in the fairtrade market prevents the price to substantially change after any trade transaction on the commodity, whether for purchase or sale, as the transaction's history was traced. The sale shall not be compulsory managed by one party, especially if a single sale party meets the market's conditions, imposes his price.
2. The 12-dodecahedron pentagonal prism model was used as a pair of dice. It's the best choice in terms of its application and the description we have come up with before.
3. If the purchase/sale trading card is finally placed, this means that the player can return the entire stacked pile cards set (the five cards). In the purchase/sale, if the player in a round acts as a seller, he gets the seller profit about ten percent 10% and transfers 05% to the state tax. But if the player in another round acts as a buyer, the player gets a transaction with the total quantity cost plus a bonus of 10%, i.e., he gets one hundred and ten 110% of the total quantity cost.
4. Some basic embodiments that belong to the sale process we want to emphasize throughout the game:
   a. Production phase: The issuing price limit is set at twenty times the state issue tax, includes the share of the end-customer profit, which equals twice the state issuing tax (SIT) (10%), the producer profit to be twice the SIT (10%), the state share in the sale equal once the SIT (05%), and lastly, the state issuing price SIP equal twenty times the SIT. It is assumed that these preceding shares were taken on the product's issuing price limit, which also includes the cost of various materials, production tools, and extra hidden costs. The whole production cost is seventy-five percent, 75% of the SIP limit. The production coefficient is related to the state production capability that enables the producer to raise the state production tax (SPT) where therein, over the SIT. The added state production coefficient (SPC) corresponding to current sales purpose shall convert the SIT into the SPT, and by consequences, shall convert the SIP into the state production price (SPP). The price increment due to the SPC is also shared among the three sale parties through the SPT. The profit share of the end-customer, which equals twice the state issuing tax (SPT) (10%), the producer profit to be twice the SPT (10%), the state share in the sale equal once the SPT (05%), and lastly, the SPP equal twenty times the SPT. It is assumed that the commodity's overall price at the end of the production phase does not exceed one and a half (1.5) times the SIP limit issued at the first production phase.
   b. Manufacturing phase: The minimum profit in the sales of manufacturing phase is 2.5%, and the maximum phase is 25% plus price increment due to the state manufacturing coefficient (SMC), which is related to the state manufacturing capability that enables the manufacturer to raise the price of the state's manufacturing where therein, which varies from state to state. The profits are taken from both as a percentage of the SPT feeding the manufacturing phase. After adding the manufacturing phase's profit and state manufacturing coefficient (SMC) profit percentages to the previous phase SPT limit, gives the state manufacturing tax (SMT) limit. The profits are shared among sale parties as to the buyer twice the SMT, seller twice the SMT, state tax one the SMT, and the state manufacturing price SMP equal twenty times the SMT. It is assumed that any product's overall price at the end-user or customer does not exceed twice the state issuing price limit at the production phase. The profits of sale parties as a percentage from the state manufacturing price limit, its profits shared as 10% for the buyer, 10% for the seller, 5% for state tax. It is assumed that the commodity's overall price at the end of the manufacturing phase does not exceed one and a half (2.0) times the SIP limit issued at the first production phase.
   c. Services phase: The minimum profit in the sales services phase is 2.5%, and the maximum phase is 25%. In addition to that, the state services coefficient (SSC), which is related to the state service capability, enables the service providers to raise the price of the state's services where therein, which varies from state to state. After adding the services phase's profit and the SSC profit percentages to the prior, the SMT limit gives the state services tax the SST limit. The profits are shared among sale parties as twice the SST to the buyer, twice the SST to the seller, state tax one the SST, and lastly, the state services price (SSP) equal twenty times the SST. It is assumed that the commodity's overall price at the end of the services phase does not exceed three times (3.0) the SIP limit issued at the first production phase.
   d. Purchase/sale trading phase: The minimum profit in the sales of trading phase is 2.5%, and the maximum phase is 25% plus price increment due to the state p/s trading coefficient (STC), which is related to the state trading capability that enables the trader to raise the state trading price (STP) where therein, which varies from state to state. After adding the trading phase's profit and the state trading coefficient's profit percentages to the prior state services tax SST limit gives the state p/s trading tax (STT) limit. The profits are shared among sale parties as to the buyer twice the STT, seller twice the STT, state tax one the STT, and the STP equal twenty times the STT. After completing the sale's five phases. It is assumed that the commodity's overall price at the end of the purchase/sale trading phase does not exceed four times (4.0) the SIP limit issued at the first production phase, which applies exclusively in most states. Otherwise, only in scarce exceptional cases where rational reasons are favored. The purchaser or the seller share equally the profits of the p/s trading phase. If the purchaser is the end-user customer of the commodity, he will receive a money return at the payment of the commodity's full price. In addition to that, the end-user customer owns the inherent right to restore the liberated buyer share when the first buyer purchased the commodity from the producer during the issuing phase. The state's trading coefficient, which expresses its commercial capability, varies from state to state. Otherwise, the end-user can get the end-user buyer's delayed rights in the first issuing purchase at this phase.

e. Governing base-rule: If the intermediate dealer achieves 25% as a phase profit, the state is entitled to a 05% tax in all phases' profits. The phase coefficient profits are also shared among the sales parties with the ratios as 40% for the seller, 40% for the buyer, and 20% for the state tax. Suppose the primary producer wants to increase the issuing price limit of a commodity. In that case, he must pay an extra state tax equal to half (50%) of the entered price increment, added over the issuing price limit. The issuing price limit represents the original equivalent price or acceptable fair price. Producers can also re-delegate the state that has issued the primary price limit about re-estimate the issuing price limits again for important reasons.

f. The mutual shared-rights for the producer, end-user consumers, and the state tax of the primary commodity in the sales are preserved when the end-user purchases the commodity. The three sale parties have the inherent right to know all information about the product's commoditerial history. The producer has the inherent right to know: the end-user consumers' geographical distribution, the commodity purchase rates by the end-users consumers, the time of sale, the intermediate periods for sale keeping, storage periods, the final price promoted to the consumers, and the consumer types. Any additional information that may help develop the product, provide it, and meet end-user consumer needs. In return, the end-user consumer has the inherent right to know: the commodity's production data, the storage periods, commodity origin, price at the origin-source (issuing price limit), occurred increments in the commodity price created by merchants and brokers, discounts were made on commodity, total tax payments. These discounts and rights were restored to the end-user buyer as a result of his commodity purchase. Likewise, the state's inherent right, the third selling partner subjected to collect the commodity tax, recognizes all the information about other sale parties, including commercial brokers. The inherent rights imply the phase tax limits, phase price limits, taxes accumulation, phase profits limits, and discounts, or increments in prices. All this information can be followed electronically on a unified system.

g. It is clear from this inherent right that subjecting commodity price controls to free-market mechanisms is non-intrinsic and non-authentic. Instead, in the fair-trade market mechanisms, the inherent right to predetermine the commodity's price is intrinsic and authentic.

h. The fairtrade market mechanisms are built on equality in mutual commercial transactions between domestic and global marketplaces and international agreements. The fairtrade market avoids the world's need for internal or external bilateral agreements and additional supporting mechanisms to bridge the gap and correct the shortage in the international commercial agreements' fairness.

i. Following free market mechanisms is a delinquent fraud against these inherent rights. It benefits those who are not originally market references. The free-market supporters are a group that accounts for the acquired rights in the market due to discriminatory practices, keeping their earnings steady, and their cash flows away from the deserved parties. This group seizes the whole market's benefits and actively influences the market deterioration. So, it has an unjustified impact on the marketplaces, marketplace parties, and associated countries. Countries and end-user consumers become dependent and weak in the face of acquisition policies. Acquisition policies necessarily do not reflect monopolistic policies in the sense of protection for competing parties. Rather than wasted market makers' rights, who are end-users' consumers themselves, and acquisition policies make the end-user consumers ineffective alongside another broad group of real producers.

5. The first issuing profit allocated to the end-user consumer is transmitted through the intermediate dealers due to the first production. The first issuing profit is repaid to the end-user consumer, eventually. Therefore, the intermediate dealers are entitled to profit in the services and tax burdens they provide to the commodity alone. The two primary sale parties are the original producer and the end-use consumer and have mutual equality in their profits.

6. The dice are made in a three-dimensional prism of twelve pentagonal faces (dodecahedron pentagonal prism). The prism faces are numbered from zero to seven. The player uses a pair of these dice every time he takes the turn. The two upper faces of the dice pair assign the state name and spot on the game board.

7. A symbol from one of the following logos (★♥♣ ♠ ♦) is assigned to every five trade purposes. The state privilege (★) takes the symbol of stars, the production takes the symbol of hearts (♥); the manufacturer considers the symbol of spades (♣), the service providers make the symbol of clubs (♠), and finally, the purchase/sale trading takes the symbol of diamonds (♦).

8. In the following table, the numbers from zero to seven are associated with the seven colors of the light spectrum in the next order: red, orange, yellow, green, blue, indigo, violet, and black, abbreviated as (R, O, Y, G, B, I, V, and W).

| | | | | | | | |
|---|---|---|---|---|---|---|---|
| R0 | O0 | Y0 | G0 | B0 | I0 | V0 | W0 |
| R1 | O1 | Y1 | G1 | B1 | I1 | V1 | W1 |
| R2 | O2 | Y2 | G2 | B2 | I2 | V2 | W2 |
| R3 | O3 | Y3 | G3 | B3 | I3 | V3 | W3 |
| R4 | O4 | Y4 | G4 | B4 | I4 | V4 | W4 |
| R5 | O5 | Y5 | G5 | B5 | I5 | V5 | W5 |
| R6 | O6 | Y6 | G6 | B6 | I6 | V6 | W6 |
| R7 | O7 | Y7 | G7 | B7 | I7 | V7 | W7 |

9. The Governor is the state privilege holder who collects the state taxes. The purchase/sale card's representation is the purchase process for the state privilege holder and the selling process for the others, and the purchase/sale cardholder is the purchaser who keeps the card. In that case, the players can exchange the different state's commodity purpose cards with each other; the same state's commodity purpose cards could be stacked in one five coins pile on the game board.

10. State card: One of the crucial points in the state card is the capital city, the total area (TA) and its rank, the population (P) and its rank, the average home income (AHI) and its rank, the gross domestic product (GDP) and its rank, the altitude above sea level, the annual average temperature range, the universal time zone, the most famous (iconic) commodities, the major corporations, and the state's landmarks.

11. The following table shows the labeled two-digit numbers for the fifty states after subtracting the red numbers. The total number of numbers labeled readings depending on permutations and combinations numbering equal sixty-four: 8×8=64⇒64−8=56⇒56−6=50 states. After subtracting the total number of fourteen activation codes, the remaining labeled state codes are fifty states.

| | | | | | | | |
|---|---|---|---|---|---|---|---|
| 00 | 01 | 02 | 03 | 04 | 05 | 06 | 07 |
| 10 | 11 | 12 | 13 | 14 | 15 | 16 | 17 |
| 20 | 21 | 22 | 23 | 24 | 25 | 26 | 27 |
| 30 | 31 | 32 | 33 | 34 | 35 | 36 | 37 |
| 40 | 41 | 42 | 43 | 44 | 45 | 46 | 47 |
| 50 | 51 | 52 | 53 | 54 | 55 | 56 | 57 |
| 60 | 61 | 62 | 63 | 64 | 65 | 66 | 67 |
| 70 | 71 | 72 | 73 | 74 | 75 | 76 | 77 |

12. The purpose of the phase means the sale operation used in commodity transactions through the five phases of the sale. For example, the purpose of the first phase is the state privilege acquiring, the purpose of the second phase is the production, the purpose of the third phase is the manufacturing, the purpose of the fourth phase is services, and the purpose of the fifth phase is the purchase/sale trading. The state card includes information about the capital, largest city, area/rank, population/rank, mean household income/rank, GDP/rank, altitude, the state's iconic commodity, universal time zone, average climate temperature, most significant companies, and iconic landmarks. The next four commodity purposes' cards include information like the quantity of commodity required, the purpose phase coefficient, the shared profits among purchaser, seller, state tax, and the commodity total quantity cost.

13. The player is applying the purpose card's instructions, especially sharing the phase profits among the players, and following the market's conditions from rules and regulations.

14. The table discloses the data and rules included in the production card.

| Production Card (Product Requirement) | |
|---|---|
| State Commodity Code (SCC) | US-CC-DD |
| State Production Coefficient (SPC) | (GDP/P) × 9.5e−6 |
| State Production Efficiency (SPE) | SPP × SPC |
| State Required Quantity (SRQ) | (Gross Domestic Production/Population) |
| State Issuing Price (SIP) (Default SIP Price US$1) | =20 × SIT × (PPC (0.75) + PPP (0.25)) Production Phase Cost (PPC) |
| State Production Tax (SPT) | SIT × (PPC + PPPr + SPC) |
| State Production Price (SPP) | 20 × SPT (≤1.5 × SIP) |
| State Production Tax (SPT) | 1.0 × SPT |
| State Producer Profit (SPPr) | 2.0 × SPT |
| State Buyer Profit (SBPr) | 2.0 × SPT |
| Total Quantity Cost (TQC) | SPP × SRQ |

15. The table discloses the data and rules included in the manufacturing card.

| Manufacturing Card | |
|---|---|
| State Commodity Code (SCC) | US-CC-DD |
| State Manufacturing Coefficient (SMC) | (P/GDP) × 4.3e−6 |
| State Manufacturing Efficiency (SME) | SMP × SMC |
| State Required Quantity (SRQ) | Gross Domestic Production/Population |
| State Manufacturing Tax (SMT) | SPT × (MPC + MPPr + SMC) |
| Default Mfg. Phase Cost (MPC = 1.0) | Manufacturing Phase Profit (MPPr) |
| State Mfg. Price (SMP) | 20 × SMT (≤2.0 × SIP) |
| State Manufacturing Tax (SMT) | 1.0 × SMT |
| State Manufacturer Profit (SMPr) | (2.0 × SMT) + (2.0 × SPT) |
| State Buyer Profit (SBPr) | 2.0 × SMT |
| Total Quantity Cost (TQC) | SMP × SRQ |

16. The table discloses the data and rules included in the service card.

| Service Card | |
|---|---|
| State Commodity Code (SCC) | US-CC-DD |
| State Services Coefficient (SSC) | (TA/P) × 2.25 (Total Area/Population) |
| State Services Efficiency (SSE) | SSP × SSC |
| State Required Quantity (SRQ) | Gross Domestic Production/Population |
| State Services Tax (SST) | SMT × (SPC + SPPr + SSC) Services Phase Cost (SPC = 1.0) Services Phase Profit (SPPr) |
| State Services Price (SSP) | 20 × SST (≤3.0 × SIP) |
| State Services Tax (SST) | 1.0 × SST |
| State Services Profit (SSPr) | (2.0 × SST) + (2.0 × SMT) |
| State Buyer Profit (SBPr) | 2.0 × SST |
| Total Quantity Cost (TQC) | SSP × SRQ |

17. The table discloses the data and rules included in the purchase/sale trading card.

| Purchase/Sale Trading Card | |
|---|---|
| State Commodity Code (SCC) | US-CC-DD |
| State Trading Coefficient (STC) | (P/TA) × 1.35e−3 (Population/Total Area) |
| State Trading Efficiency (STE) | STP × STC |
| State Required Quantity (SRQ) | Gross Domestic Production/Population |
| State Trading Tax (STT) | SST × (TPC + TPPr + STC) = 0.1 STP P/S Trading Phase Cost (TPC = 1.0) Trading Phase Profit (SPPr) |
| State Trading Price (STP) | 20 × STT (≤4.0 × SIP) |
| State Trading Tax (STT) | 1.0 × SST |
| State Trader Profit (STPr) | (2.0 × STT) + (2.0 × SST) |
| State Buyer Profit (SBPr) | 2.0 × SST |
| Total Quantity Cost (TQC) | STP × SRQ |

How can we Develop this Invention?

1. The online gameplay will add more capabilities to players, where players can communicate with each other, continue playing, publish game results online, maintain gameplay, and build on the other players' gains and competitive experiences.

2. Pre-registration is required, cards and money are recorded through encryption. We can introduce the cryptocurrency between the players in the clearing agreements.

3. Each player receives a bonus from registering in the game on the platform, adding to his balance, purchasing additional financial vouchers, and commodities.
4. When a new member is subscribing, he should pay a fee through the platform. When the game is purchased through the stores, the fee is considered in the game's price. Likewise, a subscription is paid periodically every week or every month, meaning that it can be paid daily, weekly, or monthly. This subscription is equivalent to the amount necessary to be spent by humans on buying real commodities and in the game by purchasing virtual commodities. It can be recovered after the deduction of issuance and shipping fees, and it can also be sold to others at any price.
5. According to the player's preferred registration option, the player must pay a monthly or weekly fee periodically to be subscribed and registered on the game website. The membership levels vary by several degrees. According to the player's contribution, the trader earns where the trader will be paid as much as he contributes. If we assume that you brought clients through an inference broker, the broker did not put any money in the sold item, but he provided a service. The broker will then be paid for the service provided. Every person who uses the platform will earn as much as their contribution, and the rank of their participation, logically.
6. Players can return financial vouchers/coupons or commodities deeds and get their money back after deductions for issuance and service fees.
7. Through the platform, points can be transferred from a member to other members. Point vouchers can also be purchased through the platform, as we mentioned above.
8. The platform ensures that the money profits as a result of the platform's use. The platform helps members carry out operations and grants, bonuses, and other earnings to members.
9. Every player is required to purchase the commodities in amounts as assigned in the commodity card. Every sale phase's purchase price depends on the state coefficient, previous price, and phase profits.
10. By investing money, you can start trading, i.e., purchase commodities in bulk and merchandise for resale in the diverse retail outlets.
11. Commodities are sold through the platform store in exchange for points. The manufacturing and production icons and other classification icons identify the members' strengths and capabilities and acquire production tools in a specific state.
12. If the buyer or seller needs to transport or deliver the commodity, they can request the service from any service provider who has these operations and buy the service directly.
13. The platform can provide players with many supporting services, such as shipping and wrapping. All these services will be described in the commodity's description sheet of service.
14. The buyer can hold the commodity deed at the platform in a member's portfolio for the newly issued product until requested in exchange for a retention fee.
15. Every trader on the platform will get promotional rewards when he achieves success. For example, when the player is promoting for sale, by engaging in advertising, purchasing promotional icons, attracting or soliciting purchase requests, and acquiring subscriptions.
16. The sharing of an exclusive agent represents a regional or territorial exclusive agent within the state itself. Members can have privileges as exclusive agents based on paying a lump sum representing the merchant's ability to purchase in bulk and offer competing prices.
17. The exclusive agent here is not limited to the sales and practices of a person who is depriving others of competing. Still, the exclusive agent means the actual control of the regions and thus its ability to compete in price with others. This monopolistic behavior does not prevent others from contributing and competing in providing the same service or commodity with competitive privileges if they want to share, cooperate, and avoid competitors' weaknesses.
18. It is also possible to purchase factories and warehouses for production and distribution, issue product documents as if in bulk, and acquire advantages and privileges.
19. The player can purchase, or trade additional commodities issued by the game platform and achieve the expected profit for himself and all shared traders in the commodity.
20. We have added all the market procedures as a trial to simulate the reality of the market. The random distribution or Gaussian shape distribution ensures the equality between all the players.
21. The rich are benevolent and need doors to be able to communicate these expenses to the needy. The most important thing here is to communicate with them and track those who ensure that their needs are met, where this platform enables them to fulfill and provide what they need, even if they want this to be done in the context of confidentiality.
22. Also, the provision of charitable activities requires bodies and organizations, and through them, the charity people do not know who the beneficiaries are or the targets of their donations. How are these grants spent effectively in meeting the needs of the people? According to the aspects of the spending proposed by the donor. The donors may exclusively designate the purpose.
23. It is possible to build charitable gatherings for charity acts. These gatherings can work within the platform, including those in need. Other groups can organize and harmonize with others' needs and share benefits between philanthropic people and volunteers jointly. From the other side, the volunteers exert efforts to bring them together in making a joint venture effort to offer charity work and meet the societal needs necessary in some way in crises, disasters, and epidemics.
24. It is possible to launch a corresponding charitable commodity and support agent for the distinguished, prominent commodity in each state.
25. There are multiple aspects of spending, needs, and in the doors of spending purposes of spending and charitable work provided by individuals and groups. Likewise, the needy individuals and groups can be placed in the form of a commodity, and the platform issues the first issuer and registrar body for it.
26. The platform can launch projects after approval by its sponsors and supporters. The projects are established based on payment campaigns for financing the charitable commodity. These commodities may be linked to the state in concern and called in their name.
27. Just as there is a rush to do charity deeds, there is competition in winning the charity deed commodity and the related commodities. This competition also has a role in benefiting the community of a region with its people's help. Who is benevolent and sympathetic to a region or affiliated with these areas?
28. It becomes clear that expertizing experimentation and training systems can achieve leadership and precedence in establishing the correct market system mechanisms and rules needed and upon which societies are based.

29. Procurement requests for commodities can be traced to facilitate the purpose of the fairtrade market and benevolent donor parties.

30. A charity donor may sell the commodity or offer it to another buyer at an advantageous price. The deal is not for financial gain, but to earn charitable deeds and rewards from God and reinforce other values that religion and humanity.

31. Competition can be held periodically between the platform members to grant the funds. The funds can also be collected from the profits of their purchases. Some granted funds can be given to the most active members. The members were exerting more effort that can be proved through analysis of his behavior on the platform.

32. What is happening through the platform is a circulation and redistribution of wealth, not gambling in the casino. We can someday arrive at the game commodity deeds are replaced with real products, and the profits become real.

33. The profits achieved at the start of the fairtrade market mechanisms' preliminary application represent the players' conviction and acceptance of these rules. The profits are achieved with the consent of the counterparty in the sale. The knowledge and mechanisms have been acquired by this well-trained game, which is considered an expert system. The extracted rules and obtained conclusions from the game will be included by necessity in the modern fairtrade market.

What is claimed is:

1. An apparatus to be employed for entertainment or educational purposes, the apparatus comprising:

a first dodecahedron die including twelve first die surfaces, with a first set of eight of the twelve first die surfaces each showing a distinct one of eight possible numbers when rolled, and with a second set of four of the twelve first die surfaces each showing a distinct one of the eight possible numbers when rolled;

a second dodecahedron die including twelve second die surfaces, with a first set of eight of the twelve second die surfaces each showing a distinct one of the eight possible numbers when rolled, and with a second set of four of the twelve second die surfaces each showing a distinct one of the eight possible numbers when rolled, the distinct one of the eight possible numbers shown on each of the second set of four of the twelve second die surfaces being distinct from the distinct one of the eight possible numbers shown on each of the second set of four of the twelve first die surfaces;

a game board including a plurality of regions, each region corresponding to a geographic location, each region including a commodity code comprising a first digit and a second digit, the first digit including a first one of the eight possible numbers and the second digit including a second one of the eight possible numbers, each region having a corresponding plurality of cards and a corresponding plurality of coins, each of the corresponding plurality of cards showing the commodity code;

wherein the first dodecahedron die indicates a first indicated one of the eight possible numbers when rolled and the second dodecahedron die indicates a second indicated one of the eight possible numbers when rolled, the first indicated one of the eight possible numbers combined with the second indicated one of the eight possible numbers forming an indicated commodity code, and a chosen region is chosen by matching the indicated commodity code with the commodity code shown on the chosen region's corresponding plurality of cards;

wherein each region's corresponding plurality of cards includes a corresponding location card, a corresponding production card, a corresponding manufacturing card, a corresponding services card, and a corresponding purchase card;

wherein each region's corresponding plurality of coins includes a corresponding location coin, a corresponding production coin, a corresponding manufacturing coin, a corresponding services coin, and a corresponding purchase coin.

2. The apparatus of claim 1 wherein the plurality of regions correspond to real world locations.

3. The apparatus of claim 2 wherein the real world locations include states of the United States of America.

4. The apparatus of claim 3 wherein each corresponding location card includes first information relating to its corresponding region, the first information including at least one of a state capital, a largest city, a total area (TA)/rank, a population (P)/rank, a mean household income (MHO/rank, a gross domestic production (GDP)/rank, an altitude, an iconic commodity, a universal time zone, an average climate temperature, a significant company, and an iconic state landmark.

5. The apparatus of claim 4 wherein each corresponding location card includes a first side and a second side with at least some of the first information on the first side and at least some of the first information on the second side.

6. The apparatus of claim 3 wherein each corresponding production card includes second information relating to its corresponding region, the second information including the commodity code and at least one of a state production coefficient (SPC), a state production efficiency (SPE), a state required quantity (SRQ), a state issuing tax (SIT), a state issuing price (SIP), a state production tax (SPT), a state production price (SPP), a state producer quantity profit (SPQPr), a state buyer quantity profit (SBQPr), a state production quantity tax (SPAT) paid by sale parties, and a commodity total quantity cost (TQC).

7. The apparatus of claim 6 wherein each corresponding production card includes a first side and a second side with at least some of the second information on the first side and at least some of the second information on the second side.

8. The apparatus of claim 3 wherein each corresponding manufacturing card includes third information relating to its corresponding region, the third information including the commodity code and at least one of a state manufacturing coefficient (SMC), a state manufacturing efficiency (SME), a state required quantity (SRQ), a state manufacturing tax (SMT), a state manufacturing price (SMP), a state manufacturer quantity profit (SMQPr), a state buyer quantity profit (SBQPr), a state manufacturing quantity tax (SMQT) paid by sale parties, and a commodity total quantity cost (TQC).

9. The apparatus of claim 8 wherein each corresponding manufacturing card includes a first side and a second side with at least some of the third information on the first side and at least some of the third information on the second side.

10. The apparatus of claim 3 wherein each corresponding services card includes fourth information relating to its corresponding region, the fourth information including the commodity code and at least one of a state services coefficient (SSC), a state services efficiency (SSE), a state required quantity (SRQ), a state services tax (SST), a state services price (SSP), a state services-provider quantity profit (SSQPr), a state buyer quantity profit (SBQPr), a state services quantity tax (SSQT) paid by sale parties, and a commodity services total quantity cost.

11. The apparatus of claim 10 wherein each corresponding services card includes a first side and a second side with at least some of the fourth information on the first side and at least some of the fourth information on the second side.

12. The apparatus of claim 3 wherein each corresponding purchase card includes fifth information relating to its corresponding region, the fifth information including the commodity code and at least one of a state trading coefficient (STC), a state trading efficiency (STE), a state required quantity (SRQ), a state trading tax (STT), a state trading price (STP), a state trader quantity profit (STQPr), a state buyer quantity profit (SBQPr), a state trading quantity tax (STQT) paid by sale parties, and a commodity total quantity cost (TQC).

13. The apparatus of claim 12 wherein each corresponding purchase card includes a first side and a second side with at least some of the fifth information on the first side and at least some of the fifth information on the second side.

14. The apparatus of claim 3 wherein the game board includes a pentagon including five sides, each side configured with at least one insignia representing at least one state of the United States of America.

15. The apparatus of claim 14 wherein each at least one insignia includes information relating to a state name and a state the commodity code.

16. The apparatus of claim 1 wherein the game board includes a pentagon including five sides, each side configured with at least one game board region of the plurality of regions.

17. The apparatus of claim 1 further comprising:

a market regulations card showing a market regulations number, the market regulations number comprising a first digit and a second digit, the first digit including a first one of the eight possible numbers and the second digit including a second one of the eight possible numbers, wherein the first digit matches the second digit;

wherein the first indicated one of the eight possible numbers of the first die combined with the second indicated one of the eight possible numbers of the second die forms an indicated regulations code when the first indicated number matches the second indicated number, and the market regulations card is chosen by matching the indicated regulations code with the market regulations number shown on the market regulations card.

18. The apparatus of claim 17 wherein the market regulations number is selected from the group: 11, 22, 33, 44, 55, 66, and 77.

19. The apparatus of claim 1 wherein the eight possible numbers includes the numbers 0, 1, 2, 3, 4, 5, 6, and 7.

20. The apparatus of claim 1 wherein the second set of four of the twelve first die surfaces show the numbers 1, 3, 5, and 7.

21. The apparatus of claim 1 wherein the second set of four of the twelve second die surfaces show the numbers 0, 2, 4, and 6.

* * * * *